United States Patent [19]

Murata et al.

[11] 4,325,626

[45] Apr. 20, 1982

[54] ELECTROSTATIC COPYING APPARATUS

[75] Inventors: Naoaki Murata, Takarazuka; Masahiro Yoshioka, Matsubara; Kiyoshi Hayashi, Takatsuki; Yasusuke Tohi, Sakai, all of Japan

[73] Assignee: Mita Industrial Co., Ltd., Osaka, Japan

[21] Appl. No.: 99,720

[22] Filed: Dec. 3, 1979

[30] Foreign Application Priority Data

| | | | |
|---|---|---|---|
| Dec. 13, 1978 | [JP] | Japan | 53-153203 |
| Feb. 2, 1979 | [JP] | Japan | 54-10304 |
| Mar. 29, 1979 | [JP] | Japan | 54-41643[U] |
| Apr. 5, 1979 | [JP] | Japan | 54-40302 |
| May 25, 1979 | [JP] | Japan | 54-70992[U] |
| May 25, 1979 | [JP] | Japan | 54-70993[U] |
| May 25, 1979 | [JP] | Japan | 54-70994[U] |
| May 25, 1979 | [JP] | Japan | 54-70995[U] |

[51] Int. Cl.[3] ..... G03G 15/00

[52] U.S. Cl. ..... 355/3 DR

[58] Field of Search ..... 355/3 R, 3 DR, 133; 29/123

[56] References Cited

U.S. PATENT DOCUMENTS

| | | | |
|---|---|---|---|
| 3,724,940 | 4/1973 | Koizumi | 355/3 R |
| 3,730,622 | 5/1973 | Freeman et al. | 355/14 |
| 3,914,046 | 10/1975 | Tanaka et al. | 355/15 |
| 3,923,391 | 12/1975 | Washio et al. | 355/3 R |
| 3,998,537 | 12/1976 | Smith et al. | 355/3 DD |
| 3,998,548 | 12/1976 | Wakatsuki | 355/3 DR X |
| 4,009,957 | 3/1977 | Suzuki et al. | 355/14 |
| 4,017,181 | 4/1977 | Komaba et al. | 355/72 |
| 4,026,648 | 5/1977 | Takahashi | 355/15 |
| 4,076,402 | 2/1978 | Kanno et al. | 355/3 DR |
| 4,089,600 | 5/1978 | Ito et al. | 355/3 CH |
| 4,114,998 | 9/1978 | Shimizu et al. | 355/3 DR |

FOREIGN PATENT DOCUMENTS 53-30499 8/1978 Japan .

*Primary Examiner*—Fred L. Braun

*Attorney, Agent, or Firm*—Wenderoth, Lind & Ponack

[57] ABSTRACT

An electrostatic copying apparatus of the type in which a rotary drum having a photosensative member on its surface is rotatably and detachably disposed at a predetermined location within a housing. The apparatus has a pair of inner side plates spaced apart from each other in the direction of the central axial line of rotation of said rotary drum, a guide and support member mounted at a predetermined location on the inside surface of each of said said plates, and formed in each said guide and support member, a bearing hole having a recess opened in a direction substantially perpendicular to said central axial line of rotation and at least one guide surface extending from said recess of said bearing hole in a direction substantially perpendicular to said central axial line of rotation. When a selected site of each of both side portions of said rotary drum is moved along each said guide surface, each of said side portions of said rotary drum is positioned within each said bearing hole through each said recess and thus, said rotary drum is mounted rotatably and detachably in the direction substantially perpendicular to said central axial line of rotation.

4 Claims, 42 Drawing Figures

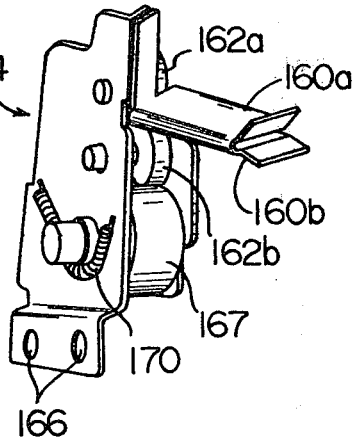
FIG. 12
FIG. 11
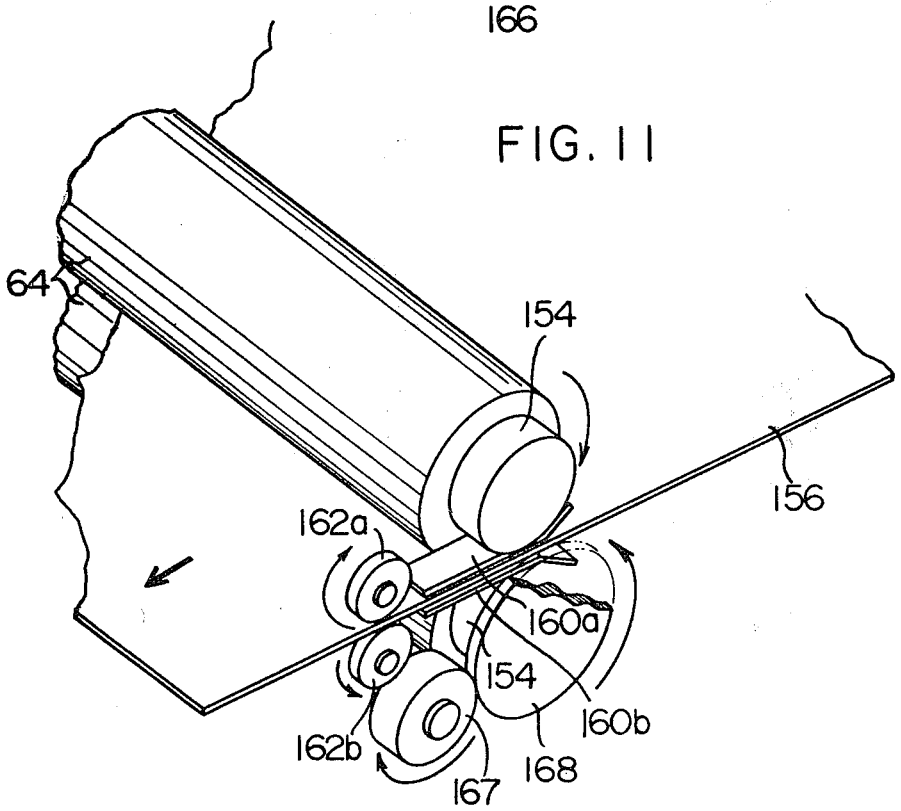

FIG. 19-A
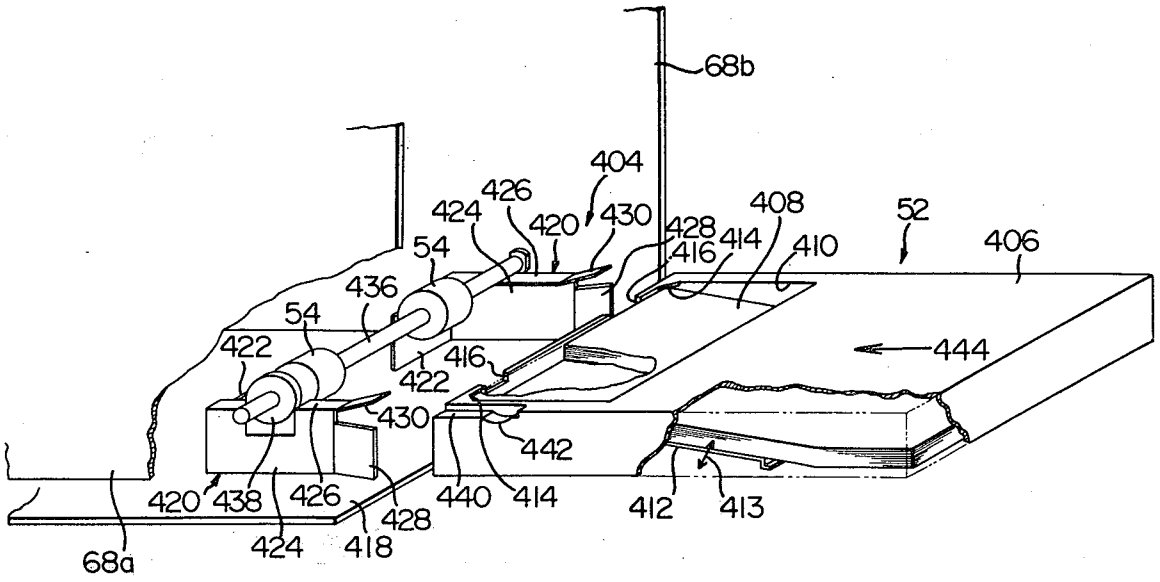

FIG. 19-B
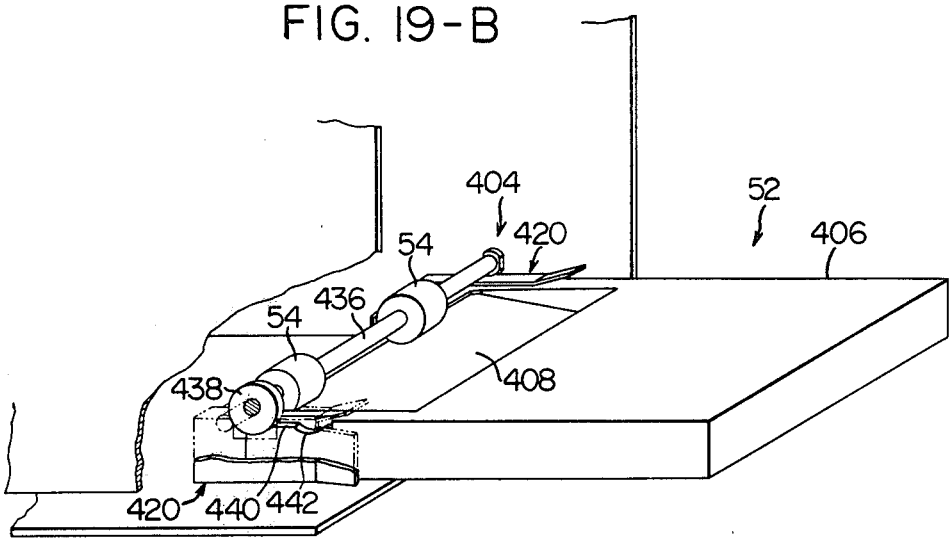
FIG. 19-C
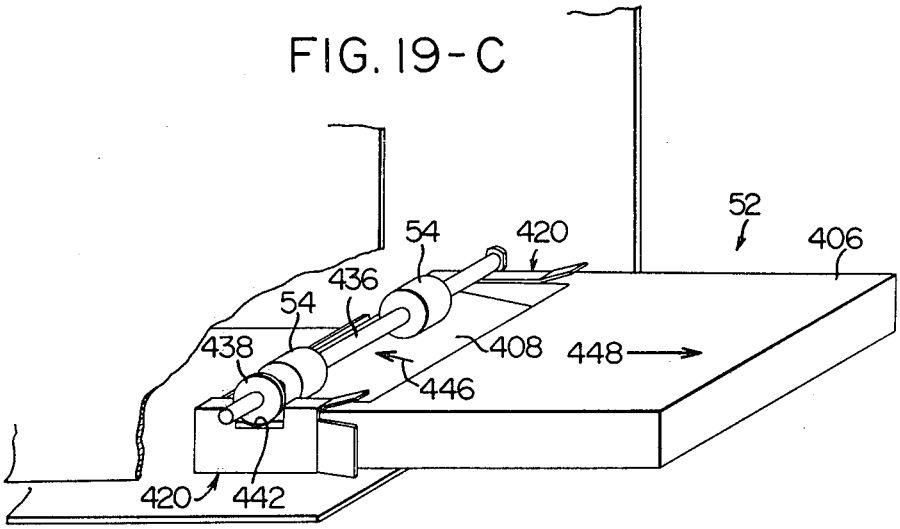

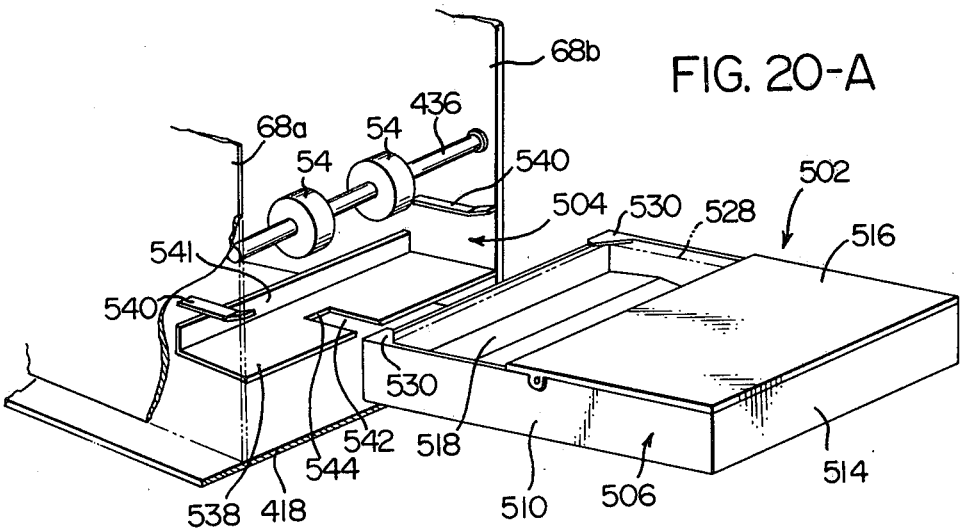
FIG. 20-A
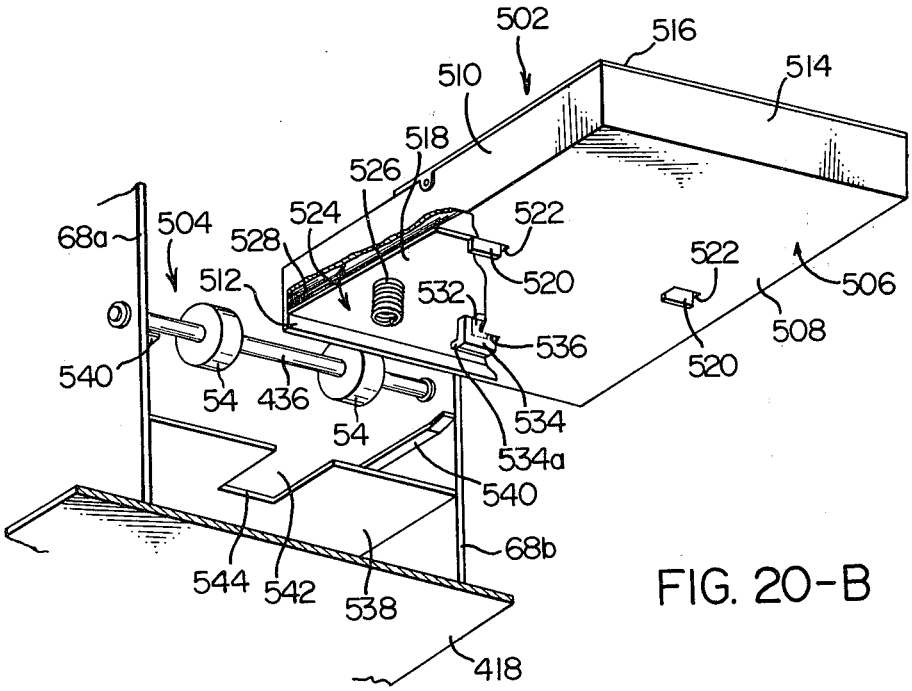
FIG. 20-B

FIG. 21-A
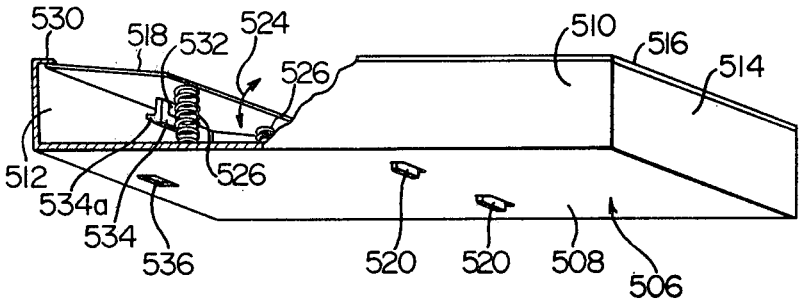
FIG. 21-B
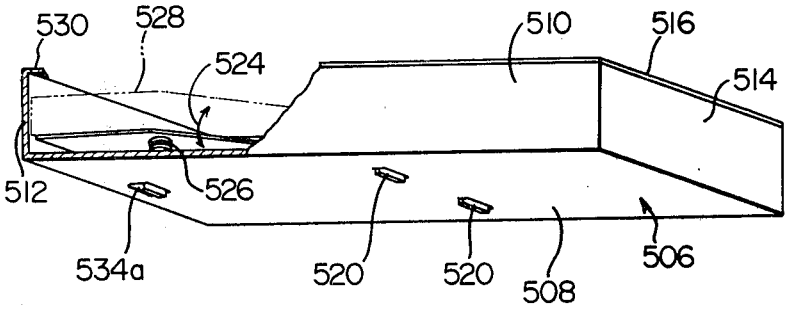

FIG. 22-A
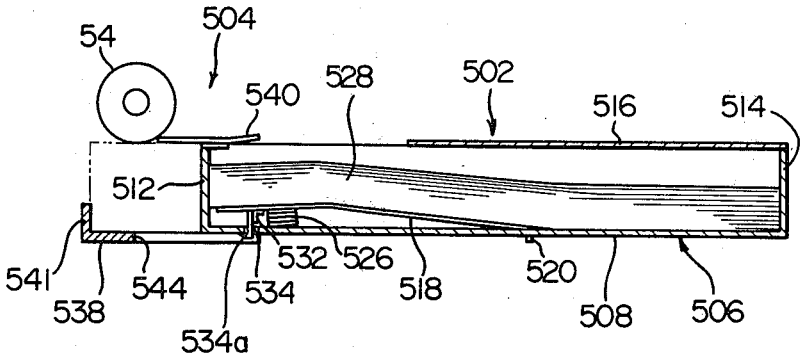
FIG. 22-B
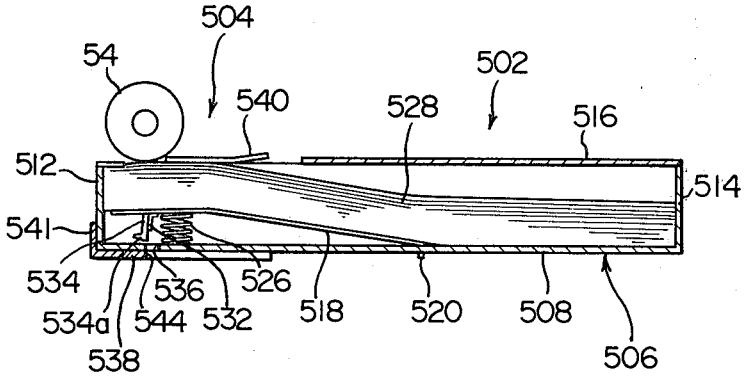

FIG. 27-A
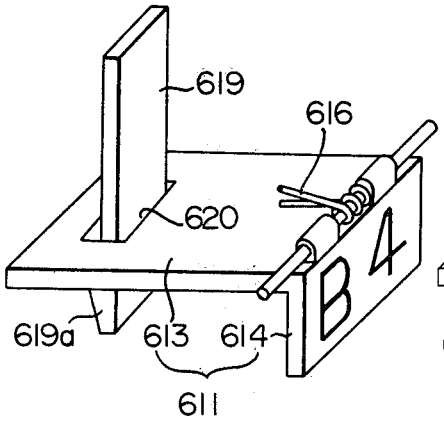
FIG. 27-B
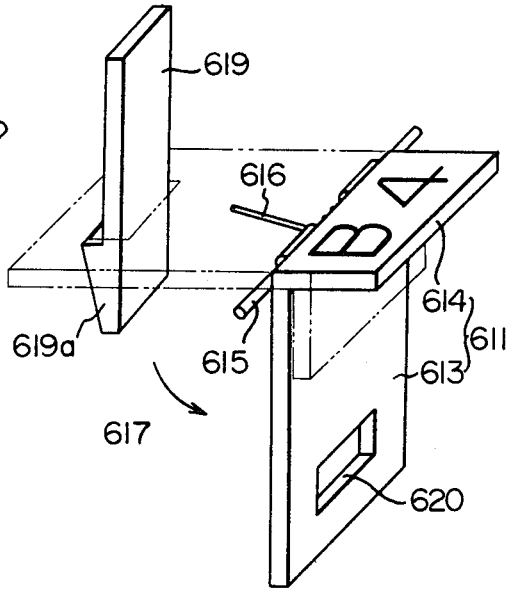
FIG. 28
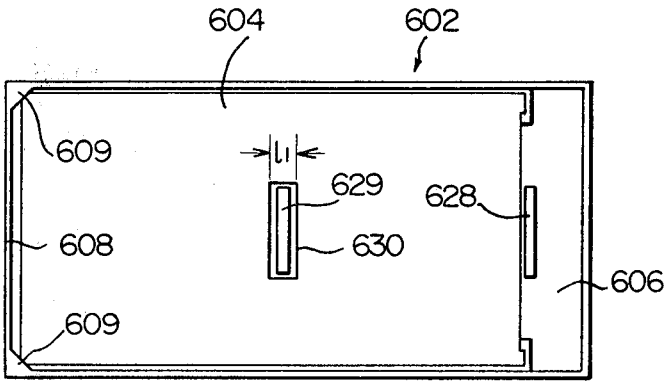

FIG. 34-A
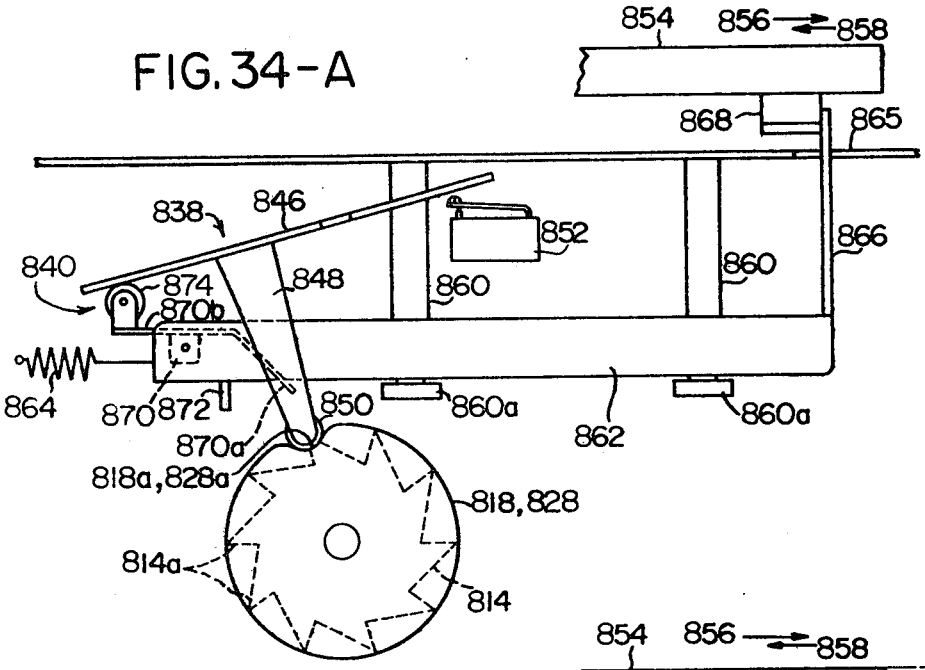
FIG. 34-B
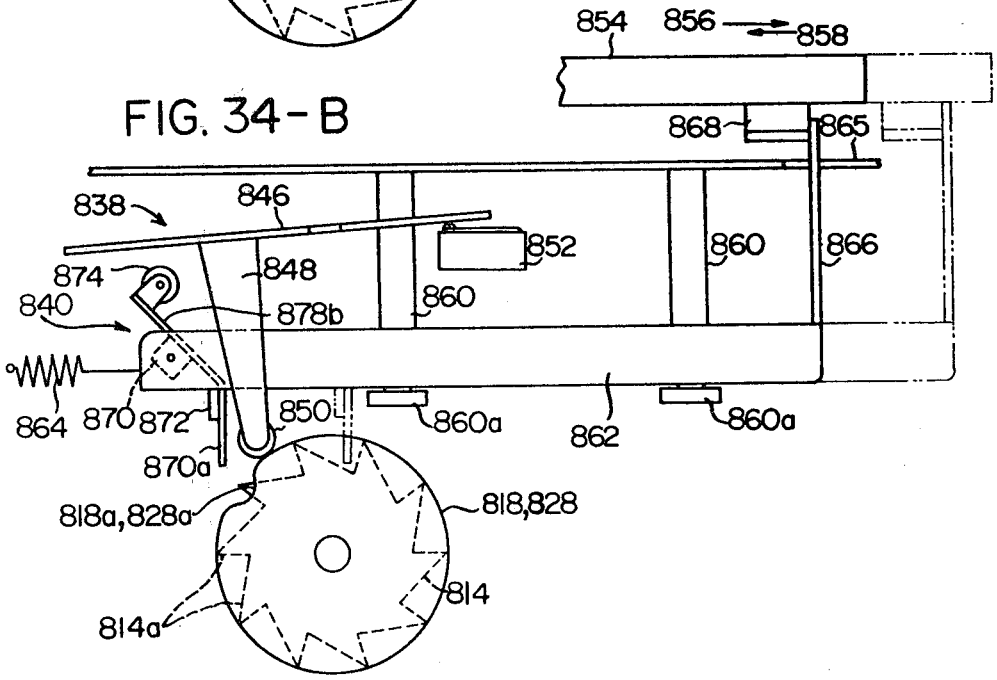

ELECTROSTATIC COPYING APPARATUS

FIELD OF THE INVENTION

This invention relates to an electrostatic copying apparatus, particularly an electrostatic copying apparatus of the type in which a rotary drum having a photosensitive member on its surface is rotatably and removably disposed within a housing.

DESCRIPTION OF THE PRIOR ART

In an electrostatic copying apparatus equipped with a rotary drum having a photosensitive member on its surface, there is generally practiced a transfer-type electrostatic copying process which involves forming on the photosensitive member a latent electrostatic image corresponding to a pattern of an original, optionally developing the latent image, and thereafter transferring the latent electrostatic image or optionally the developed image on the photosensitive member to a copying sheet. It is well known to those skilled in the art that in such an electrostatic copying apparatus, the rotary drum having a photosensitive member on its surface needs to be mounted rotatably and removably at a predetermined site within a housing of the apparatus in order to easily remove paper jamming that may occur around the rotary drum or to exchange or clean the photosensitive member as required. Thus, conventional electrostatic copying apparatuses are so constructed that the rotary drum can be mounted and detached by moving it in the direction of its central axial line of rotation. In has been found, however, that such a conventional structure has important problems to be solved. In an electrostatic copying apparatus of the conventional structure, when paper jamming occurs on the peripheral surface of the rotary drum, the rotary drum should be detached by moving it in the direction of its central axial line of rotation. In this operation, the rotary drum is moved relative to the jammed copying sheet while the jammed sheet is in contact with the photosensitive member on the surface of the rotary drum. Thus, the jammed paper rubs the surface of the photosensitive member at the time of detaching the rotary drum, and this may cause damage or degradation of the photosensitive member. Furthermore, in a conventional electrostatic copying apparatus, when paper jamming occurs on the peripheral surface of the rotary drum, it is generally necessary to move the entire rotary drum out of the housing so as to remove the jammed paper. The operation of removing the jammed paper is therefore complicated.

Electrostatic copying apparatuses of the known type described above also have problems or defects which must be solved or remedied in various respects such as the mode of mounting a developing station on the rotary drum, the method of supplying a developer to the developing station, the construction of a paper feeding cassette for feeding copying sheets, and the construction of a charge eliminating lamp for eliminating a residual charge on the photosensitive member.

SUMMARY OF THE INVENTION

It is a primary object of this invention to provide a novel and excellent electrostatic copying apparatus of the type in which a rotary drum having a photosensitive member on its surface is rotatably and removably disposed at a predetermined site within a housing, wherein the rotary drum can be mounted and detached without the need to move it in the direction of its central axial line of rotation and thus, there is no likelihood of damage or degradation of the surface of the photosensitive member which is due to the movement of the rotary drum in the direction of its central axial line of rotation, and wherein paper jamming that may occur on the peripheral surface of the rotary drum can be removed without the need to move the entire rotary drum out of the housing and therefore the operation of removing a jammed copying paper can be performed easily and rapidly.

Another object of this invention is to solve or remedy various problems or defects which reside with electrostatic copying apparatuses of the conventional type, as will be described hereinbelow.

According to this invention, there is provided, as an electrostatic copying apparatus which achieves the aforesaid primary object, an electrostatic copying apparatus of the type in which a rotary drum having a photosensitive member on its surface is rotatably and detachably disposed at a predetermined location within a housing, said apparatus comprising a pair of inner side plates spaced apart from each other in the direction of the central axial line of rotation of said rotary drum, a guide and support member mounted at a predetermined location on the inside surface of each of said side plates, and formed in each said guide and support member, a bearing hole having a recess opened in a direction substantially perpendicular to said central axial line of rotation and at least one guide surface extending from said recess of said bearing hole in a direction substantially perpendicular to said central axial line of rotation, whereby when a selected site of each of both side portions of said rotary drum is moved along each said guide surface, each of said side portions of said rotary drum is positioned within each said bearing hole through each said recess to mount said rotary drum rotatably and detachably in the direction substantially perpendicular to said central axial line of rotation.

According to this invention, there are also provided improved electrostatic copying apparatuses which solve or remedy the various problems or defects residing with the conventional electrostatic copying apparatuses, as will be apparent from the following description.

BRIEF DESCRIPTION OF THE DRAWINGS

FIG. 11 is a partly broken-away perspective view showing a peel means provided in relation to a pair of press rolls in the electrostatic copying apparatus shown in FIGS. 1 and 2;

FIG. 12 is a partial perspective view of the peel means shown in FIG. 11;

FIGS. 19-A to 19-C are partial perspective views showing a cassette-type paper feed means in one embodiment of the electrostatic copying apparatus in accordance with this invention;

FIGS. 20-A and 20-B are partial perspective views showing a second embodiment of the cassette-type paper feed means;

FIGS. 21-A and 21-B are perspective views of a copying paper cassette used in the cassette-type paper feed means shown in FIGS. 20-A and 20-B;

FIGS. 22-A and 22-B are sectional views of the cassette-type paper feed means shown in FIGS. 20-A and 20-B;

FIGS. 27-A and 27-B are perspective views of a restricting member;

FIG. 28 is a top plan view of a main body of a cassette casing;

FIGS. 34-A and 34-B are simplified sectional views for illustrating the action of the operation repeating counters shown in FIGS. 32 and 33.

DETAILED DESCRIPTION OF PREFERRED EMBODIMENTS

The invention is described below in detail with reference to the accompanying drawings.

Outline of the general structure of the appartus

Figure 1:
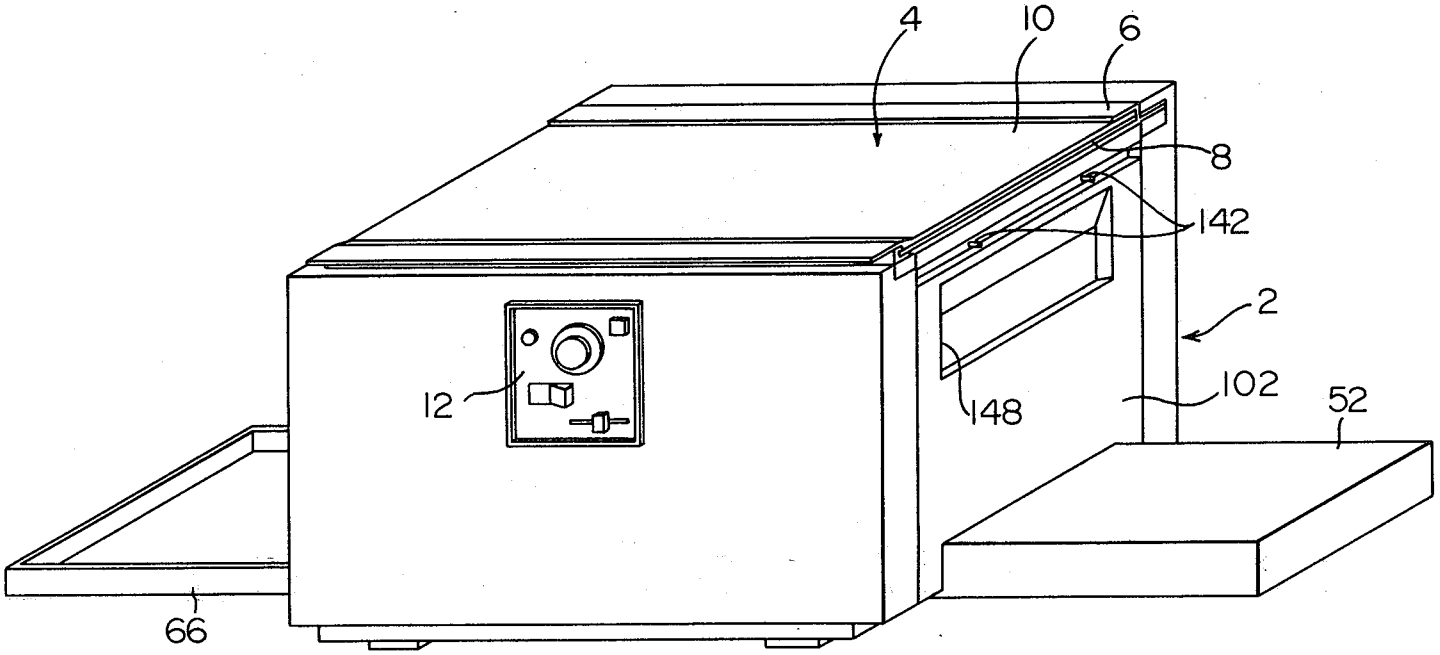
FIG. 1 is a perspective view showing one embodiment of the electrostatic copying apparatus in accordance with this invention.
Figure 2:
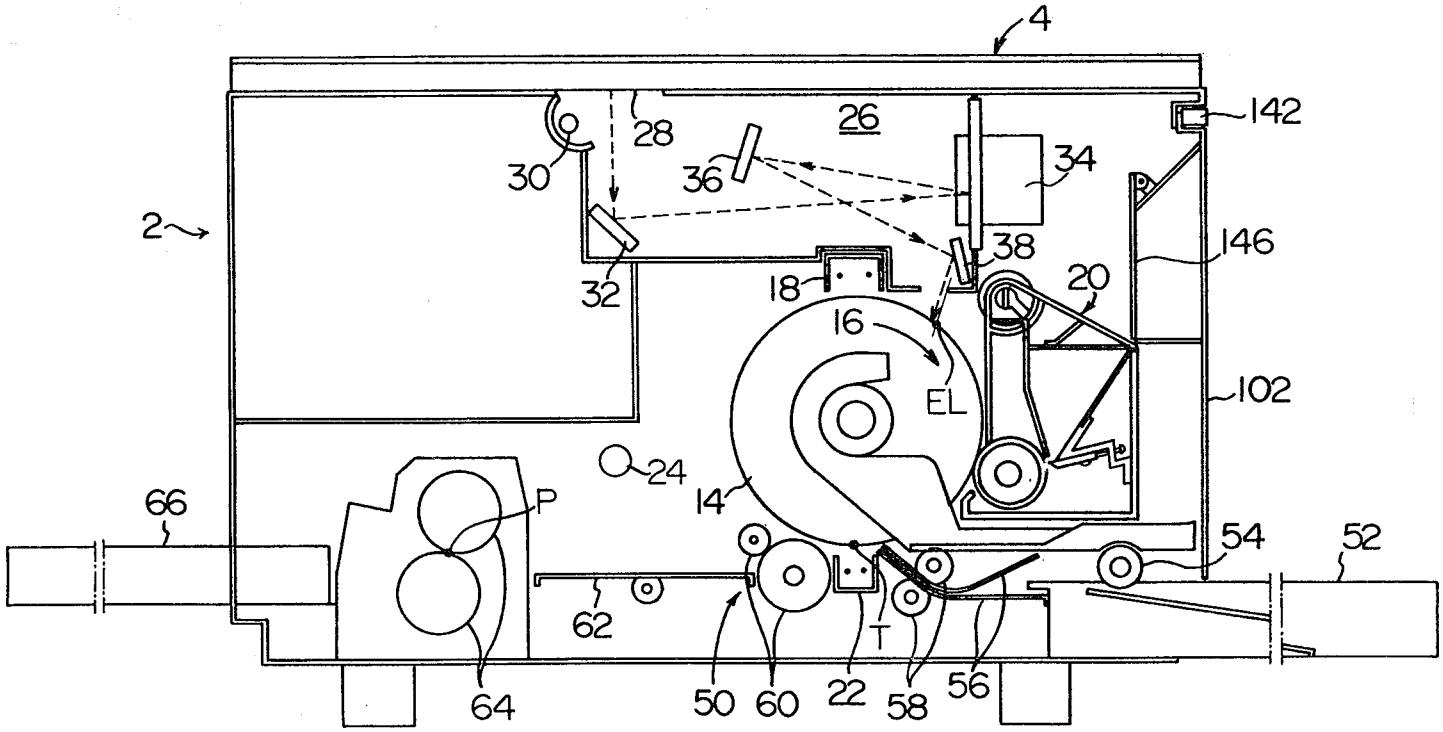
FIG. 2 is a simplified sectional view of the electrostatic copying apparatus shown in FIG. 1.

Referring to FIGS. 1 and 2, the general structure of the illustrated electrostatic copying apparatus is first described.

The electrostatic copying apparatus shown in the drawings has a substantially rectangular parallelpipedal housing generally shown at 2. On the top surface portion of the housing 2 is disposed an original-support means 4 for supporting an original to be copied. The original-support means 4 in the illustrated embodiment consists of a support frame 6 mounted so that it can move in the direction of scanning the original (in the transverse direction in FIGS. 1 and 2) by a suitable method, a transparent plate 8 secured to the support frame 6 for placing thereon the original to be copied, and an original-holding member 10 having one edge (top edge in FIG. 1) connected to the support frame 6 and capable of being brought to a condition in which it covers the original placed on the transparent plate 8 (the condition shown in FIGS. 1 and 2). In the copying process, the original-support means 4 is moved in the right or left direction in FIGS. 1 and 2 by a suitable drive means (not shown). A control panel 12 having a control switch, etc. is disposed on the front surface portion of the housing 2.

As briefly illustrated in FIG. 2, a cylindrical rotary drum 14 having a photosensitive member in at least a part of its peripheral surface is mounted rotatably and detachably at a central portion of the inside of the housing 2 by a method to be described hereinbelow. Around the rotary drum 14 to be rotated in the direction of arrow 16 are arranged successively along its rotating direction a corona discharge device 18 for charging the photosensitive member, a developing (and cleaning) station 20 which constitutes both a developing means for applying toner particles to a latent electrostatic image formed on the photosensitive member to develop it and a cleaning means for removing toner particles remaining on the photosensitive member after performing a transferring step in the illustrated embodiment (the developing station 20 will be described in detail hereinbelow), a corona discharge device 22 for transferring the developed image formed on the photosensitive member to a copying paper, and a charge eliminating lamp 24 for removing the residual charge on the photosensitive member after the transferring step.

An optical system 26 for projecting an image of an original supported on the original-support means 4 onto the photosensitive member is disposed above the rotary drum 14. The optical system 26 includes an original-illuminating lamp 30 for illuminating the original through an exposure opening 28 formed on the top surface of the housing 2 and a first reflecting mirror 32, a second reflecting mirror 36 and a third reflecting mirror 38 for projecting the reflecting light from the original onto the photosensitive member. This optical system 26 projects the image of the original supported on the original support member 4 onto the photosensitive member at a position immediately downstream of the corona discharger 18 viewed in the rotating direction of the rotary drum 14.

The illustrated electrostatic copying apparatus further includes a copying paper transfer system shown generally at 50. The copying paper transfer system 50 is constructed of a paper feeding cassette 52 whose front part is partially inserted in the housing 2 through an insertion opening formed on the right end wall of the housing 2, paper feed rollers 54 for sending out copying sheets accommodated in the cassette 52 one by one, a pair of transfer rollers 58 for transferring the copying sheet delivered by the paper feed rollers 54 to a transfer zone having the corona discharge device 22 disposed therein through a pair of guide plates 56, a pair of separating rollers 60 for separating the copying paper adhering closely to the surface of the rotary drum 14 in the transfer zone from the rotary drum 14 and withdrawing it from the transfer zone, a pair of press rollers 64 for pressing the copying paper sent from the separating rollers 60 through a guide plate 62 to fix the transferred image to the copying paper and a tray 66 for receiving the copying paper delivered from the press roller pair 64.

In an electrostatic copying apparatus of the illustrated type including a pair of press rollers 64 for fixing the developed image transferred to the copying paper by pressing the copying paper, it is important that the sum of $l_1$ and $l_2$ wherein $l_1$ is the distance along the surface of the photosensitive member from the downstream and viewed in the rotating direction of the rotary drum 14 (the position shown by EL in FIG. 2) to the transfer position at which the developed image formed on the surface of the photosensitive member is transferred to the copying paper (the position shown by T in FIG. 2) in an exposing zone in which the image of an original is projected onto the surface of the photosensitive member and $l_2$ is the length of the copying paper transfer passage from the transfer position T to the nip position of the press roller pair 64 (the position shown by P in FIG. 2) should be equal to, or larger than, the maximum copying length L of the electrostatic copying machine (i.e., the maximum length of the copying paper transferred to the press roller pair 64 past the transfer position T), i.e. $l_1+l_2 \geqq L$. The reason for this is as follows: If $l_1+l_2<L$, the forward end of the copying paper which has been conveyed past the transfer position T reaches the nip position P of the press roller pair 64, and is nipped by the press roller pair 64, before the projection of the image of the original onto the surface of the photosensitive member is completed. To fix the transferred developed image fully to the coying paper, the copying paper should be nipped by the press roller pair 64 under a fairly high pressure. Thus, a considerable impact occurs when the forward end of the copying paper is nipped by the press roller pair 64. This impact is transmitted to the rotary drum 14, the optical system 26 and the original support means 4 through transmission members such as chains connected to the press roller pair 64. Consequently, so-called exposure blurring occurs in the projection of the image of the original onto the surface of the photosensitive member, and the copied image obtained has blurring. In contrast, when the above relation $l_1+l_2=L$ is satisfied, the projection of the image of the original onto the surface of the photosensitive member in the exposing zone is completed before or at the same time as the forward end of the copying paper is nipped by the press roller pair 64, and therefore, the occurrence of the exposure blurring can be avoided.

Mode of mounting the rotary drum

Figure 3:
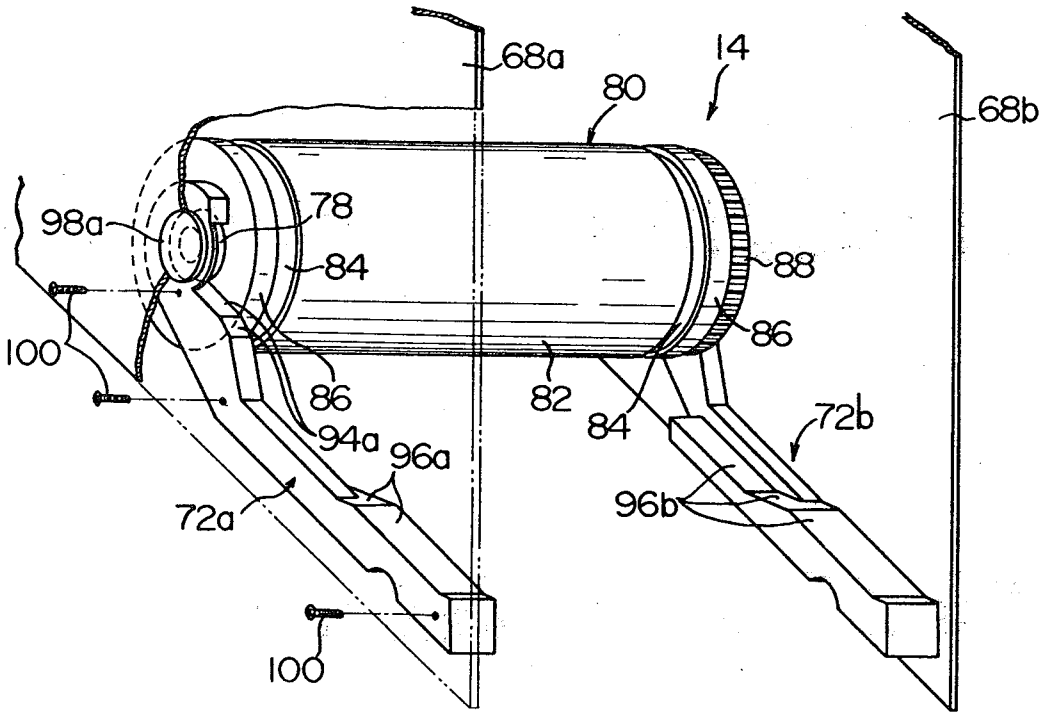
FIG. 3 is a partial perspective view showing the mode of mounting the rotary drum in the electrostatic copying apparatus shown in FIGS. 1 and 2.
Figure 4:
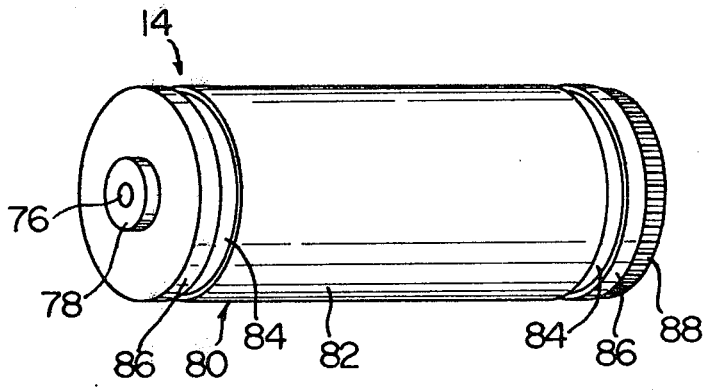
FIG. 4 is a perspective view of the rotary drum in the apparatus of this invention.
Figure 5:
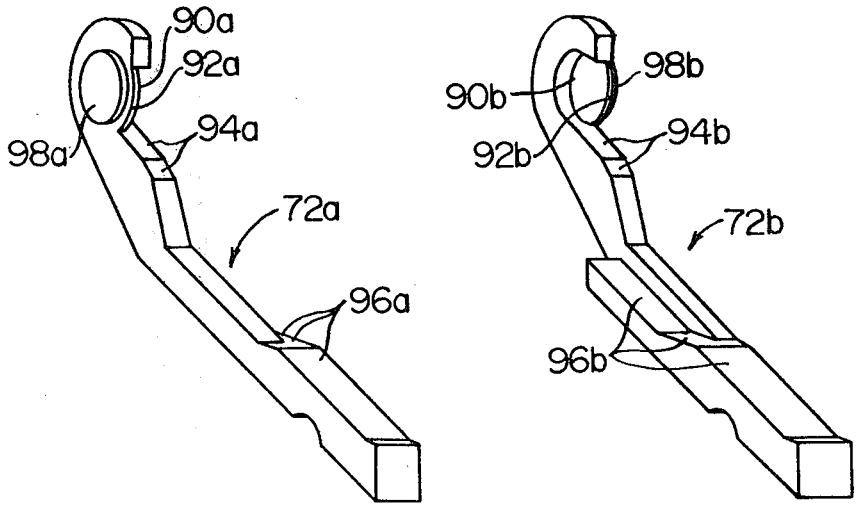
FIG. 5 is a perspective view of a guide and support member used in mounting the rotary drum.
Figure 6:
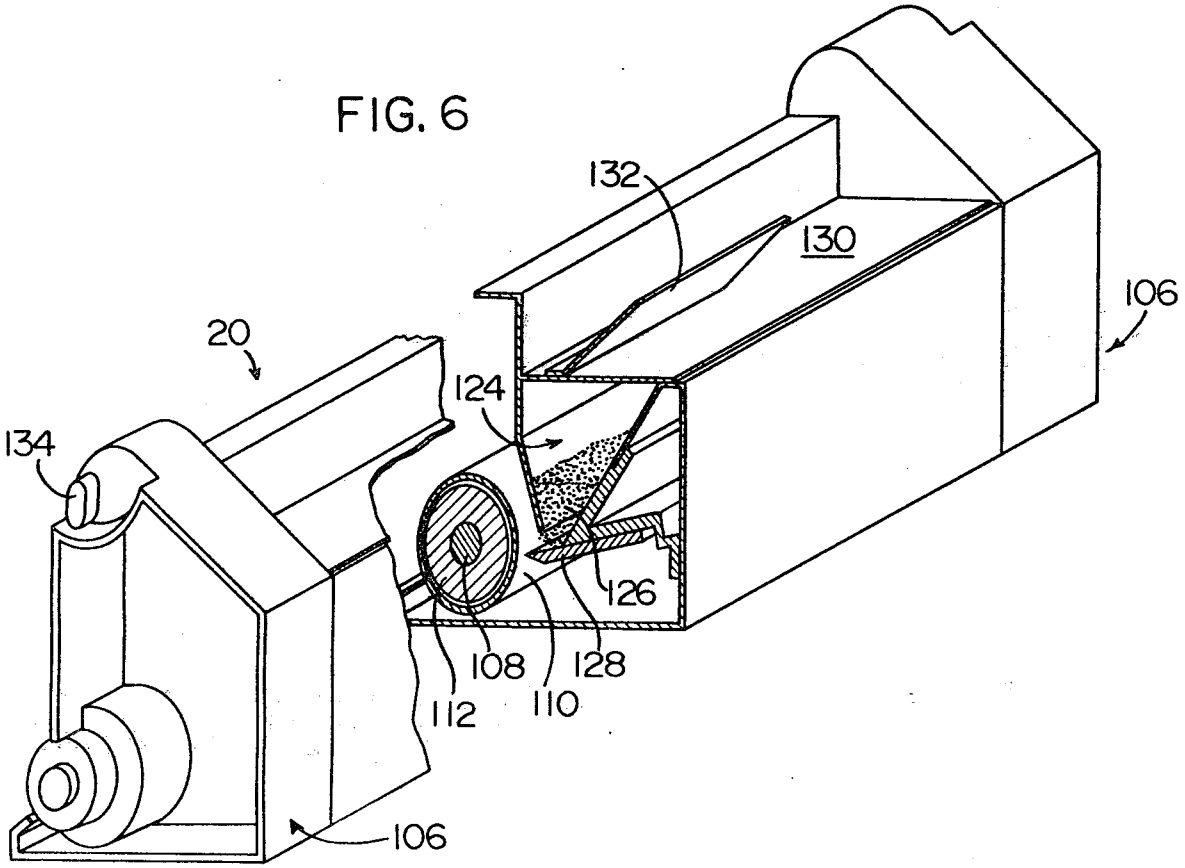
FIG. 6 is a partly broken-away perspective view showing a developing station used in the electrostatic copying apparatus shown in FIGS. 1 and 2.

Now, referring to FIGS. 3 to 5, the mode of mounting the rotary drum 14 is described.

Referring to FIG. 3, in the illustrated embodiment, a pair of inner side plates 68*a* and 68*b* spaced from each in the direction of the central axial line of rotation of the rotary drum 14 (in a direction perpendicular to the sheet surface in FIG. 2) are disposed within the housing 2 (see FIGS. 1 and 2). Guide and support members 72*a* and 72*b* for use in mounting the rotary drum 14 are provided respectively to the inside surfaces of the side plates 68*a* and 68*b*.

Before describing the structure of the guide and support members 72*a* and 72*b* in detail, the structure of the rotary drum 14 is described with reference to FIGS. 3 and 4. The rotary drum 14 is composed of a shaft 76, bearing members 78 of a relatively small diameter disposed on both side ends of the shaft 76 (only one of them is shown in the drawing), and a drum member 80 fixed to the shaft 76 between the bearing members 78. A photosensitive member 82 made of a suitable material is disposed on the main surface of the drum member 80. An annular groove 84 having a slightly smaller diameter than the outside diameter of the photosensitive member 82 is located in the drum member 80 exteriorly of each of the side ends of the photosensitive member 82, and a non-photosensitive area 86 preferably having substantially the same outside diameter as the outside diameter of the photosensitive member 82 is located further exteriorly of each annular groove 84. The forward end of a peel member (not shown) well known to those skilled in the art for peeling off a copying paper in contact with the surface of the photosensitive member 82 for transfer of a developed image (the copying paper has a slightly larger width than the width of the photosensitive member 82 and its both side edges are located at the annular grooves 84) from the surface of the photosensitive member after transfer is positioned at a pair of said annular grooves 84. As will be described in detail hereinafter, a pair of spacer rings abut a pair of said non-photosensitive areas 86 so as to prescribe the distance between the surface of a developing sleeve of the developing station 20 and the photosensitive member 82. Furthermore, a gear 88 preferably having a slightly smaller outer diameter than the outside diameter of the non-photosensitive area 86 is provided at one side end portion (i.e. between one end of the drum member 80 and one bearing member 78) of the rotary drum 14. The gear 88 which rotates integrally with the shaft 76 and the drum member 80 is connected to a drive power source through a suitable gear mechanism (not shown) when the rotary drum 14 is mounted in position. Consequently, the rotary drum 14 is driven in the direction shown by arrow 16 in FIG. 2.

With reference to FIG. 5 together with FIG. 3, the construction of a pair of guide and support members 72*a* and 72*b* will now be described. The guide and support members 72*a* and 72*b* illustrated in the drawings respectively have bearing holes 90*a* and 90*b* for receiving the bearing members 78 disposed on both side ends of the rotary drum 14. It is essential that such bearing holes 90*a* and 90*b* should have recesses 92*a* and 92*b* respectively which are opened in a direction substantially perpendicular to the central axial line of rotation of the rotary drum 14 (in FIG. 2, in the right-hand direction which is substantially horizontal). It is also essential that the guide and support members 72*a* and 72*b* should respectively have guide surfaces for guiding suitable sites of the both side portions of the rotary drum 14 at the time of mounting the rotary drum 14, said guide surfaces extending respectively from the recesses 92*a* and 92*b* of the bearing holes 90*a* and 90*b* in a direction substantially perpendicular to the central axial line of rotation of the rotary drum 14. In the illustrated embodiment, these guide surfaces are respectively defined by the top surfaces of the parts constituting the guide and support members 72*a* and 72*b*, and are composed respectively of first guide surfaces 94*a* and 94*b* extending substantially horizontally (or slightly inclinedly upward) from the lower ends of the recesses 92*a* and 92*b* of the bearing holes 90*a* and 90*b* and then somewhat inclinedly in the downward direction and second guide surfaces 96*a* and 96*b* located inwardly and downwardly of the first guide surfaces 94*a* and 94*b* and extending substantially horizontally, then somewhat inclindedly in the upward direction and again substantially horizontally. Preferably, the guide and support members 72*a* and 72*b* respectively have provided therein circular positioning projections 98*a* and 98*b* on opposite surfaces corresponding to the above beaing holes 90*a* and 90*b*.

The guide and support members 72*a* and 72*b* are secured to the predetermined positions of the inside surfaces of the side plates 68*a* and 68*b* respectively by inserting the positioning projections 98*a* and 98*b* in circular openings formed at predetermined positions of the side plates 68*a* and 68*b*, thus exactly coordinating the positions of the bearing holes 90*a* and 90*b* with predetermined positions of the side plates 68*a* and 68*b*, and then screwing a plurality of set screws 100 into the guide and support members 72*a* and 72*b* through holes formed in the side plates 68*a* and 68*b*.

The rotary drum 14 is mounted on the guide and support members 72*a* and 72*b* in the following manner. Referring to FIG. 2 together with FIGS. 3 to 5, it is necessary that in mounting the rotary drum 14, developing station 20 and the right end wall 102 (FIGS. 1 and 2) of the housing 2 to be described in detail hereinafter should not be mounted in position as yet, but should be detached. In this condition, the rotary drum 14 is first inserted in to the housing 2 through an opening to be closed later by the right end wall 102, i.e. the right end opening portion of the housing 2, and a pair of non-photosensitive areas near both side end walls of the rotary drum 14 are placed respectively on the second guide surfaces 96*a* and 96*b* of the guide and support members 72*a* and 72*b*. Then, the rotary drum 14 is moved toward the bearing holes 90*a* and 90*b* (i.e. in the left-hand direction in FIG. 2) along the second guide surfaces 96*a* and 96*b*. In other words, the rotary drum 14 is moved toward the bearing holes 90*a* and 90*b* by rotating it over the second guide surfaces 96*a* and 96*b*. During this movement, not only the non-photosensitive areas 86 but also the gear 88 is located on the second guide surface 96*b* at one side end portion (FIGS. 3 and 5) of the rotary drum 14 (accordingly, in the illustrated embodiment, the width of the second guide surface 96*b* of the guide and support member 72*b* is broader by the width of the gear 88 than that of the second guide surface 96*a* of the other guide and support member 72*a*). Since, however, the outside diameter of the gear 88 is slightly smaller than that of the non-photosensitive area, the gear 88 never makes contact with the second guide surface 96*b*. When the rotary drum 14 is moved by a predetermined amount along the second guide surfaces 96*a* and 96*b*, the bearing members 78 disposed at both side ends of the rotary drum 14 are located respectively on the first guide surfaces 94*a* and 94*b* to move the rotary drum further toward the bearing holes 90*a* and 90*b* along the first guide surfaces 94*a* and 94*b*, the non-photosensitive areas 86 depart from the second guide surfaces 96*a* and 96*b*, and the bearing members 78 are positioned within the bearing holes 90*a* and 90*b* through the recesses 92*a* and 92*b*. Thus, the rotary drum 14 is rotatably and detachably mounted in the bearing holes 90*a* and 90*b* via the bearing members 78 disposed in both side end portions of the rotary drum 14. In the illustrated embodiment, the spacer rings of the developing station 20 to be mounted subsequent to the mounting of the rotary drum 14 abut the non-photosensitive areas 86 of the rotary drum 14 to restrain the rotary drum 14 within the bearing holes 90*a* and 90*b* and thereby to prevent the detachment of the rotary drum from the bearing holes 90*a* and 90*b*, as will be described in detail hereinafter. If desired, however, a releasable restraining means may be provided to prevent the rotary drum 14 from being detached from the bearing holes 90*a* and 90*b* through the recesses 92*a* and 92*b*.

The guide surfaces (the first guide surfaces 94*a* and 94*b* and the second guide surfaces 96*a* and 96*b*) of the guide and support members 72*a* and 72*b* are not limited to the type shown in the drawings, and they may be of any desired configuration so long as they can guide the rotary drum 14 to the bearing holes 90*a* and 90*b* as required. It is important however that these guide surfaces should be disposed such that they guide the rotary drum without bringing the rotary drum 14 into collision with various constituent elements already mounted within the housing 2 (for example, the feed roller 54, guide plate pair 56 and transfer roller pair 58 located beneath the mounted position of the rotary drum 14). If the photosensitive area of the rotary drum, i.e. the surface of the photosensitive member 82, makes contact with the guide surfaces, the photosensitive member 82 is likely to be damaged. Preferably, therefore, the rotary drum 14 is guided such that its areas other than the photosensitive member 82, i.e. both side end portions of the rotary drum 14 in which the photosensitive member 82 is absent, make contact with the guide surfaces.

In an electrostatic copying apparatus in which the rotary drum 14 is mounted by the method described hereinabove, when paper jamming occurs on the peripheral surface of the rotary drum 14, the jammed copying paper can be easily removed by moving the rotary drum 14 by a required amount toward the right in FIG. 2 along the guide surfaces of the support and guide members 72*a* and 72*b*. The moving direction of the rotary drum 14 is not along its central axial line of rotation but to a direction perpendicular to the central axial line of rotation. Hence, the jammed copying paper does not make frictional contact with the surface of the photosensitive member 82 during the movement of the rotary drum 14, thus obviating any likelihood of the surface of the photosensitive member 82 being damaged or degraded. Furthermore, since the moving direction of the rotary drum 14 is perpendicular to the axial line of rotation of the drum 14, the jammed copying paper can be removed by only moving the rotary drum by a required amount without the need to remove the drum 14 completely out of the housing 2. Consequently, the operation of removing jammed papers is easy.

Construction of the developing station and the method of mounting it

To develop a latent electrostatic image formed on the photosensitive member 82 by applying toner particles, there has been conveniently used a developing station 20 consisting of a hollow cylindrical developing sleeve extending substantially parallel to the central axial line of rotation of the rotary drum 14, a roll-like magnet member disposed within the sleeve, and a toner dispenser for supplying a developing toner to the peripheral surface of the developing sleeve. It is well known to those skilled in the art that when such a type of developing device is used, and especially when a one-component developer composed only of magnetic toner particles is used, the distance between the photosensitive member 82 on the surface of the rotary drum 14 and the surface of the developing sleeve should be very precisely prescribed in order to achieve good development as desired. In conventional electrostatic apparatuses, relatively complex and expensive mechanisms need to be used in order to make possible the precise prescription of the aforesaid distance, and the operation of prescribing this distance is complicated.

In contrast, according to this invention, the electrostatic copying apparatus is improved such that the distance between the surface of the hollow cylindrical developing sleeve in the developing station 20 and the photosensitive member 82 provided on the surface of the rotary drum 14 can be prescribed easily, rapidly and precisely without the need for a complicated and expensive mechanism.

In this regard, the construction of the developing station 20 and the method of mounting it in the electrostatic copying apparatus shown in the drawings are described with reference to FIG. 2 and FIGS. 6 to 8.

Figure 8:
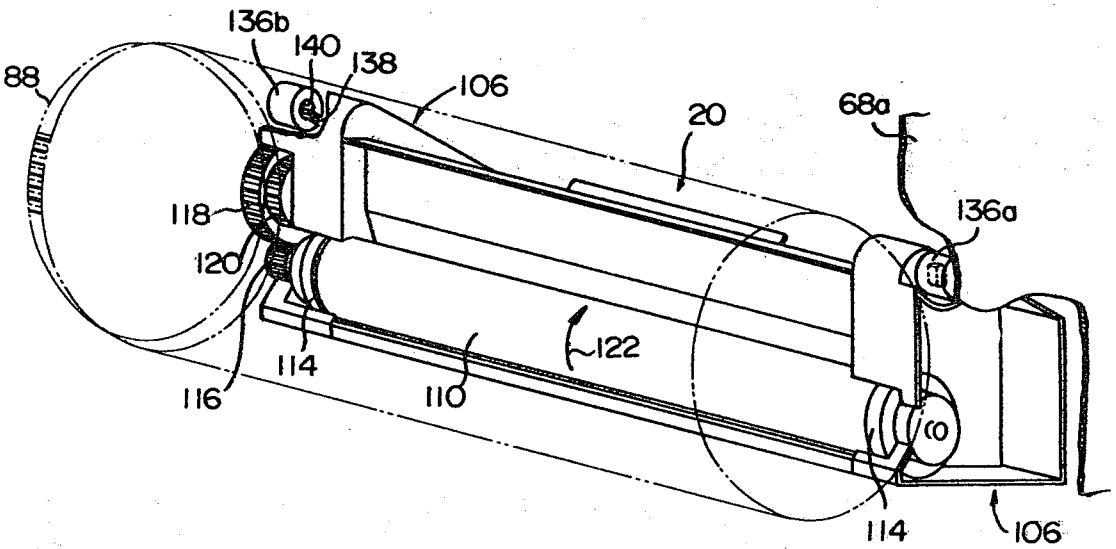
FIG. 8 is a partial perspective view showing the developing station used in the electrostatic copying apparatus shown in FIGS. 1 and 2.

First, the construction of the developing station 20 is described. The illustrated developing station 20 includes a support frame 106 having an open front surface (the surface facing the rotary drum 14). A support shaft 108 extending substantially parallel to the central axial line of rotation of the rotary drum 14 is fixed to the bottom portion of the front surface of the support frame. On the supporting shaft 108 are mounted a hollow cylindrical developing sleeve 110 and a roll-like magnet member 112. It is essential that the developing sleeve 110 should extend in proximity to the peripheral surface of the rotary drum 14 and substantially parallel to the central axial line of rotation of the rotary drum 14. In the illustrated embodiment, the sleeve 110 is rotatably mounted on the support shaft 108, and the magnet member 112 positioned within the sleeve 110 is fixed to the support shaft 108. Furthermore, the support shaft 108 has mounted thereon a pair of spacer rings 114 (FIG. 8) adjacent to both side ends of the developing sleeve 110 so that they can rotate independently of the developing sleeve 110. It is essential that these spacer rings should have an outside diameter larger than the outside diameter of the developing sleeve 110 by a predetermined length. As shown in FIG. 8, a gear 116 is connected to one end of the developing sleeve 110, and on one side portion of the support frame 106 are mounted rotatably a gear 118 engaged with the gear 116 and a gear 120 rotating integrally with the gear 118. When the developing station 20 is mounted within the housing 2 in the manner to be described hereinafter, the gear 120 meshes with the gear 88 (see FIGS 3 and 4 also) provided at one end portion of the rotary drum 14, and therefore, the rotation of the rotary drum 14 is transmitted to the gears 88, 120, 118 and 116 to cause the developing sleeve 110 to rotate in the direction shown by arrow 122. In the illustrated developing station, the developing sleeve 110 is rotated. As is well known to those skilled in the art, however, the magnet member 112 or both the developing sleeve 110 and the magnet member 112 may be rotated in a predetermined direction instead of rotating the developing sleeve 110.

The developing station 20 includes a developer dispenser 124 fixed to the support frame 106 or formed intergral with the support frame 106. The developer dispenser 124 has an outlet opening at its lower end located adjacent to the periphery of the developing sleeve 110. A developer 126 (a one-component developer consisting only of magnetic toner particles in the illustrated embodiment) is supplied to the peripheral surface of the developing sleeve 110 through the developer outlet opening and magnetically held there by the action of the magnetic member 112. The thickness of the layer of the developer 126 held on the peripheral surface of the developing sleeve 110 is adjusted to a required value by the action of the brush length adjusting plate 128 which is disposed below the developer outlet opening and whose front edge is spaced a predetermined distance from the periphery of the developing sleeve 110 (the adjustment of the position of the brush length adjusting plate 128 will be described in detail hereinbelow). At the top surface of the developer dispenser 124 is provided a closure 130 whose inside edge (the left edge in FIG. 7) is pivotably connected to the front wall of the developer dispenser 124. An upwardly extending engaging projection 132 is formed on the top surface of the closure 130. When the developer 126 stored in the dispenser 124 is consumed after performing the developing operation through a predetermined number of cycles, it is necessary to furnish the dispenser 124 with a fresh supply of toner. Supplying of the developer to the dispenser 124 is effected by turning the closure 130 upwardly about its inside edge as a center to open the top surface of the dispenser 124 (the operation of turning the closure 130 and the operation of the engaging projection 132 at the time of supplying the developer will be described in detail hereinafter).

The method of mounting the developing station 20 is now described. In the illustrated embodiment, a short shaft 134 is provided on the top end portion of each of the two ends of the supporting frame 106 of the developing station 20. Further, shaft supporting members 136*a* and 136*b* are fixed to predetermined positions of the inside surfaces of said pair of inner side plates 68*a* and 68*b* (FIGS. 3 and 8) for rotatably supporting a short shaft 134.

In the illustrated embodiment, the developing station 20 is mounted after the rotary drum 14 is mounted at a predetermined position within the housing 2 and before the right end wall 102 (FIGS. 1 and 2) of the housing 2 is mounted to close the right end portion of the housing 2. The mounting of the developing station can be easily effected by inserting the developing station 20 into the housing 2 through the opening portion of the housing 2 to be closed by the right end wall 102, positioning the short shafts 134 provided in the support frame 106 of the developing station respectively within support holes 140 of the shaft supporting members 136*a* and 136*b* through slit portions 138 of the shaft support members 136*a* and 136*b*, and thus mounting the developing station 20 at a predetermined position between a pair of inner side plates 68*a* and 68*b* so that it is pivotable about the short shaft 134 as a center. When the developing station 20 is pivotably mounted in this manner, the developing station 20 is turned in the direction of the rotary drum, i.e. clockwise in FIGS. 2 and 7, by its own weight based on the relation between the position of the short shaft 134 and the position of the center of gravity of the developing station 20, whereby a pair of said spacer rings 114 of the developing station 20 are caused to abut the non-photosensitive areas 86 on both end portions of the rotary drum 14. Since as described hereinabove, the non-photosensitive areas 86 of the rotary drum 14 have substantially the same outside diameter as the photosensitive member 82, and the spacer rings 114 have a larger outside diameter than the outside diameter of the developing sleeve, the distance between the photosensitive member 82 and the surface of the developing sleeve 110 (i.e., the distance which should be precisely set so as to perform good development) can be automatically adjusted accurately to a value half of the distance between the outside diameter of spacer ring 114 and the outside diameter of developing sleeve 110 without the need for any special operation. At the same time, since the spacer rings 114 of the developing station 20 are caused to abut the non-photosensitive areas 86 of the rotary drum 14 by the urging action of the developing station 20 by its own weight (i.e., the urging action in the clockwise direction in FIGS. 2 and 7), a force tending toward the left in FIGS. 2 and 7 is exerted on the rotary drum 14 to restrain the bearing members 78 provided on both side ends of the rotary drum 14 within the bearing holes 90*a* and 90*b* of the guide and support members 72*a* and 72*b* (see FIGS. 3 to 5 also) and to prevent detachment of the rotary drum 14 from the bearing holes 90*a* and 90*b*.

Thus, it will be readily appreciated that although the mounting mechanism for the developing station is relatively simple and inexpensive, it can mount and detach the developing station 20 very easily and rapidly, and that the distance between the photosensitive member 82 formed on the rotary drum 14 and the surface of the developing sleeve 110 of the developing station can be accurately adjusted to a required value without the need for any special operation.

When the developing station 20 is mounted subsequent to the mounting of the rotary drum 14, the right end wall 102 of housing 2 is mounted in position by a suitable means such as a set screw 142 (FIGS. 1 and 2), and the right end opening of the housing 2 is closed.

Figure 7:
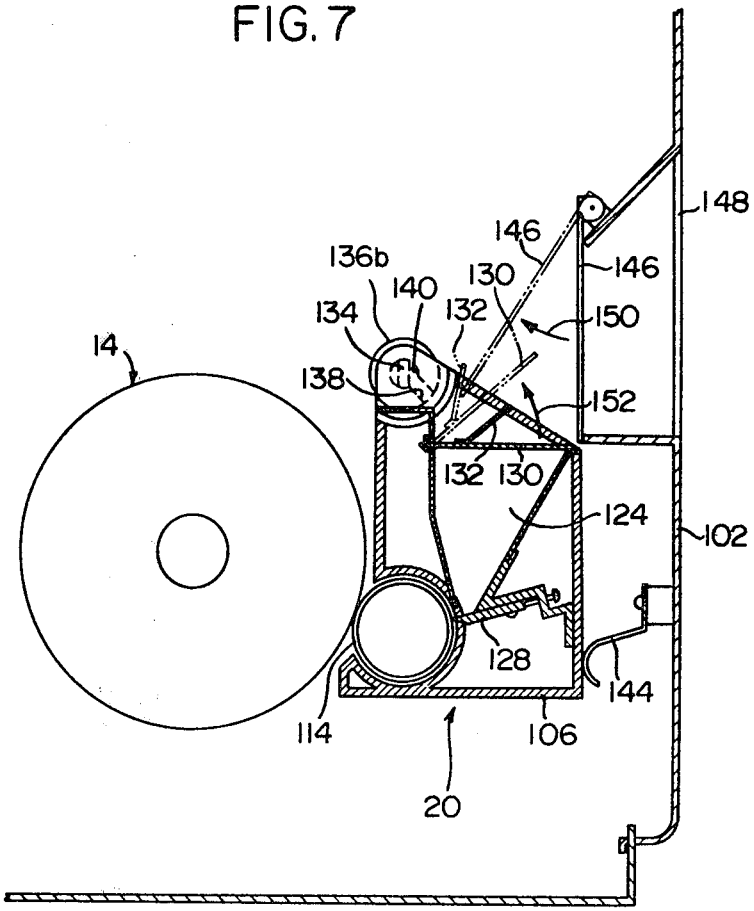
FIG. 7 is a simplified sectional view showing the rotary drum and developing station in the electrostatic copying apparatus shown in FIGS. 1 and 2.

In the illustrated embodiment, an elastic member 144 is secured to the inside surface of the right end wall 102 of the housing 2 as shown in FIG. 7. The free end of the elastic member 144 abuts against the support frame 106 of the developing station 20 to elastically urge the developing station 20 toward the rotary drum 14, i.e. clockwise in FIGS. 2 and 7. Hence, in the illustrated embodiment, both the urging action of the developing station 20 by its own weight and the urging action of the elastic member 144 urge the developing station 20 clockwise in FIGS. 2 and 7 to cause the spacer rings 114 of the developing station 20 to abut exactly against the nonphotosensitive areas 86 of the rotary drum. Consequently, the distance between the photosensitive member 82 of the rotary drum and the developing sleeve 110 of the developing station 20 is adjusted exactly to a predetermined value, and at the same time, detachment of the rotary drum 14 from the bearing holes 90*a* and 90*b* of the guide and support members 72*a* and 72*b* is prevented with certainty. If desired, however, the developing station 20 may be urged clockwise in FIGS. 2 and 7 only by the urging action of the developing station 20 by its own weight or by the urging action of the elastic member 144.

In the event that paper jamming occurs, for example, on the peripheral surface of the rotary drum 14 in the illustrated embodiment in which the rotary drum 14 and the developing station 20 are mounted by the methods described hereinabove, the jammed copying paper can be easily removed by detaching the right end wall 102 of the housing 2, and then moving the rotary drum by a required amount toward the right in FIGS. 2 and 7 in resistance to the urging action of the developing station 20 by its own weight. When the photosensitive member 82 is to be exchanged, the developing station 20 is detached after the detaching of the right end wall 102 of the housing, and then the rotary drum 14 is detached.

Mechanism about the supplying of a developer to the developing station

In the developing station 20 described above, the developer 126 stored in the developer dispenser 124 is consumed as the developing operation is performed. Thus, after a predetermined number of cycles of the developing operation, a fresh supply of developer 126 must be sent to the dispenser 124. In a conventional electrostatic copying apparatus, it is necessary to perform a complicated operation comprising removing the entire developing station from the housing, opening the closure of the developer dispenser, supplying a developer to it, then closing the closure, and thereafter returning the entire developing station to a predetermined position within the housing.

In contrast, according to this invention, the electrostatic copying apparatus is improved such that developer 126 can be supplied to the developer dispenser 124 very easily and rapidly without the need to withdraw the developing station 20 from the housing 2, as described in detail below. As is apparent from FIGS. 2 and 7, when the developing station 20 is mounted at a predetermined position within the housing 2 in the illustrated electrostatic copying apparatus, the developer dispenser 124 of the developing station 20 will be positioned in proximity to an outside wall defining a part of the housing 2 (the right end wall 102 in the drawing). A part of the right end wall 102 is formed of a developer supply door 146 capable of being opened or closed by pivotal movement. Referring to FIGS. 1, 2 and 7, a developer supply opening 148 of a rectangular shape is formed on the upper part of the right end wall 102, and the opening 148 is closed by the developer supply door 146 forming a part of the right end wall 102. The developer supply door 146 is connected pivotably at its upper edge to the main portion of the right end wall 102 and can be opened by turning it inwardly, i.e. in the direction shown by arrow 150 in FIG. 7. When the door 146 is pushed from outside to turn it in the direction shown by arrow 150, its lower end portion abuts against the engaging projection 132 provided on the top surface of the closure 130, whereby the closure 130 is turned in the direction of arrow 152 about its inner edge (the left edge in FIG. 7) as a center incident to the pivotal movement of the door 146 in the direction shown by arrow 150. Thus, when the door 146 is turned to the position shown by the two-dot chain line in FIG. 7 to release the opening 148 of the right end wall 102, the closure 130 of the developer dispenser 124 is turned to the position shown by the two-dot chain line in FIG. 7 incident to the turning of the door 146, to open the top side of the dispenser 124. When the developer supply door 146 is returned to the position shown by the solid line to close the opening 148 of the right end wall 102, the closure 130 returns to the position shown by the solid line by its own weight to close the top side of the developer dispenser 124. If desired, it is possible to provide a suitable elastic member (not shown) which is adapted to urge the closure 130 (and the door 146) elastically to the closed positions shown by solid lines so that the closure 130 and the door 146 can be certainly returned to the closed positions by the elastic action of such an elastic member.

According to the above construction, simple pushing of the lower portion of the developer supply door 146 releases the opening 148 of the right end wall 102 from a closed state, and incident to it, the closure 130 is opened. A developer can therefore be supplied very easily and rapidly via the opening 148 of the right end wall 102 and the top side of the developer dispenser 124 without the need to withdraw the developing station 20 from the housing 2 as in a coventional electrostatic copying machine. Furthermore, upon the closing of the developer supply door 146, the closure 130 is automatically closed. Accordingly, this ensures prevention of the scattering of the developer from the dispenser 124 into the housing 2 past the top side of the developer dispenser 124, which scattering might occur if the closure 130 does not close the dispenser 124.

In the illustrated embodiment, the closure 130 is adapted to be closed or opened incident to the closing or opening of the developer supply door 146 by bringing the lower edge portion of the door 146 into engagement with the engaging projection 132 provided on the top surface of the closure 130. Alternatively, it is possible to open (or close) the closure 130 incident to the opening (or closing) of the door 146 by connecting the door 146 to the closure 130 through a suitable link mechanism. Furthermore, while the embodiment shown in the drawing is constructed such that the developer supply door 146 can be opened by turning it inwardly of the housing 2, it is also possible to open the door 146 by turning it outwardly of the housing 2.

Mechanism for adjusting the position of the brush length adjusting plate in the developing station In order to achieve development as desired in the developing station 20 described above, it is important that the distance between the tip of the brush length adjusting plate 128 and the surface of the developing sleeve 110 should be precisely adjusted to a predetermined value to adjust the thickness of the layer of developer magnetically held on the surface of the sleeve 110 to a predetermined value in addition to prescirbing very precisely the distance between the photosensitive member 82 provided on the surface of the rotary drum 14 and the surface of the developing sleeve 110 to a predetermined value. In conventional developing apparatus, it is not necessarily easy to adjust precisely the distance between the tip of the brush length adjusting plate and the surface of the developing sleeve to a predetermined value.

In contrast, according to this invention, the developing station is provided with a mechanism for adjusting the position of the brush length adjusting plate, which makes it possible to adjust easily and precisely the position of the brush length adjusting plate 128 relative to the surface of the developing sleeve 110 and to set the distance between the tip of the brush length adjusting plate 128 and the surface of the sleeve 110 easily and precisely at a predetermined value.

Figure 9:
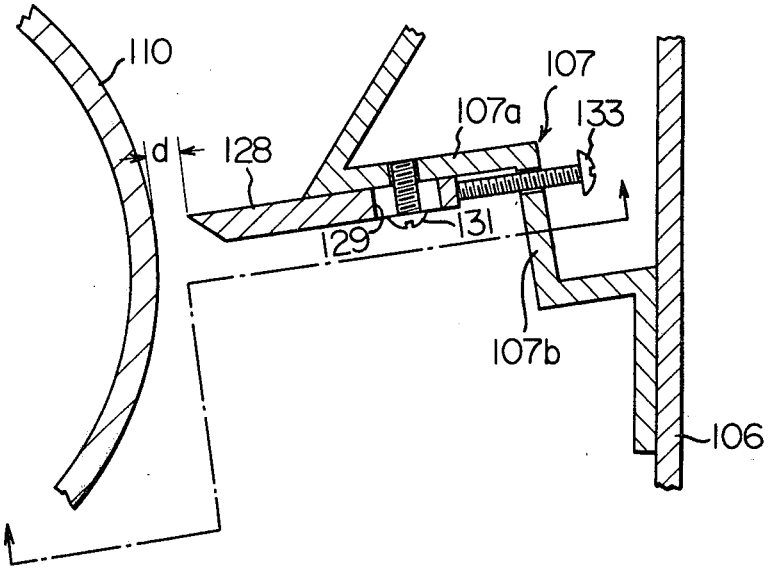
FIG. 9 is a partial sectional view showing a mechanism for adjusting the position of a brush length adjusting plate in the developing station.
Figure 10:
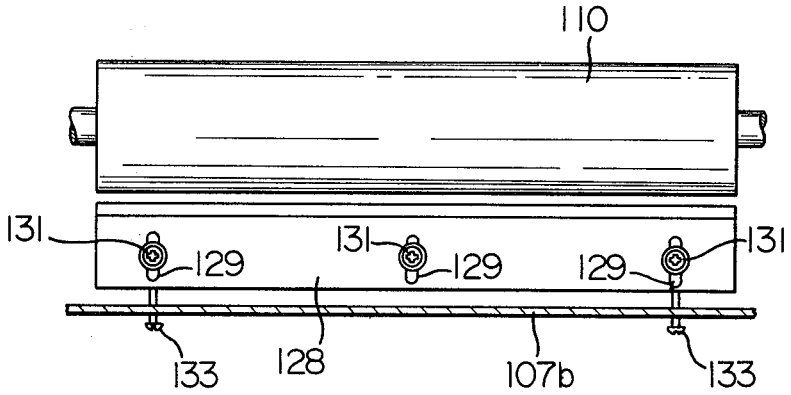
FIG. 10 is a sectional view taken along the line of FIG. 9.

This construction is described below with reference to FIGS. 9 and 10 taken in conjunction with FIG. 7. In the developing station 20, a member 107 having a support portion 107*a* extending at right angles to the axial line of the developing sleeve 110 (the left end portion of this support member in FIGS. 7 and 9 defines a part of the developer dispenser 124) is fixed to the support frame 106. The rear end portion of the brush length adjusting plate 128 is secured to the under-surface of the support portion 107*a*. Securing of the brush length adjusting plate 128 to the support portion 107*a* is effected in the following manner. The brush length adjusting plate 128 was formed therein a plurality (three in the drawing) of elongated apertures 129 extending in a direction at right angles to the axial line of the developing sleeve 110 and spaced apart from each other in the axial direction of the sleeve 110. By screwing setscrews 131 into the support portion 107*a* through these elongated apertures 129, the brush length adjusting plate 128 is fixed to the support portion 107*a*. The aforesaid member 107 has a portion 107*b* extending from the rear end of the portion 107*a* in a direction substantially perpendicular to the support portion 107*a* and downwardly and being located rearwardly of the rear end of the brush length adjusting plate 128. The portion 107*b* has formed therein a plurality (two positioned on both side edge portions of the brush length adjusting plate 128 in the drawing) of screw holes spaced from each other in the axial direction of the developing sleeve 110, and adjusting screws are screwed in these screw holes. Each adjusting screw 133 is adapted to move back and forth in a direction at right angles to the axial line of the sleeve 110 upon being rotated.

In setting the distance between the tip of the brush length adjusting plate 128 and the surface of the developing sleeve 110 at a predetermined value by adjusting the position of the brush length adjusting plate 128, the first step is to screw the setscrews 131 somewhat loosely with the support portion 107*a* so that the brush length adjusting plate 128 can be moved in a direction at right angles to the axial line of the developing sleeve 110. Then, a thickness gauge having a predetermined thickness d (not shown) is interposed between the tip of the brush length adjusting plate 128 and the surface of the developing sleeve 110, and the adjusting screws 133 are moved forward. As a result, the tip of the adjusting screw 133 abuts against the rear end of the brush length adjusting plate 128. When the adjusting screws 133 are further moved forward, the brush length adjusting plate is moved toward the surface of the developing sleeve 110, and the thickness gauge is held by the tip of the brush length adjusting plate 128 and the surface of the developing sleeve 110. Thus, the distance between the tip of the brush length adjusting plate 128 and the surface of the developing sleeve 110 equals to the thickness d of the gauge. Thereafter, the setscrews 131 are screwed sufficiently strongly with the support portion 107*a* to fix the brush length adjusting plate 128 firmly to the support portion 107*a*, and the thickness gauge is removed from the space between the tip of the brush length adjusting plate 128 and the surface of the developing sleeve 110. In this manner, the distance between the tip of the brush length adjusting plate 128 and the surface of the developing sleeve 110 is set at a required value d. The adjusting screws may be removed from the portion 107*b* of the support member 107 after the completion of the above operation, or it may be left there.

In the illustrated embodiment, the brush length adjusting plate 128 is secured to the support portion 107*a* by providing the elongated apertures 129 in the brush length adjusting plate 128 and screwing the setscrews 131 with the support portion 107*a* through these apertures 129. In an alternative embodiment, the brush length adjusting plate 128 may be secured to the support portion 107*a* by forming the elongated apertures in the support portion 107*a* and screwing the setscrews with the brush length adjusting plate 128 through these apertures.

Peeling means in the fixing station

In the illustrated eletrostatic copying apparatus, a pair of press rollers 64 are provided downstream of the copying paper transfer system shown generally at 50, and a developed image transferred to a copying paper is fixed under pressure by the action of the press rollers 64, as described hereinabove with reference to FIG. 2. As is well known to those skilled in the art, when a copying paper moves through a pair of these press rollers 64 (or a pair of heated rollers which may be used instead of the press rollers), the copying paper tends to adhere to, and wrap about, one of these press rollers 64. In the illustrated electrostatic copying apparatus, therefore, a peeling means shown inFIGS. 11 and 12 is provided relative to the press roller pair 64 in order to send the copying paper exactly from the press roller pair 64 to a receiver tray 66.

Referring to FIGS. 11 and 12, the construction of the peel means is described in detail. A small-diameter portions 154 are provided at one side end of each of said pair of press rollers 64 as clearly shown in FIG. 11. The small-diameter portions 154 are positioned correspondingly to the position of one of a pair of annular grooves 84 (FIGS. 3 and 4) formed in the rotary drum 14 when viewed in the moving direction of copying paper 156. Accordingly, when the copying paper 156 passed between the press rollers 64 rotating in the direction shown by arrows, a non-image area in one edge of the copying paper 156 passes between the small-diameter portions 154. A pair of peel guide portions 160*a* and 160*b* are disposed at the small-diameter portions 154 of the press rollers 64, and downstream of the peel guide portions 160*a* and 160*b* are provided a pair of peel rollers 162*a* and 162*b*. It is important that these peel guide members 160*a* and 160*b* should be located on both sides of the nip position of the press rollers 64, i.e. above and below the nip position, respectively. Preferably, the upstream ends of the peel guide portions 160*a* and 160*b* extend to a position slightly upstream of the nip position of the press rollers 64 and are inclined substantially in a tangential shape with respect to the small-diameter portions 154 of the press rollers 64 so that they depart from each other toward the upstream side. Such a pair of peel guide portions 160*a* and 160*b*, as shown in FIG. 12, can be formed as an integral unit by subjecting a one-piece plate-like material to a suitable working operation such as bending. This pair of peel guide portions 160*a* and 160*b* which are integral with each other are fixed to a frame member 164. The frame member 164 is mounted in position by screwing a setscrew (not shown) through a through-hole 166 formed therein and securing it to one inside surface of the inner side plates 68*a* and 68*b*. Thus, this pair of peel guide members 160*a* and 160*b* are disposed at a predetermined position. The above pair of peel rollers 162*a* and 162*b* preferably made of an elastic material such as rubber rotatably disposed at a predetermined position by mounting them rotatably on the frame member 164. A transmission roller 167 is further provided rotatably in the frame member 164 at a position below the peel rollers 162*a* and 162*b*. The transmission roller 167 engages a disc 168 fixed to the outside end of the small-diameter portion of the lower press roller 64 and also with the peel roller 162*b*. Thus, the rotation of the press roller pair 64 is transmitted through the disc 168 and transmission roller 167 to peel roller 162*b* and peel roller 162*a* cooperating with it, whereby the peel rollers 162*a* and 162*b* are rotated in the directions shown by the arrows. To ensure transmission of the rotation of the press roller pair 64 to the peel rollers 162*a* and 162*b*, it is preferred to make transmission roller 167 and disc 168 also of an elastic material such as rubber. Preferably, the transmission roller 167 and the peel roller 162*b* are mounted on the frame member 164 so that they are movable upwardly and downwardly over a predetermined range, and the transmission roller 167 is elastically urged upwardly by a suitable elastic member 170, thereby elastically urging the transmission roller 167 against the disc 168 and the peel roller 162*b* against the peel roller 162*a*.

It will be readily appreciated that according to the peeling means described above, when the copying paper 156 moves in the direction of the arrow and passes through the press rollers 64, one edge of the copying paper passes between the peel guide portions 160*a* and 160*b* and is conducted exactly to the space between a pair of the peel rollers 162*a* and 162*b*, whereby the copying paper 156 is surely peeled from the press rollers 64 and delivered to the receiving tray (FIGS. 1 and 2) by the action of the peel rollers 162*a* and 162*b*.

Inspection of the charge eliminating lamp from outside

The developing station described hereinabove is of an image transfer type in which a latent electrostatic image is formed on the photosensitive member 82 on rotary drum 14, and developed by the developing station 20, and then the developed image is transferred to copying paper.

On the other hand, there is known an electrostatic copying apparatus of a latent electrostatic image type in which a latent electrostatic image is formed on photosensitive member 82 on rotary drum 14, transferred to copying paper, and then developed on the copying paper.

Whether an electrostatic charge pattern formed on the photosensitive member 82 is transferred to copying paper either directly or after development, some electrostatic charge remains on the photosensitive member 82 after the transfer, as is well known to those skilled in the art. In any of the above-mentioned types of electrostatic copying apparatus, a residual charge remaining on the photosensitive member 82 in a preceding cycle of copying operation should be removed in order to repeat the copying operation through many cycles. Generally, a charge eliminating lamp 24 (FIG. 2) is disposed within housing 2 which serves to irradiate light to the photosensitive member 82 after the transfer and removes the residual electrostatic charge therein.

If the charge eliminating lamp 24 fails to give out light for some reason, the residual charge will never be removed, and the desired copy cannot be obtained. In many cases, the charge eliminating lamp 24 is generally constructed of a fluorescent lamp. When the fluorescent lamp is degraded after long-term use and its light becomes less intense, the removal of the residual charge is insufficient and the resulting copy is unsatisfactory. In other words, in order to obtain copies as desired, it is essential that the charge eliminating lamp 24 should be properly lighted and act as prescribed.

In a conventional electrostatic copying apparatus of the type equipped with a charge eliminating lamp 24, however, the action of the charge eliminating lamp 24 disposed within housing 2 cannot be inspected from outside. Thus, when good copies cannot be obtained because of improper action of the charge eliminating lamp 24, it is often impossible to fine out its cause easily. Furthermore, it is generally impossible in such a type of copying apparatus to exchange the charge eliminating lamp 24 before the copying operation if the lamp 24 fails to give out light or is degraded.

According to this invention, however, the electrostatic copying apparatus is improved such that the action of the charge eliminating lamp 24 can be very easily inspected from outside.

This improvement is described in detail below mainly with reference to FIG. 13.

In the illustrated electrostatic copying apparatus, a pair of inner side plates 68*a* and 68*b* spaced from each other are provided within housing 2, and the charge eliminating lamp 24 is mounted between these side plates 68*a* and 68*b* together with the rotary drum 14. The charge eliminating lamp 24 may be constructed of any type of lamp, but preferably a fluorescent lamp. The lamp 24 extends from its rear end removably fitted in a socket member 230 secured to the inner side plate 68*b*, in the forward direction (i.e. in the direction of the width of the rotary drum 14) in parallel with the axial line of the rotary drum 14. The front end portion of the charge eliminating lamp 24 extends beyond the front end of the rotary drum 14, passes through an opening formed in the inner side plate 68*a*, projects beyond it, and is removably fitted in a socket member 234 secured to a bracket member 232 fixed to the inner side plate 68*a*. That part of the charge eliminating lamp which is located between the inner side plates 68*a* and 68*b* (this part extends at least along the entire width of the photosensitive member 82 on the surface of rotary drum 14) is surrounded by a reflecting member 236 opened at that surface which faces the rotary drum 14 and having a roughly ]-shaped cross section. Thus, when the charge eliminating lamp 24 is lighted, the light from that part of the lamp 24 which is between the inner side plates 68*a* and 68*b* is irradiated to the rotary drum 14, thereby eliminating an electrostatic charge remaining on the photosensitive member 82 (FIGS. 3 and 4) on the rotary drum 14. The bracket member 232 surrounding the front end portion of the lamp 24 which projects beyond the inner side plate 68*a* has an open top portion. Hence, the light from the front end portion of the lamp 24 is projected upward through the opening at the top portion of the bracket member 232. Above the bracket member 232 is disposed a reflecting plate 238 which can be formed of a mirror or a metal plate having a surface with a high reflectance such as an aluminum plate. The lower end of the reflecting plate 238 is fixed to the inner side plate 68*a*, and its top end is fixed to a bracket plate 240 secured to the inner side plate 68*a*. The reflecting plate 238 is inclined to the inner side plate 68*a* at a predetermined angle, for example 45°, and serves to receive light from the front end portion of the lamp 24 and reflect it forwardly, as shown by an arrow 242.

In the illustrated electrostatic copying apparatus of this invention, a front side plate 204 defining the front portion of the housing 2 has secured thereto a control panel 12 having various operating members known to those skilled in the art such as a copying start switch 244, a dial 246 for presetting the number of copies desired, a knob 248 for adjusting the amount of exposure and a main switch 250 for on-off control of a power supply source. A light penetrating portion 252 is formed at that part of the control panel 12 to which light from the reflecting plate 238 is projected. The light penetrating portion 252 can be formed by simply providing an opening in the front side plate 204 and the control panel 12. Preferably, the opening has secured thereto a material which permits transmission of at least a part of the light, such as transparent glass, ground glass or colored glass in desired colors.

When the charge eliminating lamp 24 is lighted in the electrostatic copying apparatus described, light from the front end portion of the lamp 24 is conducted to the light penetrating portion 252 through the reflecting plate 238. Accordingly, the action of the charge eliminating lamp 24 (for example, whether it is lighted, or it gives out light of reduced intensity because of degradation) can be very easily inspected from outside the electrostatic copying apparatus through the light penetrating portion 252.

Preferably, the charge eliminating lamp 24 is constructed such that it is lighted when the power source is turned on by closing the main switch 250. By turning on the power source, light from the front end portion of the charge eliminating lamp 24 is irradiated to the light penetrating portion 252. Hence, the light penetrating portion 252 can be utilized as an on-off indication of the power source, and it is possible to omit the provision of a pilot lamp for exclusive use in the on-off indication of the power source and related circuits.

The illustrated electrostatic copying apparatus is of the type in which an original on the transparent plate 8 of the original-supporting means 4 is scanned and exposed by moving the original support means 4, and a cylindrical photosenstive member 82 mounted on the surface of the rotary drum 14 is used. The above-described improvement in and relating to the charge eliminating lamp 24 is applicable to any described type of electrostatic copying apparatus in which the photosensitive member 82 and the charge eliminating lamp 24 for removing a residual charge on the photosensitive member 82 are disposed within the housing 2. For example, it can be applied to an electrostatic copying apparatus of the type in which a transparent plate on which to place an original to be copied is kept stationary and an optical system is moved to scan and expose the orginal, or an electrostatic copying apparatus of the type in which a plate-like or endless strip-type photosensitive member mounted on an endless belt is used instead of the cylindrical photosensitive member mounted on the surface of the rotary drum.

In the illustrated electrostatic copying apparatus, the front end portion of the cahrge eliminating lamp 24 is caused to protrude beyond the front end of the rotary drum 14, and light from the front end portion of the lamp 24 is conducted to the light penetrating portion 252. Instead of this construction, it is possible to cause the rear end of the lamp 24 to project beyond the rear end of the rotary drum 14 and to conduct light from the rear end portion of the lamp 24. If desired, light from an arbitrary part of the lamp 24 may be conducted to the light penetrating portion 252 without causing both end portions of the lamp 24 to project beyond both ends of the rotary drum 14. This construction, however, is not preferred because some adverse effect is likely to be exerted on the irradiation of light from the lamp 24 onto the surface of the photosensitive member 82 formed on the rotary drum 14. When the charge eliminating lamp 24 is constructed of a fluorescent lamp, its degradation appears markedly on its both end portions. Hence, it is preferred to conduct light from the front or rear end portion of the lamp 24 to the light penetrating portion 252.

In the illustrated electrostatic copying apparatus, light from the front end portion of the charge eliminating lamp 24 is conducted to a single light penetrating portion 252, and the light penetrating portion 252 is utilized both for inspection of the action of the lamp 24 and for an on-off indication of the power supply source. If desired, the light from the lamp 24 may be conducted to two or more light-penetrating portions, and the different light-penetrating portins may be used for the inspection of the action of the lamp 24 and for the on-off indication of the power source. According to this alternative embodiment, it is possible to provide a recess at a part of the reflecting plate 238 of the illustrated electrostatic copying apparatus, conduct a part of the light travelling from the front end portion of the lamp 24 to the reflecting plate 238 to the light penetrating portion 252 and also to conduct the remainder of the light left after passing through the recess to another light-penetrating portion by utilizing a suitable reflecting plate. Or it is possible to cause the rear end portion of the lamp 24 to project rearwardly through an opening formed in the inner side plate 68*b*, conduct light from the front end of the lamp 24 to the light penetrating portion 252, and to conduct light from the rear portion of the lamp 24 to another light penetrating portion by utilizing a suitable reflecting plate.

Furthermore, in the illustrated electrostatic copying apparatus, light from the front end portion of the lamp 24 is conducted to the light-penetrating portion 252 of the control panel 12 provided on the front side plate 204 by utilizing one reflecting plate 238. Alternatively, it is possible to provide a light-penetrating portion at that part of a substantially horizontally extending portion 204*a* on the upper end of the front side plate 204 which is above the front end portion of the charge eliminating lamp 24, whereby light from the front end portion of the lamp 24 can be directly conducted to the light-penetrating portion without utilizing the reflecting plate 238.

In the illustrated electrostatic copying apparatus, the light-penetrating portion 252 is provided in the control panel 12 secured to the front side plate which is one of the various outer wall members defining the housing 2 of the electrostatic copying apparatus. The light-penetrating portion 252 may be formed in any desired outer wall member so long as the site of formation allows the operator to view the inside easily.

In an electrostatic copying apparatus of the type in which operating members such as a main switch and a start switch are provided in an operation or control box disposed, for example, above and independently from the housing, a light-penetrating portion may be formed in outer wall members defining the operation or control box.

Multi-purpose utilization of the charge eliminating lamp

It is known that in an electrostatic copying apparatus of a developed image transfer type such as the one shown in FIG. 2, the efficiency of fixation of the developed image transferred to the surface of copying paper in a transfer zone can be increased by pre-heating the surface of the copying paper before the copying paper reaches a fixing station constructed of a suitable means such as a pair of press rollers 64. It is also known that the efficiency of transfer can be increased by irradiating the surface of the photosensitive member 82 in a transfer zone in which the developed image on the photosensitive member 82 (FIGS. 3 and 4) is transferred to copying paper.

Thus, according to this invention, the electrostatic copying apparatus is improved such that the above-described charge eliminating lamp 24 for removing a residual charge pattern on the photosensitive member 82 after transfer is utilized to pre-heat copying paper between the transfer zone and the fixation zone and to irradiate light to the photosensitive member 82 in the transfer zone.

Figure 14:
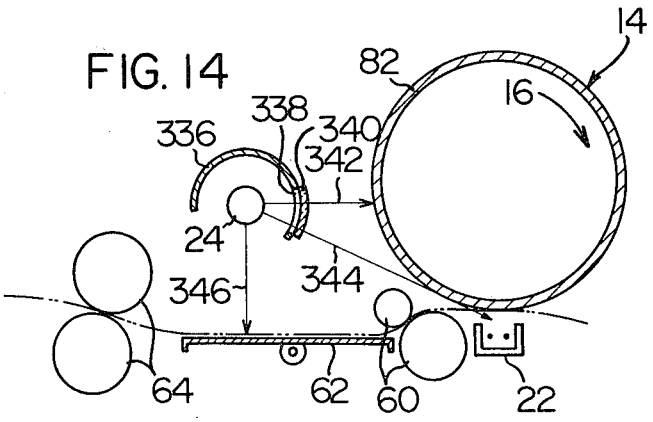
FIG. 14 is a simplified sectional view showing part of an electrostatic copying apparatus which is improved so that a charge eliminating lamp is used for a multiplicity of purposes.

This improvement is described specifically with reference to FIG. 14 which is a simplified view of a part of the electrostatic copying apparatus in which the reflecting member of the lamp 24 is improved.

Figure 13:
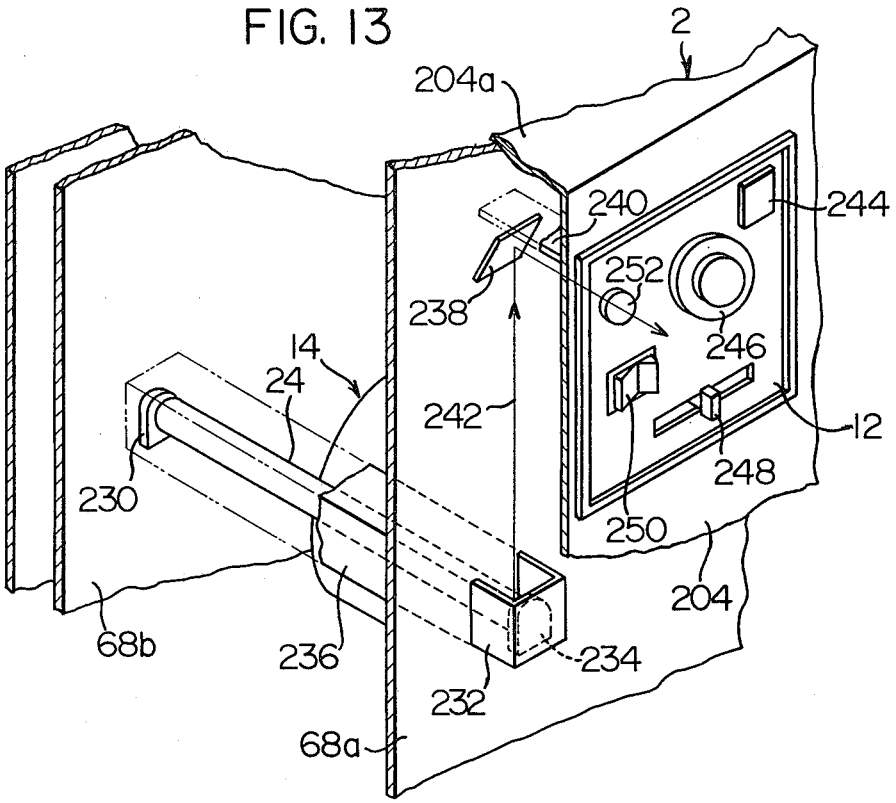
FIG. 13 is a partially broken-away perspective view of the electrostatic copying apparatus of FIGS. 1 and 2 showing a construction that permits inspection of the operation of a charge eliminating lamp from outside.

In the electrostatic copying apparatus shown in FIG. 14, a reflecting member 336 is provided between the inner side plates 68*a* and 68*b* (FIG. 13). The reflecting member 336 covers approximately the upper half of the charge eliminating lamp 24, and that part of the reflecting member 336 which faces a guide plate 62 defining a part of copying paper conveying passage shown by the two-dot chain line is opened. An opening 338 is formed at that part of the reflecting member 336 which faces the photosensitive member 82 on the rotary drum 14, and a suitable filter 340 is provided at the opening 338.

As a result of providing the reflecting member 336 over the charge eliminating lamp 24, light from the lamp 24 passes through the opening 338 and the filter 340 and is irradiated onto the photosensitive member 82 at a position downstream of the transfer zone as shown by an arrow 342, thereby eliminating a residual charge on the photosensitive member 82. Furthermore, as shown by an arrow 344, the light is also irradiated on the photosensitive layer in the transfer zone after passing through the opening 338 and the filter 340, thereby increasing the efficiency of transfer of a developed image from the photosensitive member 82 to copying paper. Moreover, as shown by an arrow 346, the light from the charge eliminating lamp 24 (the direct light from the lamp 24 and the light reflected by the inner surface of the reflecting member 336) is irradiated on the surface of the copying paper conveyed on the guide plate 62 between the transfer zone and the fixing zone, thereby pre-heating the surface of the copying paper and increasing the efficiency of fixation of the developed image on the copying paper.

A large amount of heat must be applied to the surface of the copying paper in order to pre-heat it sufficiently. Hence, the use of a lamp capable of yielding a large amount of heat is preferred. On the other hand, it is known that the direct irradiation of the light from a lamp capable of generating a large amount of heat on the photosensitive member 82 is likely to cause thermal degradation of the photosensitive member 82. If, however, the reflecting member 336 described above is used, the light from the lamp 24 is weakened by the filter 340 and then reaches the photosensitive member 82. Accordingly, even when a charge eliminating lamp 24 capable of generating a large amount of heat is used to pre-heat the copying paper sufficiently, the photosensitive member 82 will not be degraded by the heat.

Mechanism for synchronizing the scanning and exposing of an original with the starting of feeding of copying paper As is well known to those skilled in the art, in an electrostatic copying apparatus of the original-moving type in which a pattern on the original is scanned and exposed to light by moving the original-support means 4 having transparent plate 8 as shown in FIGS. 1 and 2, it is important to start the feeding of copying paper synchronously with the movement of the original-support means 4. Also, in an electrostatic copying apparatus of the optical system moving type in which a pattern on the original is scanned and exposed to light by moving a part or the whole of the optical system while keeping the original-supporting means stationary, it is important to start the feeding of copying paper synchronously with the movement of the optical system.

Feeding of the copying paper is usually started by rotating paper feed rollers engaged with the copying paper whether a cassette-type paper feeding means (which will be described in detail hereinbelow) is used as in the electrostatic copying apparatus shown in FIGS. 1 and 2, or a paper feeding mechanism is of other types such as the roll-type paper feeding mechanism in which a roll of copying paper is unwound and cut to the desired length. It is important therefore to start the rotation of the feed rollers in relation to the scanning and exposing of an original, i.e. the movement of the original-support means or optical system.

In a conventional electrostatic copying apparatus, a detector such as a microswitch is disposed in a moving path of the original-support means or optical system or a rotary drum rotated relative to the movement of such means or system, and the paper feed rollers are connected to a drive power source through a releasable linking means such as an electromagnetic clutch. Thus, in response to the detection of the movement of the original-support means, optical system of rotary drum by the detector, the linking means is actuated to connect the paper feed rollers to the drive power source. In this manner, the rotation of the paper feed rollers is started in relation to the movement of the original-support means, optical system or rotary drum.

The conventional electrostatic copying apparatus, however, requires an electric circuit for actuating the linking means in response to the operation of the detector in addition to the aforesaid detector and the linking means, and therefore, a mechanism for synchronously driving the paper feed rollers is relatively complicated and expensive. The time point and duration of the operation of the linking means are determined by the time point and duration of the operation of the detector or by the time duration of operation of elements included in the aforesaid electric circuit (for example, by the discharging time of a condenser). These factors, however, somewhat vary depending upon the properties of the detector or the elements of the electric circuit. Accordingly, there is a tendency toward the occurrence of some error in the time point and duration of operation of the linking means, and thus, the time of starting the rotation of the paper feed rollers and the time during which the rollers are rotated. Generally, the paper feed rollers need to be freely rotatable at times other than the time when they are positively rotated relative to the movement of the original-support means or the optical system (i.e. when the copying paper is positively fed by the feed rollers). For this reason, in the conventional electrostatic copying apparatus using the aforesaid synchronously driving mechanism the paper feed rollers are mounted on a support shaft via a one-way clutch, and the support shaft is connected to a drive power source by a releasable linking mechanism such as an electromagnetic clutch. In this respect, too, the construction relating to the paper feed rollers is complicated and expensive.

In contrast, according to this invention, the electrostatic copying machine is improved such that the paper feed rollers can be rotated relative to the movement of the original-support means or optical system or the rotary drum by a relatively simple and inexpensive synchronizing mechanism, and there is almost no likelihood of an error in the time of starting the rotation of the paper feed rollers and the time duration of their rotation.

The improvement in this regard is described in detail below with reference to FIGS. 15 to 18.

A pair of shafts 462 and 464 spaced from each other a predetermined distance in the moving direction of the original-support means 4 (i.e., in the directions shown by arrows 452 and 454) are fixed to the outside surface of the inner side plate **68*b* provided in the housing 2 (FIG. 1). To the shaft 462 are rotatably mounted an input wheel 466 and a wheel 468 to be driven which are preferably sprocket wheels. The input wheel 466 and the wheel 468 to be driven are formed integral with each other so that they rotate integrally with each other. To the shaft 464 is rotatably secured an idle wheel 470 which is likewise preferably a sprocket wheel. The input wheel 466 is connected to the output shaft of a drive power source (not shown) such as an electric motor provided within the housing 2 by means of a suitable power transmission means 472 such as a chain, and is driven in the direction of arrow 473 by the drive power source. A winding power transmission system 474 such as a chain is wound about the driven wheel 468 and the idle wheel 470. A follower plate 476 suspended downwardly in the perpendicular direction is fixed to one side edge (the side edge located on the right-hand side in FIG. 15) of support frame 6 of the original-support means 4. In the follower plate 476 is formed an elongated slot 478 which extends in the perpendicular direction along a length corresponding to the distance between an upper travelling portin 474*a* and a lower travelling portion 474*b* of the winding power transmission system 474. A cam roller 480 secured to the winding power transmission system 474 and moving together with it is engaged with the slot 478**.

When in the above-described construction, the input wheel 466 is rotated in the direction of arrow 473 by the drive power source (not shown), the winding power transmission system 474 moves in the direction of arrow 482 to cause the original-support means 4 to reciprocate in the direction shown by an arrow 452 (when the cam roller 480 moves along the lower travelling portion **474*b* of the power transmission system 474) and in the direction shown by an arrow 454** (when the cam roller 480 moves along the upper travelling portion 474*a* of the power transmission system 474). More specifically, in the illustrated embodiment, in a copying cycle, the original-support means 4 makes a preparatory movement from the position shown in FIG. 15 to the direction shown by arrow 452 while the cam roller 480 moves along the lower travelling portion 474*b* of the system 474. Then, while the cam roller 480 moves along the upper travelling portion 474*a* of the system 474, the means 4 makes a scanning movement in the direction shown by arrow 454. Subsequently, while the cam roller 480 moves along the lower travelling portion 474*b* of the system 474, the original-support means 4 makes a returning movement to the position shown in FIG. 15 in the direction shown by arrow 452. During the scanning movement of the means 4 in the direction of arrow 454, the original placed on the transparent plate 8 is scanned and exposed to light by the action of the stationary optical system 26 (FIG. 2) disposed within housing 2.

A detailed description of the original-support means 4 and the mechanism for driving it in the electrostatic copying apparatus shown in the drawings is omitted in this specification because the aforesaid construction regarding these elements is well known to those skilled in the art and does not form a novel feature of the apparatus in accordance with this invention.

According to this invention, a synchronously driving mechanism having the following structure is provided to deliver copying paper by rotating the paper feed rollers 54 relative to the movement of the original-support means 4.

A synchronizing wheel is provided which is to be rotated coaxially with one of the driven wheel 468 and the idle wheel 470 by a predetermined amount at a predetermined time in response to the movement of the winding power transmission system 474. The synchronizing wheel is drivingly connected to a support shaft 436 to which the paper feed rollers 54 are fixed.

Figure 15:
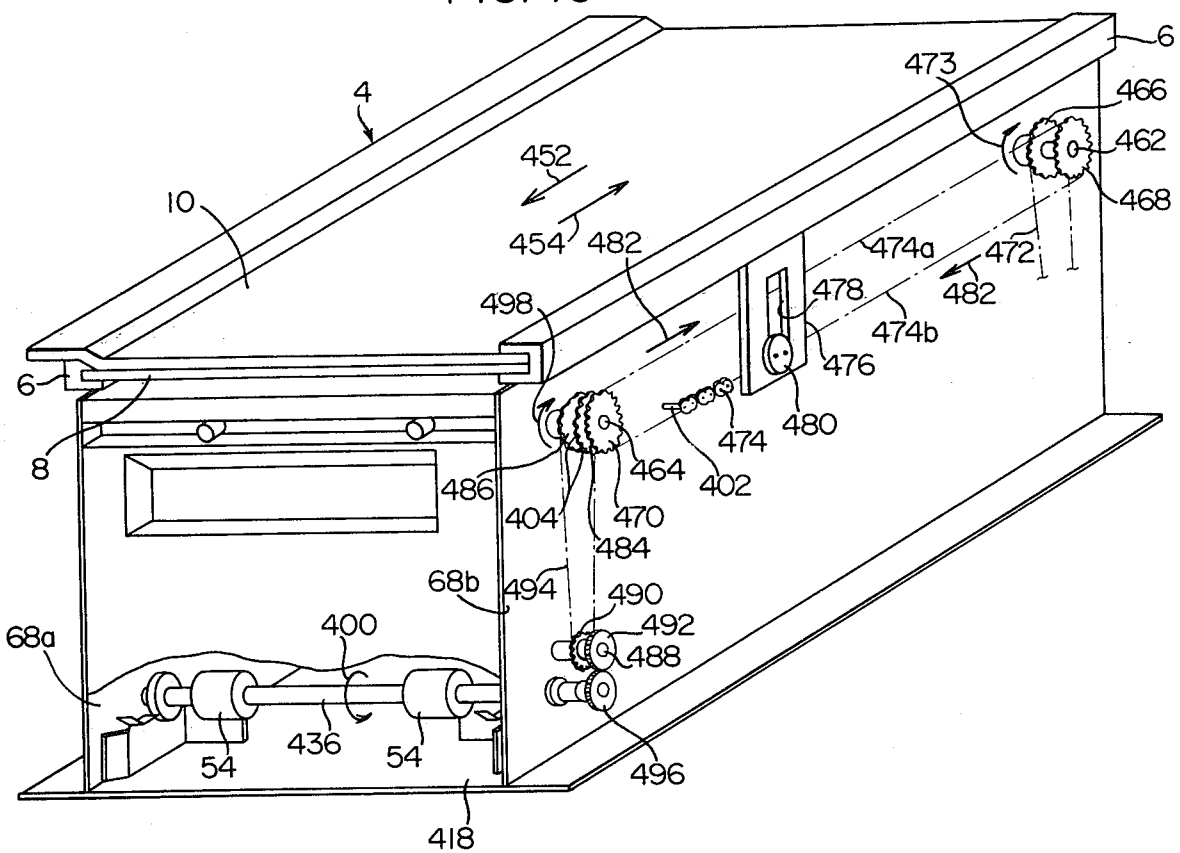
FIG. 15 is a partial perspective view showing a synchronous-drive means for paper feed rollers in one embodiment of the electrostatic copying apparatus in accordance with this invention.
Figure 16:
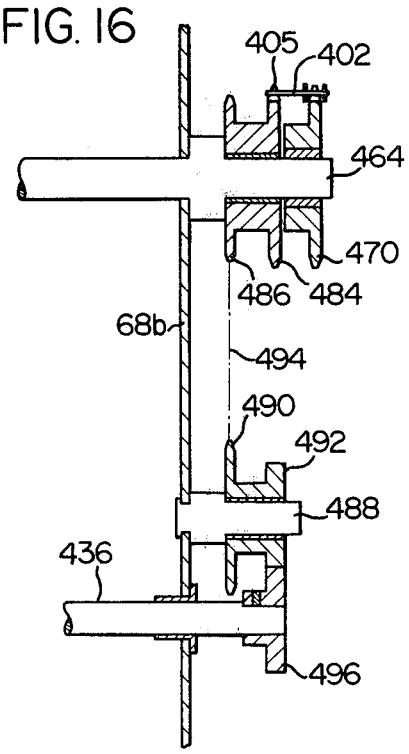
FIG. 16 is a partial sectional view of the synchronous-drive means shown in FIG. 15.

Referring to FIGS. 15 and 16, a synchronizing wheel 484 composed of a sprocket wheel and a first power transmission wheel formed of a sprocket wheel integral with the wheel 484 are rotatably mounted on the shaft 464 having the idle wheel 470 secured thereto. Thus, the synchronizing wheel 484 and the first transmission wheel 486 are provided coaxially with, and adjacent to, the idle wheel 470. A shaft 488 is fixed to the inner side plate 68*b* at a position below the shaft 464 and adjacent to the support shaft 436 to which the paper feed rollers 54 are secured. On the shaft 488 are rotatably mounted a second power transmission wheel 490 composed of a sprocket wheel and a third power transmission wheel 492 composed of a gear formed integral with the second power transmission wheel 490. A winding power transmission system 494 such as a chain is wound about the first transmission wheel 486 and the second transmission wheel 490. The third power transmission wheel 492 engages a fourth power transmission wheel 496 composed of a gear secured to one end of the support shaft 436 to which the paper feed rollers 54 are secured. It is apparent therefore that when the synchronizing wheel 484 is drivingly connected to the support shaft 436 through the first transmission wheel 486, the winding power transmission system 494, the second transmission wheel 490, the third transmission wheel 492 and the fourth transmission wheel 496 and is rotated in the direction shown by an arrow 498, the support shaft 436, and the paper feed rollers 54 fixed to it are rotated in the direction shown by an arrow 400.

An engaging protrusion 402 composed of a pin projecting laterally and inwardly is fixed to the winding power transmission system 474 wound about the driven wheel 468 and the idle wheel 470 at a position ahead of the cam roller 480 by a predetermined distance in the moving direction of the winding power transmission system 474. As will be appreciated from FIG. 16, the engaging protrusion 402 can engage with any one of a plurality of engaging sections formed on the peripheral edge of the synchronizing wheel 484 (a plurality of teeth formed on the peripheral edge of the sprocket wheel in the illustrated embodiment) while moving about the idle wheel 470 in response to the movement of the winding power transmission system 474.

According to the aforesaid synchronously driving mechanism composed of the engaging protrusion 402 fixed to the transmission system 474, the synchronizing wheel 484 having a plurality of engaging sections 405 at its peripheral edge, and the drivingly connecting elements 486, 494, 490, 492 and 496 located between the synchronizing wheel 484 and the support shaft 436, the support shaft 436 and the paper feed rollers 54 are rotated by a predetermined amount at a predetermined time in relation to the movement of the original-support means 4, thereby deliver predetermined amount of copying paper. More specifically, in the illustrated embodiment, the rotation of the paper feed rollers 54 is started at a predetermined time (the time at which the engaging protrusion 402 comes into engagement with an engaging section 405) while the engaging protrusion 402 moves about the idle wheel 470, i.e. while the original-support means 4 makes a preparatory movement from the position shown in FIG. 15 in the direction shown by arrow 452. The rotation of the paper feed rollers 54 lasts for a predetermined period of time (i.e., until the engaging protrusion 402 comes out of the engaging section 405) to rotate the paper feed rollers 54 by a predetermined amount. Thus, during the preparatory movement of the original-support means 4 before starting of its scanning movement, a predetermined amount of copying paper is delivered from the cassette 52 (FIGS. 1 and 2). The copying paper delivered by the action of the paper feed rollers is conveyed through a predetermined path of the copying paper conveying system 50 (FIG. 2) synchronously with the scanning movement of the original-support means 4 in the direction of arrow 454.

The aforesaid synchronously driving mechanism constructed in accordance with this invention is much simpler and lower in cost than a conventional synchronously driving mechanism comprising a detector, an electromagnetic clutch and an electric circuit relating to these members. Because of the very much simplified structure, this synchronously driving mechanism does not substantially cause an error, and in relation to the movement of the original-support means 4, starts the rotation of the paper feed rollers accurately at a predetermined period and keeps it rotating for a predetermined period of time. Generally, the paper feed rollers 54 should be mounted such that they can freely rotate at times other than the time during which they are positively rotated relative to the movement of the original-support means 4. When the aforesaid synchronously driving mechanism is used, the support shaft 436 can rotate freely except when it is positively rotated by the original-support means 4. It is not necessary therefore to use a one-way clutch or the like in mounting the paper feed rollers 54 on the support shaft 436, and the feed rollers 54 can be directly secured to the shaft 436. In this respect, too, the construction of the synchronously driving mechanism can be simplified and made less expensive.

Figure 17:
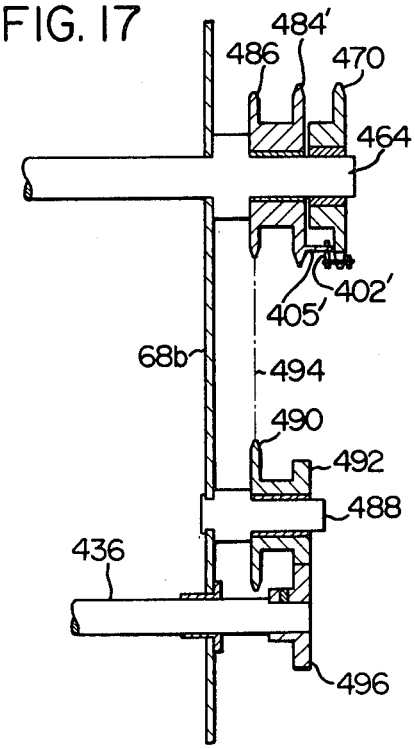
FIG. 17 is a partial sectional view showing a modified example of the synchronous-drive means.
Figure 18:
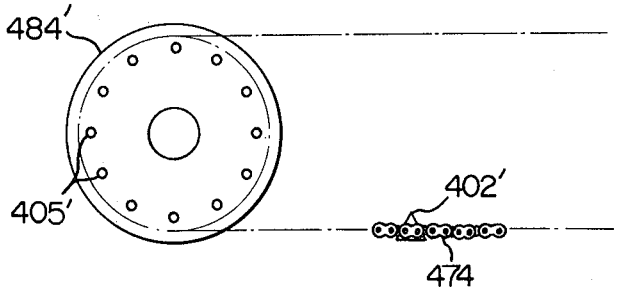
FIG. 18 is a simplified view showing a part of the synchronous-drive means shown in FIG. 17.

FIGS. 17 and 18 show modified examples of the synchronizing wheel having a plurality of engaging sections at its peripheral edge and the engaging protrusion fixed to the winding power transmission system. In the modified examples shown in FIGS. 17 and 18, a synchronizing wheel 484' is composed of a disc-like member having a plurality of engaging sections 405' at its peripheral edge on that side surface which faces the idle wheel 470. The engaging sections 405' are constructed of a plurality of pins provided at spaced intervals along the circumferential direction on the peripheral edge of the aforesaid side surface of the disc-like member and extending toward the idle wheel 470. On the other hand, the engaging protrusion 402', as shown in FIG. 18, is constructed of a substantially triangular projection fixed to the winding power transmission system 474. As is readily appreciated from FIG. 17, in such a modified embodiment, too, the end portion of the engaging protrusion 402' engages one of the pins constituting the engaging sections 405' when the engaging protrusion 402' moves about the idle wheel 470 in response to the movement of the winding power transmission system 474. This results in the rotation of the synchronizing wheel 484', and it is apparent therefore that the support shaft 436 and the paper feed roller 54 are rotated through the first transmission wheel 486, the winding power transmission system 494, the second transmission wheel 490, the third transmission wheel 492 and the fourth transmission wheel 496.

While the synchronously driving mechanism in accordance with this invention has been described hereinabove with regard to an original-moving type electrostatic copying apparatus in which the scanning and exposing of an original are performed by moving the original-support means 4 relative to the stationary optical system 26 (FIG. 2), it will be all too apparent that it can also be applied to an optical system-moving type electrostatic copying apparatus in which the scanning and exposure of an original are performed by moving a part or the whole of the optical system while keeping the original-support means stationary, thereby rotating the paper feed rollers relative to the movement of a part or the whole of the optical system.

Furthermore, while in the illustrated embodiment, the paper feed rollers 54 of a cassette-type paper feeding mechanism are rotated relative to the movement of the original-support means 4, it is apparent that the synchronously driving mechanism constructed in accordance with this invention can also be used when paper feed rolls of a paper roll feeding mechanism are rotated relative to the movement of the original-support means or optical system.

First embodiment of the cassette-type paper feeding means

An electrostatic copying apparatus requires a paper feed means for properly feeding a copying paper (i.e. a receptor sheet for transfer thereto of a latent image corresponding to an original or a developed image, or a photosensitive paper for forming an image corresponding to the original directly thereon). In modern electrostatic copier machines, it is the widespread practice to use a cassette-type paper feeding means in which copying paper cassette is directly introduced into the housing, as is the case with the apparatus shown in FIGS. 1 and 2. In such a cassette-type paper feeding means, the cassette generally consists of a box-like cassette casing with its top surface at least partly opened and a plurality of copying paper sheets of a predetermined size stacked within the casing. The stack of copying paper sheets is urged upwardly by the action of a spring. In the housing of the apparatus, a cassette-receiving section for the cassette is provided. Within the cassette-receiving section are disposed paper feed rollers which come into engagement with copying sheets within the cassette through its top opening, more specifically the uppermost sheet of the stack of copying paper sheets, and thereby can deliver the copying paper sheets within the cassette one by one.

In the cassette-type paper feeding means described above, it is generally necessary that the paper feed rollers should come into engagement with a copying paper in the cassette only when the cassette is inserted into a predetermined position. The paper in the cassette when the cassette is inserted into or taken out of the housing for loading or exchange of copying papers. If the paper feed rollers come into engagement with a copying paper in the cassette at the time of inserting or removing the cassette, the paper feed rollers would abstruct the movement of the uppermost copying paper, and thereby, the uppermost copying paper would get wrinkled or come out of the cassette.

As disclosed in Japanese-Laid-Open Patent Publication No. 18337/74, in a conventional electrostatic copying apparatus equipped with the aforesaid cassette-type paper feeding means, the paper feed rollers are mounted so as to be movable up and down and are urged by a spring to a lower operative position, so that at the time of inserting a paper cassette, the paper feed rollers move upwardly in resistance to the urging action of a spring by the action of cooperative cam means (a cam plate and a dovetail) provided at the cassette casing and the cassette-receiving section of the housing, and at the time of removing the cassette from the housing, the paper feed rollers move upwardly in resistance to the urging action of a spring by a manual operation of a manually operable member (handle) provided in the cassette casing. Thus, at the time of inserting or removing the paper cassette, the paper feed rollers are moved upward from the operative position, and therefore, do not come into engagement with a copying paper. When the cassette is inserted into a predetermined position, the paper feed rollers are returned to the operative position by the urging action of a spring and engage the copying paper.

In another embodiment shown in Japanese Laid-Open Patent Publication No. 18336/74, instead of moving the paper feed rollers upwardly from the operative position at the time of inserting or removing the paper cassette, the paper feed means is constructed such that a stack of copying papers urged upwardly by the action of a spring within the cassette casing are moved downwardly in resistance to the urging action of the spring by the action of cooperative cam means (a dovetail and a cam plate) provided at the cassette casing and the cassette-receiving section of the housing, and at the time of removing the cassette, the copying papers are moved downwardly in resistance to the action of the spring by manually operating a manually operable member (handle) provided in the cassette casing. Thus, at the time of inserting or removing the cassette, copying papers within the cassette are moved downwardly from their normal position, and therefore, the paper feed rollers do not make contact with the copying papers. When the cassette is inserted into a predetermined position, the copying papers are returned to the normal position within the cassette by the urging action of the spring, and the paper feed rollers engage the copying paper.

The conventional electrostatic copying machines described above have the following defects.

(1) The paper feeding means is complicated and expensive because of the need for the provision of cooperative cam means at the cassette casing and the cassette-receiving section of the housing and also for the provision of a manually operable member in the cassette casing.

(2) The operation required for removing the cassette from the apparatus is complicated because the manually operable member must be operated prior to the removal of the cassette.

In contrast, according to the present invention, the electrostatic copying apparatus is improved such that the wrinkling of copying paper and its displacement from the cassette can be completely prevented at the time of inserting or removing the cassette without the need for any means of keeping the paper feed rollers out of engagement with the copying paper, a complicated and expensive means such as cam means and manually operable member, and also for a complicated operation.

A first embodiment of the cassette-type paper feeding means in accordance with this invention which achieves the aforesaid improvement is described in detail with reference to FIGS. 19-A, 19-B and 19-C.

Referring to FIG. 19-A, the illustrated electrostatic copying apparatus of this invention is provided with a cassette-type paper feeding means including a copying paper cassette 52 and a cassette-receiving section 404 formed in the housing of the apparatus.

The paper cassette 52 includes a generally box-like cassette casing 406 and a plurality of sheet-like copying papers 408 accommodated in the casing 406 in the stacked state. An opening 410 is formed on at least a part of the top surface (the forward portion of the top surface in the illustrated embodiment) of the cassette casing 406. The front portion of the copying papers 408 is exposed through the opening 410. Preferably, a bottom plate 412 is provided at the bottom of the cassette casing 406 to urge the copying paper 408 upwardly. In the illustrated embodiment, the bottom plate 412 extends from its rear end located somewhat rearwardly of an intermediate portion of the cassette casing 406 in its longitudinal direction (in the left and right direction in FIG. 19-A) to a point near the front end of the cassette casing 406. The bottom plate 412 is disposed pivotally about its rear end in the direction shown by an arrow 413. Between a bottom wall defining the bottom surface of the cassette casing 406 and the bottom plate 412 is provided a spring (not shown) urging the bottom plate 412 clockwise in FIG. 19-A. The front portion of the stack of copying papers 408 accommodated in the cassette casing 406 is placed on the bottom plate 412, and therefore, elastically urged upwardly by the elastic action of the aforesaid spring which acts via the bottom plate 412. On the other hand, a pair of press members 414 for restricting the upward movement of the copying papers 408 upon engagement with both sides of the front end of the copying papers 408 are provided at both side portions of the front end of the top surface of the cassette casing 406. Thus, irrespective of the number of copying papers 408 in the cassette casing 406, the front portion of a copying paper located topmost is always maintained in a certain relation to the top surface of the casette casing 406 by the cooperation of the bottom plate 412 and the spring (not shown) with the press member 414. A pair of cuts 416 are provided in the upper edge portion of the front end wall of the cassette casing 406.

The cassette-receiving section 404 formed in the housing of the apparatus is constructed of a horizontal plate member 418 defining the bottom wall of the apparatus and a pair of guide members 420 spaced from each other on the plate member 418. Each of the guide members 420 has a front wall portion 422 which when the cassette 52 is inserted into a predetermined position through an opening formed on one end wall (not shown) of the apparatus, abuts the front end wall of the cassette casing 406 and thus obstructs further insertion of cassette 52, a side wall portion 424 which restrict the lateral movement of the cassette 52, and a top portion 426 which restricts the upward movement of the cassette 52. The distance in the lateral direction between the side wall portions 424 of the guide members 420 corresponds substantially to the width of the cassette casing 406. The distance in the perpendicular direction between the plate member 418 and the top wall portion 426 of each of the guide members 420 corresponds substantially to the height of the cassette casing 406. Also, at the rear end portion of each of the guide members 420 are provided a guide wall portion 428 for guiding the cassette in the lateral direction which is inclined lateral outwardly toward the rear and a guide wall portion 430 for guiding the cassette in the perpendicular direction which is inclined upwardly toward the rear in order to make it easy to insert the cassette 52 between the guide members 420 and position it as prescribed.

The cassette-type paper feeding means further has paper feed rollers 54 provided in the cassette-receiving section 404. In the illustrated embodiment, the support shaft 436 is rotatably mounted between a pair of inner side plates 68*a* and 68*b* spaced from each other in the lateral direction, and a pair of feed rollers 54 are secured in a spaced-apart relationship to the support shaft 436.

The aforesaid construction of the cassette-type paper-feeding means provided in the illustrated electrostatic copying apparatus is known, and does not form a novel feature of the electrostatic copying apparatus of this invention. According to this invention, the following novel improvements have been made in the cassette-type paper feeding means described above.

Specifically, according to this invention, an auxiliary roller connected operatively to the paper feed roller 54 is provided in the cassette-receiving section 404, and at the front end portion of the cassette casing 406, an actuating portion is provided which when the cassette 52 is inserted into, or removed from, the cassette-receiving section 404, engages the auxiliary roller to rotate it.

In the illustrated embodiment, an auxiliary roller 438 having substantially the same outside diameter as the outside diameter of the paper feed roller 54 is secured to one end portion of the shaft 436 having a pair of paper feed rollers 54 secured thereto. In one of the guide members 420, the top wall portion 426 and the side wall portion 424 are partly cut so as to secure a space for the provision of the auxiliary roller 438. On the other hand, in the cassette casing 406, a part (i.e., the outside portion) of the front end portion of its one side wall is slightly lower than the other part, and an actuating section 440 is formed of the top surface of this part which is substantially flat and horizontal. An arcuate recess 442 is provided immediately rearwardly of the aforesaid top surface which constitutes the actuating section 440.

The operation and advantage of the electrostatic copying apparatus of this invention which has been improved in the aforesaid manner in the cassette-type paper feeding means are described with reference to FIGS. 19-B and 19-C together with FIG. 19-A.

When the cassette 52 is removed from the position shown in FIG. 19-A in a direction shown by an arrow 444 in FIG. 19-A and inserted into the cassette-receiving section 404 defined by the guide members 420 and the plate member 418, the cuts 416 provided in the front end wall of the cassette casing 406 respectively receive the paper feed rollers, and the undersurfaces of the paper feed rollers 54 engage the top surface of the uppermost copying paper of the stack of copying papers 408 in the cassette casing 406 through the opening 410 formed on the top surface of the casing 406, as shown in FIG. 19-B. When during this inserting operation, the cassette 52 is introduced to a position at which the cuts 416 match the paper feed rollers 54 (i.e. immediately before the paper feed rollers 54 engage the copying paper 408), the actuating section 440 formed at the front end portion of one side wall of the cassette casing 406 abuts the lower surface of the auxiliary roller 438 and is engaged therewith. Hence, when the cassette 52 is moved in the direction shown by arrow 444 in FIG. 19-A, the auxiliary roller 438 is positively rotated clockwise in FIG. 19-A and FIG. 19-B in response to the movement of the cassette 52, and thereby the shaft 436 and the paper feed rollers 54 are positively rotated clockwise in FIGS. 19-A and 19-B. When the cassette 52 is further inserted after the actuating section 440 abuts the auxiliary roller 438, the paper feed rollers 54 go beyond the cuts 416 and engage the copying paper 408. At this time, the paper feed rollers 54 are positively rotated clockwise in FIGS. 19-A and 19-B in response to the movement of the cassette 52 in the direction shown by arrow 444 in FIG. 19-A and therefore to the movement of the copying paper 408. Since the outside diameter of the auxiliary roller 438 is substantially equal to the outside diameter of the paper feed roller 54, the amount of rotation of the surfaces of the paper feed rollers 54 is substantially equal to the amount of movement of the cassette 52 in the direction of arrow 444 in FIG. 19-A, and therefore, to the amount of movement of the copying paper 408. Hence, when the paper feed rolls 54 engage copying paper 408 at the time of inserting cassette 52 into the cassette-receiving section 404, the movement of the copying paper 408 is not obstructed, and moreover, the topmost copying paper in the stack of copying papers 408 is not moved relative to the cassette casing, nor is wrinkled.

In the absence of the actuating section 440 and the auxiliary roller 438 provided in accordance with this invention, the paper feed rollers 54 would not be positively rotated at the time of inserting the cassette 52 into the cassette-receiving section 404. Hence, after engagement of the paper feed rollers 54 with the copying paper 408, the movement of the copying paper 408 in the direction of arrow 444 in FIG. 19-A is hampered, and therefore, the topmost copying paper in the stack of the copying papers 408 is moved relative to the cassette casing 406 or wrinkled. Or when the rear end surface of the cassette casing 406 is not completely closed, the copying paper may drop off from the rear end surface of the cassette casing 406.

Since the support shaft 436 having paper feed rolls 54 fixed thereto is mounted so that it rotates freely, when a copying paper engages the paper feed rollers 54, the paper feed rollers 54 tends to be rotated slightly by the movement of the copying paper caused by the insertion of the cassette 52. It will be readily appreciated however that since a force above certain limit is required to rotate the support shaft 436 and the paper feed rollers 54 and the copying paper is generally very pliable, there is a greater tendency toward the obstruction of the movement of the topmost copying paper of the stack of copying papers 408 than toward the rotation of the paper feed rollers 54.

When the cassette 52 has been inserted into a predetermined position of the cassette-receiving section 404, i.e. a position at which the front end wall of the cassette casing 406 abuts the front wall portions 422 of the guide members 420, the auxiliary roller 438 moves away from the actuating section 440 and is positioned opposite to a recess 442, as shown in FIG. 19-C. Thus, the auxiliary roller 438 departs from the cassette casing 406 and is out of engagement or contact with any part of the cassette casing 406, so that it can rotate freely independently of the cassette casing 406. On the other hand, the paper feed rollers 54 are kept engaged with the topmost copying paper in the stack of copying papers 408. Thus, when the support shaft 436, and the paper feed rollers 54 are rotated clockwise in FIG. 19-C by suitable means such as the synchronously driving mechanism described hereinabove with reference to FIGS. 15 to 18, the topmost copying paper 408 is delivered from the cassette casing 406 in the direction shown by an arrow 446 in FIG. 19-C.

Now, the removal of the cassette 52 from the cassette-receiving section 404 for change of copying papers or otherwise is described in detail. To remove the cassette 52 from the cassette-receiving section 404, the cassette 52 is moved in the direction shown by an arrow 448 in FIG. 19-C, whereupon the actuating section 440 of the cassette casing 406 immediately engages the auxiliary roller 438. Thus, the auxiliary roller 438 is rotated counterclockwise in FIG. 19-C in response to the movement of the cassette 52 in the direction of arrow 448 in FIG. 19-C, and therefore, the support shaft 436 and the paper feed rollers 54 are rotated counterclockwise in FIG. 19-C. The engagement of the actuating section 440 with the auxiliary roller 438 is maintained until the cassette 52 is moved in the direction of arrow 448 in FIG. 19-C and the cuts 416 formed at the front end wall of the cassette casing 406 match in position with the paper feed rollers 54 (i.e. until immediately after the paper feed rollrs 54 come out of engagement with the stack of copying papers 408 in the casing 406). Accordingly, until this time, the paper feed rollers 54 are positively rotated counterclockwise in FIG. 19-C in response to the movement of the cassette 52 in the direction of arrow 448 in FIG. 19-C. Thus, in the case of removing the cassette 52 as in the case of inserting it, the paper feed rollers 54 engage the copying papers 408, but the movement of the copying papers 408 is not hampered, and moreover, the topmost copying paper in the stack of copying papers 408 is not moved relative to the cassette casing 406 nor is wrinkled nor drops off forwardly from the cassette casing 406.

In spite of the relatively simple and inexpensive improvement made in accordance with this invention, the electrostatic copying apparatus of this invention can completely prevent wrinkling of the topmost copying paper in the stack of copying papers 408 in the cassette and its dropping from the cassette at the time of inserting or removing the cassette 52 into or from the cassette-receiving section 404. There is no need at this time for means of keeping the paper feed rollers 54 out of engagement with the copying papers 408, complicated and expensive special means such as the cam means and manually operable member disclosed in the specifications of Japanese Laid-Open Patent Publications Nos. 18337/74 and 18336/74, and for any complicated procedures such as the manual operation of the manually operable member other than a simple operation of moving the cassette 52 in the direction of arrow 444 in FIG. 19-A or in the direction of arrow 448 in FIG. 19-C.

While in the illustrated embodiment of the electrostatic copying paper in accordance with this invention, the auxiliary roller 438 is rotatably mounted coaxially with the paper feed rollers 54 by securing it to the support shaft 436 to which the paper feed rollers 54 are secured, it is possible to mount the auxiliary roller 438 rotatably at a suitable part of the cassette-receiving section 404 and drivingly connect it to the support shaft 436 and thus to the paper feed roller 54 by a suitable linking means such as a gear system. According to this modification, there is no need to make the outside diameter of the auxiliary roller 438 substantially equal to the outside diameter of the paper feed roller 54. Instead, for example, by properly selecting the number of teeth of the gear system constituting the linking system, the amount of movement of the cassette 52 can be made substantially equal to the amount of rotation of the surfaces of the paper feed rollers 54.

While in the illustrated embodiment, the actuating section 440 is provided in the front end portion of one side wall of the cassette casing 406, it is possible to provide the actuating section 440 at an arbitrary position at the front end portion of the cassette casing 406 according to the position of the auxiliary roller 438 disposed in the cassette-receiving section 404.

Furthermore, while in the illustrated embodiment, the amount of movement of the cassette 52 is made substantially equal to the amount of rotation of the surfaces of the paper feed roller 54 by making the outside diameter of the auxiliary roller 438 substantially equal to the outside diameter of the paper feed roller 54, some difference between the amount of movement of the cassette 52 and the amount of rotation of the surfaces of the paper feed rollers 54 will not cause any practical inconvenience if the amount of rotation of the surfaces of the paper feed rollers 54 is larger than the amount of movement of the cassette 52 at the time of inserting the cassette 52. For example, if the outside diameter of the auxiliary roller 438 is made smaller than the outside diameter of the paper feed roller 54, the surfaces of the paper feed rollers 54 are positively rotated clockwise in FIG. 19-A to an amount slightly larger than the amount of movement of the cassette 52 in the direction of arrow 444 in FIG. 19-A by the cooperation of the actuating section 440 with the auxiliary roller 438 at the time of inserting the cassette 52 into the cassette-receiving section 404 by moving it in the direction of arrow 444 in FIG. 19-A. Accordingly, when the cassette 52 is inserted into the predetermined position shown in FIG. 19-C, the topmost copying paper in the stack of copying papers 408 is delivered to some extent in the direction of arrow 466 in FIG. 19-C by the delivering action of the paper feed rollers 54 which are positively rotated. But in an electrostatic copying apparatus of the type in which a delivered copying paper is stopped at a predetermined position in its conveying path and then again moved forward upon the starting of the scanning and exposure of the original, the early delivery of the copying paper at the time of inserting the cassette as described above does not cause any inconvenience. When the cassette 52 is to be removed from the cassette-receiving section 404, the surfaces of the paper feed rollers 54 are rotated counterclockwise in FIG. 19-C in an amount slightly larger than the amount of movement of the cassette 52 in the directin of arrow 448 in FIG. 19-C. Thus, when the difference between the amount of movement of the cassette 52 and the amount of rotation of the surfaces of the paper feed rollers 54 is excessive, the topmost copying paper of the stack of copying papers 408 is positively driven rearwardly relative to the cassette casing 406, and therefore, likely to get wrinkled. If the outside diameter of the auxiliary roller 438 is made larger than that of the feed roller 54, the surfaces of the paper feed rollers 54 are rotated positively clockwise in FIG. 19-A only in an amount smaller than the amount of movement of the cassette 52 at the time of inserting the cassette 52 into the cassette-receiving section 404 by moving it in the direction of arrow 444 in FIG. 19-A. Thus, when the difference between the amount of movement of the cassette 52 and the amount of rotation of the paper feed roller 54 is excessive, the movement of the topmost paper in the stack of copying papers 408 is excessively hampered, and the paper is likely to get wrinkled. When the cassette 52 is moved in the direction of arrow 448 in FIG. 19-C and removed from the cassette-receiving section 404, the surfaces of the paper feeding rollers 54 can be positively rotated conterclockwise in FIG. 19-C only in a smaller amount than the amount of movement of the cassette 52. Accordingly, the topmost copying paper in the stack of copying papers 408 is displaced forward relative to the cassette casing 406 and projects slightly ahead of the cassette casing 406. So long as the amount of such projection is slight, however, there is no inconvenience such as the dropping of the copying paper from the cassette casing 406.

Second embodiment of the cassette-type paper feeding means

FIGS. 20-A and 20-B, FIGS. 21-A and 21-B and FIGS. 22-A and 22-B show a second embodiment of the cassete-type paper feeding means which can be used instead of the first embodiment described hereinabove.

Referring to FIGS. 20-A and 20-B and FIGS. 21-A and 21-B, the cassette-type paper feeding means is constructed of a copying paper cassette 502 and a cassette-receiving section 504 formed in the housing of the apparatus.

The cassette 502 has a generally box-like cassette casing 506. The casing 506 consists of a main body having a bottom wall 508, two side walls 510, a front wall 512 and a rear wall 514, and a closure plate 516 mounted detachably on the top surface of the main body. The closure plate 516 has its front end portion cut off, and therefore, the top surface of the front end portion of the cassette casing 506 is opened. On the bottom wall 508 of the cassette casing 506 is provided a bottom plate 518 at least the front end portion of which should be movable up and down. The bottom plate 518 in the illustrated embodiment extends from its rear end located slightly rearwardly of the intermediate point of the casing 506 in its longitudinal direction to a point near the front end of the casing 506. A pair of bending members 520 are formed at the rear end of the bottom plate 518. The bending members 520 are fitted in a pair of slots 522 formed at the bottom wall 508 of the casing 506. Accordingly, the bottom plate 518 is pivotable in the direction of an arrow 524 about its rear end, and by turning the bottom plate 518 in the direction of arrow 524, the front end portion of the bottom plate 518 is moved up and down. An elastic means formed of a spring 526 which urges the bottom plate 518 clockwise in FIG. 20-A is disposed between the bottom wall 508 and the bottom plate 518. Copying papers 528 in the stacked state can be easily placed within the casing 506 by removing the closure plate 516 from the main body of the cassette casing 506. The front portion of the stack of copying papers 528 is placed on the bottom plate 518, and therefore, elastically urged upwardly by the elastic action of the spring 526 which acts through the bottom plate 518. A pair of press members 530 adapted for engagement with both side portions of the front end of the copying papers 528 to restrict their upward movement are provided on both side portions of the front end of the top surface of the cassette casing 506. Thus, the front portion of the topmost copying paper in the copying papers 528 placed in the cassette casing 506 is maintained in a certain relation to the top surface of the cassette casing 506 irrespective of the number of copying papers in the stack.

The aforesaid construction of the cassette 502 is known. According to this invention, the cassette 502 further has a holding means for holding the bottom plate 518 in the descended position when the front end portion of the bottom plate 518 is pushed downwardly in resistance to the urging action of the spring 526.

In the illustrated embodiment, a substantially L-shaped spring 532 is fixed to the bottom surface of the front end portion of the bottom plate 518, and to the plate spring 532 is secured an anchor member 534 having a hook portion 534*a* at its free end. Since the anchor member 534 is secured to the bottom plate 518 through the plate spring 532, it can be displaced elastically in the longitudinal direction of the casing 506 with respect to the bottom plate 518. On the other hand, the bottom wall 508 of the cassette casing 506 has formed therein an opening 536 with which the hook portion 534*a* of the anchor member 534 can be engaged. Thus, when the front end portion of the bottom plate 518 is pushed downwardly in the state shown in FIG. 21-A, the hook portion 534*a* of the anchor member 534 engages the opening 536 to hold the bottom plate 518 in its descended position, as shown in FIG. 21-B.

Now, the cassette-receiving section 504 is described. The cassette-receiving section 504 is constructed of a cassette-receiving plate 538 fixed between the inner side plates 68*a* and 68*b* already described hereinabove, and a pair of guide members 540 fixed respectively to the inside surfaces of the inner side plates 68*a* and 68*b* above the cassette-receiving plate 538. The distance in the perpendicular direction between the cassette-receiving plate 538 and said pair of guide members 540 corresponds to the height of the cassette casing 506. When the cassette 502 is to be inserted into the cassette-receiving section 504, the bottom surface of the cassette casing 506 is positioned on the cassette-receiving plate 538, and the guide members 540 guide the top surface of the casing 506. On the other hand, in the illustrated embodiment, the width of the cassette casing 506 corresponds to the distance between the inner side plate 68*a* and 68*b* in the lateral direction. When the cassette 502 is to be inserted into the cassette-receiving section 504, a pair of the inner side plates 68*a* and 68*b* guide the two side surfaces of the cassette casing 506. An upstanding portion 541 extending upwardly in the perpendicular direction is formed at the front end of the cassette-receiving plate 538. When the cassette 502 is inserted into the cassette-receiving section 504, the front surface of the cassette casing 506 abuts the upstanding portion 541, thereby preventing further insertion of the cassette 502 into the cassette-receiving section 504. The cassette-receiving section 504 further includes a pair of paper feed rollers 54 secured to a support shaft 436 mounted rotatably between the inner side plates 68*a* and 68*b* as in the cassette-type paper feeding means illustrated in FIGS. 19-A to 19-C.

The aforesaid construction of the cassette-receiving section 504 is already known. According to this invention, the cassette-receiving section 504 further includes a releasing means for releasing the holding action of the holding means provided in the cassette 502 when the cassette 502 has been inserted into a predetermined position of the cassette-receiving section 504 (the position at which the front surface of the cassette casing 506 abuts the upstanding portion 541).

In the illustrated embodiment, a rectangular cut 542 is formed in the rear end portion of the cassette-receiving plate 538, and the bottom edge 544 of the cut 542 constitutes the releasing means (the operation of the bottom edge 544 will be described hereinbelow).

With reference to FIGS. 22-A and 22-B, the operation and advantage of the aforesaid cassette-type paper feeding means are described below.

In accommodating a plurality of sheet-like copying papers 528 in the stacked state in the cassette casing 506, the first step is to remove the closure plate 516 from the main body of the cassette casing 506. Then, the front end portion of the bottom plate 518 is pushed downward to bring the anchor member 534 into engagement with the opening 536 and thereby to hold the bottom plate in its descended position shown in FIG. 21-B. Subsequently, the copying papers 528 are placed on the bottom plate 518, and the closure plate 516 is mounted in position in the main body of the cassette casing 506. Thus, the cassette 502 assumes the state shown in FIG. 22-A. The cassette 502 in this state is inserted into the cassette-receiving section 504. During this inserting operation, the bottom plate is held at its descended position as shown in FIGS. 22-A, and therefore, the copying papers 528 placed on the bottom plate are also held at their descended position. Accordingly, the topmost paper of the stacked copying papers 528 is located below the bottom surfaces of the paper feed rollers 54. Thus, the paper feed rollers 54 do not contact the copying paper, and the movement of the topmost copying paper is not obstructed by the paper feed rollers 54. On the other hand, when the cassette 502 is inserted into a predetermined position of the cassette-receiving section 504 (i.e., the position at which the front surface of the cassette casing 506 abuts the upstanding portion 541), the bottom edge 544 of the cut 542 formed in the cassette-receiving plate 538 abuts the hook portion 534*a* of the anchor member 534 to displace the anchor member 534 toward the right in FIGS. 22-A. As a result, the anchor member 534 comes out of the opening 536, and as shown in FIG. 22-B, the front end portion of the bottom plate 518 and the front end portion of the copying papers 528 placed on it are lifted by the urging action of the spring 526. When the front end portions of the bottom plate 518 and the copying papers 528 are lifted, a pair of the press members 530 engage the two side portions of the front end of the topmost copying paper of the stacked copying papers 528, and simultaneously, a pair of the paper feed rollers 54 engage the surface of the topmost copying paper 528 through the opening formed in the front end portion of the top surface of the cassette casing 506.

When the cassette 502 is removed from the cassette-receiving section 504 in the cassette-type paper feeding means described hereinabove with the casing 506 still containing copying papers 528, the cassette 502 is moved while the paper feed rollers 54 are in engagement with the surface of the topmost copying paper sheet 528. This brings about the problem that the topmost paper in the stacked copying papers 528 is displaced forwardly relative to the cassette casing 506. This problem, however, does not adversely affect the operation of the electrostatic copying paper, and is permissible unlike the problem which arises when the topmost copying paper 528 moves backward relative to the cassette casing when the cassette 502 is inserted into the cassette-receiving section 504.

Improvements in the cassette casing

The cassette casing used in the aforesaid copying paper cassette can be applied only to sheet-like copying papers of a single specified size. Cassette casings have already been suggested and put into practical use which are applicable to sheet-like copying papers having at least two different sizes.

In a known cassette casing which can be applied to sheet-like copying papers of at least two different sizes, a restricting plate for restricting the rear end of a sheet-like copying paper is mounted on the bottom wall of the main body of the cassette casing in such a manner that it can move freely along the longitudinal direction of the cassette casing (i.e., along the conveying direction of the sheet-like copying paper). The restricting plate is adapted to be moved to a predetermined position according to the size of sheet-like copying papers aand be screwed there. Accordingly, every time copying papers of a different size are used, it is necessary to move the restricting plate and screw it. The operation is, therefore, troublesome. Moreover, the size of sheet-like copying papers accommodated in the cassette casing cannot be identified when the cassette casing is capped with a closure plate. It is necessary to open the closure plate in order to identify the paper size.

According to this invention, however, there is provided a cassette casing for sheet-like copying papers of at least two different sizes, which permits fixing of the rear end of sheet-like copying sheets in the cassette casing by a simple operation and enables the size of the sheet-like copying sheets to be identified from outside the casing.

One embodiment of the cassette casing provided by the present invention is described in detail below with reference to FIGS. 23 to 28.

Figure 23:
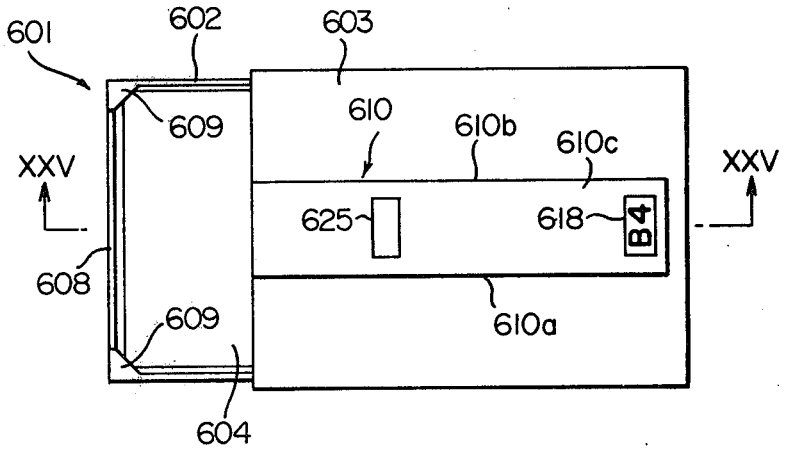
FIG. 23 is is a top plan view of a cassette casing improved by this invention.
Figure 24:
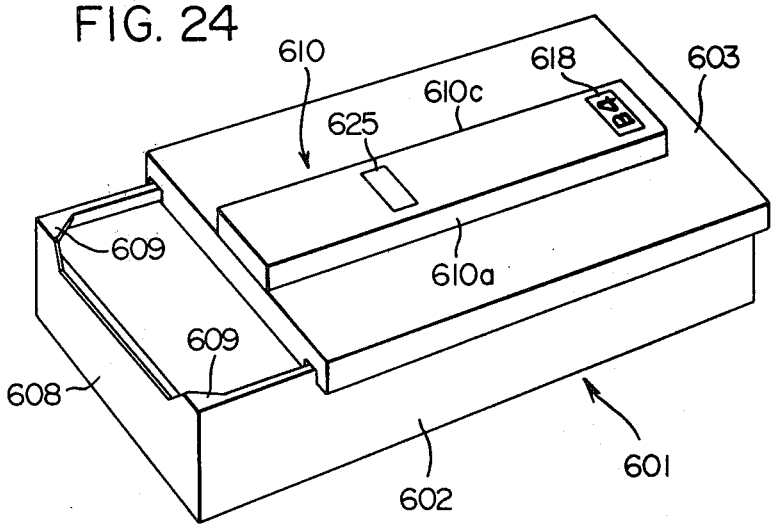
FIG. 24 is a perspective view of the cassette casing shown in FIG. 23.
Figure 25:
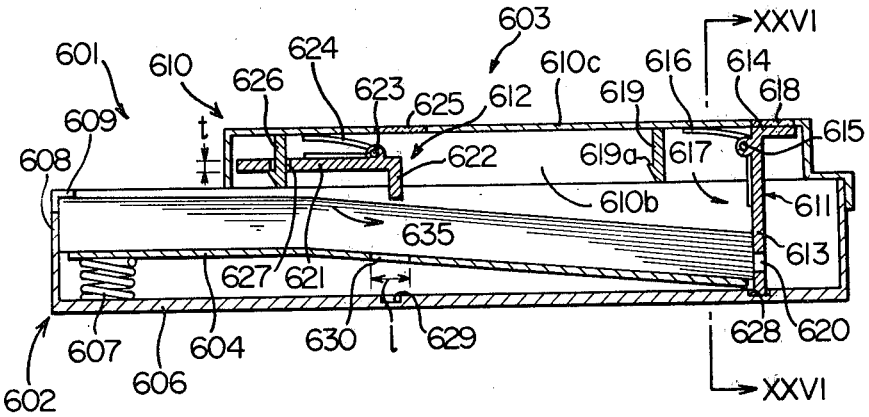
FIG. 25 is a sectional view taken along the line XXV—XXV of FIG. 23.

Referring to FIGS. 23, 24 and 25, the cassette casing 601 illustrated is constructed such that it can be applied to sheet-like copying papers of two different sizes, B4 and B5 according to JIS (Japenese Industrial Standards). The drawings show the accommodation of sheet-like copying papers with a B4 size in the cassette casing.

The cassette casing 601 includes a box-like housing 602 with an open top, and a closure plate 603 mounted removably on the top surface of the housing 602. A bottom plate 604 is disposed on the bottom wall of the housing 602, and a spring 607 for urging the front end portion of the bottom plate 604 upwardly is interposed between the bottom wall of the housing 602 and the bottom plate 604. Sheet-like copying papers in the stacked state are placed on the bottom plate 604. On both side portions of the front end of the top surface of the housing 602 are provided press members 609 with which both side portions of the front end of the copying papers come into abutment.

The aforesaid construction of the cassette casing 601 is already known. In the present invention, the casing 601 is improved in the following respect so that it can be applied to sheet-like copying papers of two different sizes, B5 and B4.

A protruded portion 610 projecting upwardly and extending in the longitudinal direction is formed centrally in the closure plate 603. A restricting member 611 for restricting the rear end of a copying paper of B4 size and displaying its size is provided within the protruded portion 610 at a position near its rear end in the longitudinal direction. A restricting member 612 for restricting the rear end of a copying paper of B5 size and displaying its size is provided ahead of the restricting member 611 in the longitudinal direction within the protruded portion 610.

Figure 26:
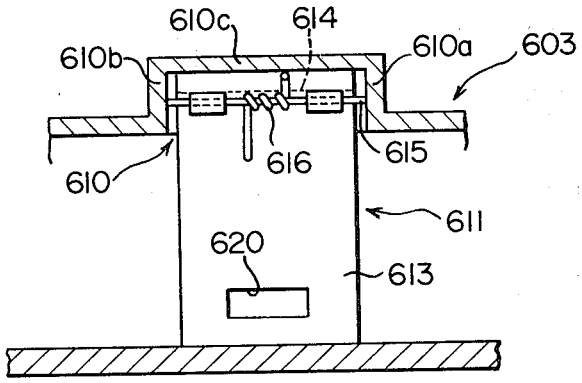
FIG. 26 is a sectional view taken along the line XXVI—XXVI of FIG. 25.

Referring to FIGS. 26, 27-A and 27-B, the restricting member 611 is formed in an L-shape and includes a restricting portion 613 for restricting the rear end of a copying paper of B4 size and a display portion 614 located substantially at right angles to the restricting portion 613 and having an indication of the size of the copying paper to be restricted. The connecting part between the restricting portion 613 and the display portion 614 is pivotably supported by a horizontal pin 615 provided at right angles to the longitudinal direction and extending between side walls 610*a* and 610*b* of the protruded portion 610. About the horizontal pin 615 is provided a torsion spring 616. One end of the torsion spring 616 abuts a top panel 610*c* of the protruded portion 610, and the other abuts the restricting member 613. Thus, the spring 616 urges the restricting member 611 about the horizontal pin 615 in a direction of an arrow 617. As clearly shown in FIG. 25, when the restricting portion 613 descends and the restricting member 611 is set at an operative position at which it restricts the rear end of copying paper, the display portion 614 abuts the top panel 610*c* of the protruded portion 610 to restrict the rotation of the restricting member 611 in a direction shown by an arrow 617. At that part of the top panel 610*c* with which the display portion 614 comes into abutment is formed a display window 618 made of a transparent or semitransparent material. When the display portion 614 is in contact with the display window 618, the indication "B4" attached to the display portion 614 can be viewed from above the closure plate 603.

Ahead of the horizontal pin 615, a downwardly extending engaging member 619 is secured to the top panel 610*c*. An engaging hole 620 is formed at that part of the restricting portion 613 which corresponds to the engaging member 619 when the restricting member 611 is rotated in a direction opposite to the direction of arrow 617 in resistance to the urging force of the torsion spring 616. For example, when copying papers of B5 size are to be accommodated in the cassette casing, the restricting member 611 is rotated in a direction opposite to the direction of arrow 617, and brought to its inoperative position at which the engaging hole 620 is held by the engaging portion 619*a* of the engaging member 619, whereby the restricting member 611 is set in the protruded portion 610.

The other restricting member 612 is of an L-shaped structure composed of a restricting portion 621 and a display portion 622, as in the restricting member 611. The connecting portion between the restricting portion 621 and the display portion 622 is supported pivotably by a horizontal pin 623 which lies parallel to the horizontal pin 615. The restricting member 612 is urged in the direction shown by an arrow 635 by a torsion spring 624, and ahead of the horizontal pin 623, an engaging member 626 similar to the engaging member 619 is fixed. A holding hole 627 is formed at that part of the restricting portion 621 which corresponds to the stop member 626. A display window 625 made of a transparent or semitransparent material is formed at that part of the top panel 610*c* with which the display portion 622 comes into abutment.

Referring to FIG. 28, a groove 628 is formed in the bottom wall 606 of the housing 602 of cassette casing 601 at a position which corresponds to the lower end of restricting member 613 when the restricting member 611 is brought to an operative position. The restricting member 611 is held in the operative position by fitting the lower end part of the restricting portion 613 of the restricting member 611 into the groove 628, thus preventing the rearward displacement of the rear end of copying paper beyond the restricting portion 613. A groove 629 similar to the groove 628 is formed in the bottom wall 606 at that position which corresponds to the lower end portion of the restricting portion 621 of the restricting member 612. In the bottom plate 604, a hole 630 is formed at a position corresponding to the restricting portion 621 of the restricting member 612. The lower end portion of the restricting portion 621 extends through the hole 630 and is fitted into the groove 629. The length l of the hole 630 is made larger than the thickness t of the restricting portion 621 of the restricting member 612 in view of the fact that the bottom plate 604 is displaced up and down.

In accommodating sheet-like copying papers of B4 size, the engagement of the engaging portion 619*a* of the engaging member 619 with the engaging hole 620 of the restricting member 611 is released. As a result, the restricting member 611 is rotated from the state shown in FIG. 27-A in the direction of arrow 617 as shown in FIG. 27-B by the urging force of the spring 616, and the display portion 614 stops on abutment with the display window 618. In this state, the restricting portion 613 descends. When the closure plate 603 is mounted on the top surface of the housing 602, the lower end portion of the restricting portion 613 is fitted into the groove 628, and the rear end of copying papers of B4 size is restricted by the restricting portion 613. At this time, the indication "B4" marked in the display portion 614 in contact with the display window 618 can be viewed from above the closure plate 603 through the display window 618, and thus, the size of copying papers accommodated in the cassette casing 601 can be identified.

In accommodating sheet-like copying papers of B5 size in the cassette casing 601, the restricting member 611 is rotated in a direction opposite to the direction of arrow 617 in resistance to the urging force of the spring 616 to engage the engaging hole 620 with the member 619. When the engagement of the member 626 with the engaging hole 627 of the restricting member 612 is subsequently released, the restricting member 612 is rotated in a direction of an arrow 635 by the urging force of the spring 624 to cause the restricting portion 621 to descend. When the closure plate 603 is mounted on the housing 602, the lower end portion of the restricting portion 621 extends through the hole 630 and is fitted in the groove 629. Since the display portion 622 at this time can be viewed from above the closure plate 603 through the display window 625, it is possible to ascertain that the copying papers with B5 size are placed in the cassette casing.

If desired, in the cassette casing 601 described above, the restricting portions 613 and 621 may be made of a magnetic material, and magnets can be secured instead of the engaging members 619 and 626 to the top panel 610*c*. Moreover, the display windows 618 and 625 may be constructed of simple openings formed in the top panel 610*c* of the protruded portion 610 instead of using a transparent or semitransparent material to make them. Alternatively, the entire top panel 610*c* or closure plate 603 may be formed of a transparent or semitransparent material to form one large display window in place of the two display windows 618 and 625. Furthermore, in order that the cassette casing 601 may be applied to the cassette-type paper feed means described hereinabove, the improvements made in the cassette casing 106 illustrated in FIGS. 19-A to 19-C or the improvements made in the cassette casing 506 shown in FIGS. 20-A to 20-B may be applied to the cassette casing 601.

Cleaning device

In the electrostatic copying apparatus illustrated in FIGS. 1 and 2, the developing station 20 is also utilized as a cleaning device for removing a developer remaining on the photosensitive member 82 (FIGS. 3 and 4) after transferring to a copying paper a developed image formed on the photosensitive member 82 disposed on the rotary drum. As is well known to those skilled in the art, it is also possible to provide a cleaning device for removing the developer remaining on the photosensitive member 82 separately from the developing station 20, for example at a position upstream of the corona discharge device 18 for charging in the rotating direction of the rotary drum 14.

Cleaning devices of various types have been suggested and put into practical use in the past, but all of them have the defect that they are complicated in structure or the developer removed from the photosensitive member scatters.

According to this invention, however, there is provided a cleaning device suitable for use when at least a part of the developer is magnetic, which is of relatively simple structure and inexpensive and which can completely prevent the scattering of the developer removed from the photosensitive member.

Figures 29, 30, 31:
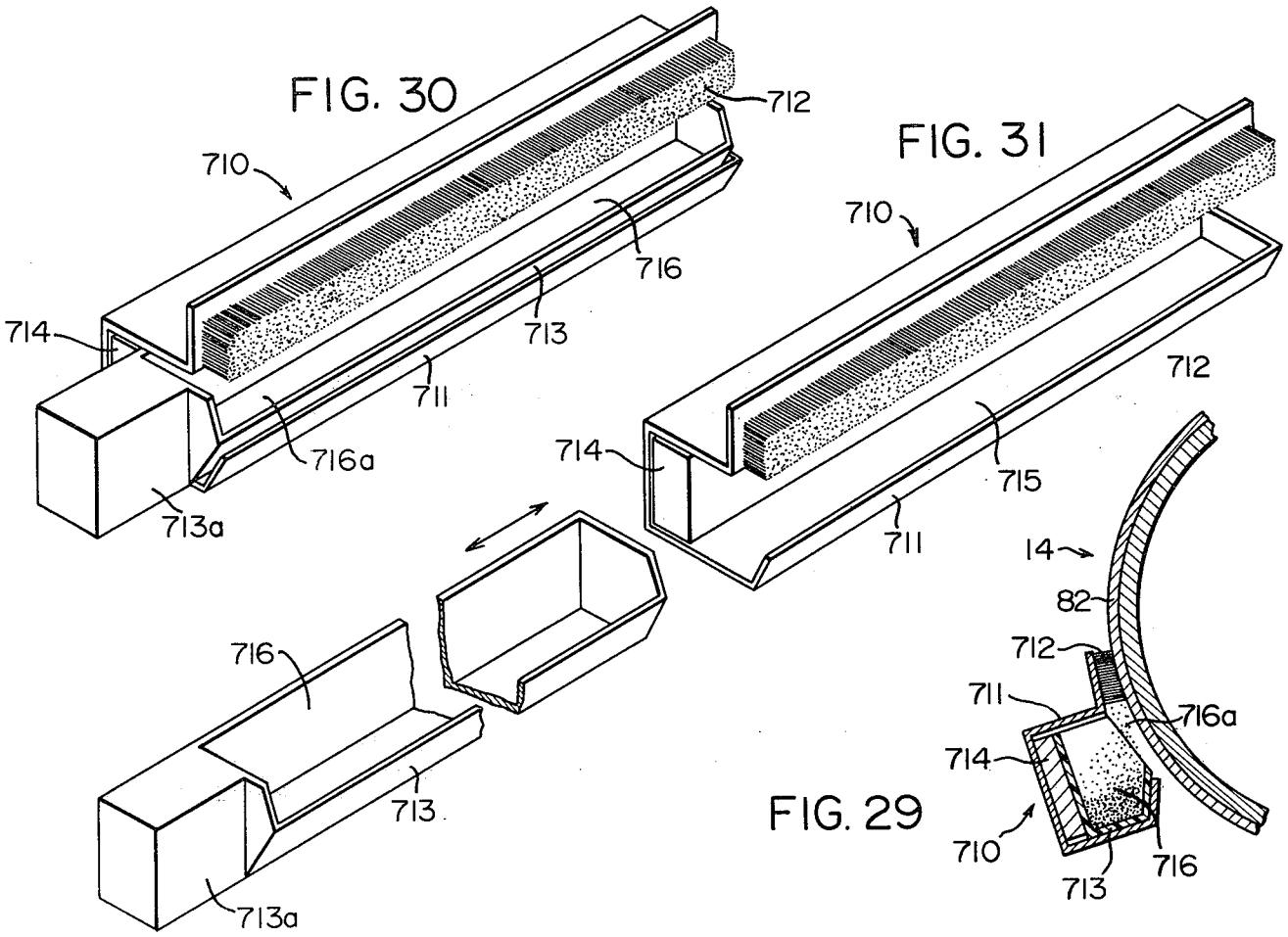
FIG. 29 is a partial sectional view showing a cleaning station.
FIG. 30 is a perspective view of the cleaning station shown in FIG. 29.
FIG. 31 is an exploded perspective view of the cleaning station shown in FIG. 29.

Referring to FIGS. 29 and 31, one embodiment of the cleaning device is described.

The illustrated cleaning device 710 is made of a nonmagnetic material of low magnetic permeability such as aluminum or plastics, and consists of a support 711 mounted within the housing 2 (FIGS. 1 and 2), a sweeping member 712 fixed to support 711 so as to make contact with the surface of the photosensitive member 82 on the rotary drum over the entire width of the photosensitive member 82, a developer receiving tray 713 mounted detachably on the support 711, and a magnet 714 for generating a magnetic field within the tray 713.

the support 711 has a holding space 715 extending over the entire width of the rotary drum 14 along the axial line of the rotary drum 14 and having a top opening. One side end of the holding space 714 is opened, and the tray is introduced into the holding space 715 through this one side end. The receiving tray 713 has an accommodating portion 716 having a top opening. While the tray 713 is fitted in the space 715, an opening portion 716*a* opened above the accommodating portion 716 is positioned immediately below a position at which the sweeping member 712 formed of a brush comes into slidable contact with the photosensitive member 82. The magnet 714 is secured to the inside wall of the support 711 on the opposite side to the rotary drum with respect to the tray 713.

The residual developer on the photosensitive member 82 is swept away from the surface of the photosensitive member 82 by the sweeping member 712. The swept developer falls into the accommodating portion 716 of the tray through the opening 716*a* by its own weight. Since the tray 713 is made of a non-magnetic material, the magnetic field of the magnet 714 readily reaches the inside of the accommodating portion 716, and the developer stored in the storing portion 716 is held by the magnetic field. Hence, the developer which has fallen into the storing portion 716 of the tray 713 is prevented from scattering.

In discharging the developer within the storing portion 716, a knob 713*a* of the tray 713 is grasped and the tray 713 is pulled out from one open side portion of the space 715 in the direction of the axial line of the rotary drum as shown in FIG. 31. Subsequently, the developer is discharged from the tray. Since the tray 713 is made of a non-magnetic material, the developer is not magnetically attracted to the inside surface of the tray 713, but can be discharged easily.

The support 711 can be made of a magnetic material having a high magnetic permeability. In this case, the magnet 714 is secured to the inside wall of the support 711.

The sweeping member 712 may be made of a blade instead of the brush.

The cleaning device described above is applicable not only to a developer composed only of a magnetic toner, but also to a developer composed of a magnetic toner and a magnetic carrier, a developer composed of a magnetic toner and a nonmagnetic carrier, and a developer composed of a nonmagnetic toner and a magnetic carrier.

Operation repeating counter

In an electrostatic copying machine of the type shown in FIGS. 1 and 2, it is frequently desired to operate the apparatus repeatedly a required number of times and then automatically stop its operation, thereby obtaining the required number of copies or printed matters without the need for any special operation excepting initial operations such as the actuation of a start switch.

In such a case, it is convenient to utilize an operation repeating counter to be described hereinbelow with reference to FIGS. 32 to 35, which includes separate counter wheels corresponding to the individual places of a preset number of repeating cycles, thus not limiting a presettable number of cycles to a small one, and which is relatively simple in structure and relatively inexpensive.

Figure 32:
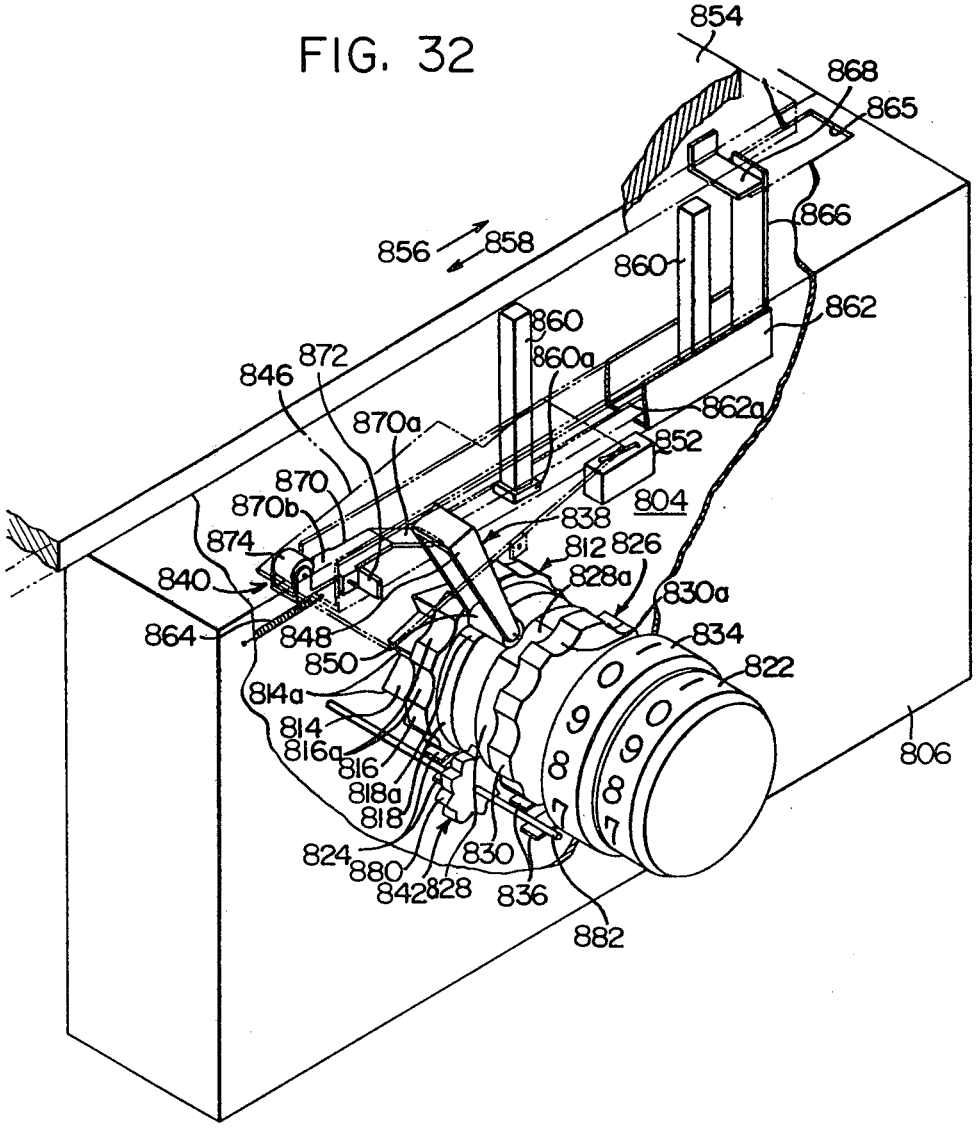
FIG. 32 is a partial broken-away perspective view showing one embodiment of an operation repeating counter.
Figure 33:
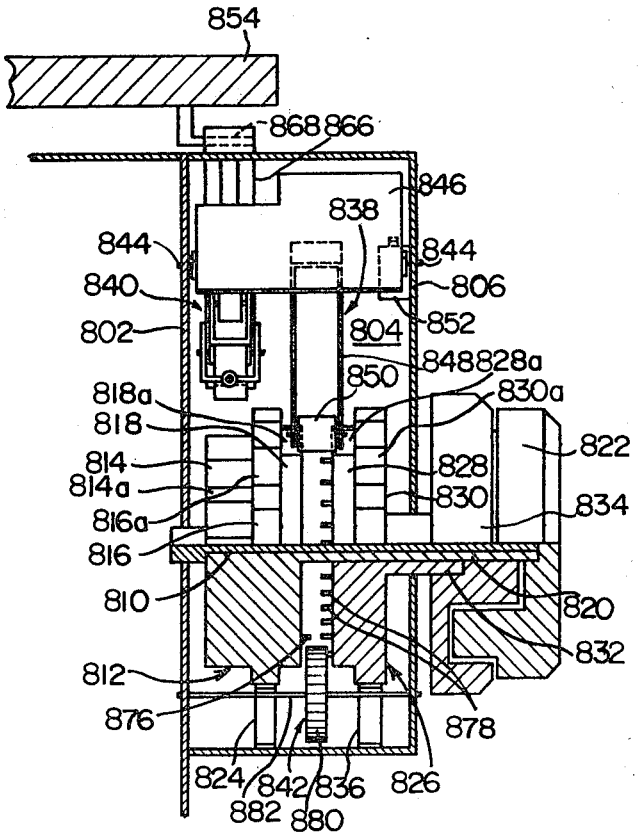
FIG. 33 is a sectional view of the operation repeating counter shown in FIG. 32.

Referring to FIGS. 32 and 33, the illustrated operation repeating counter includes a frame member 806 which is fixed to one side plate 802 (which may, for example, be the inside inner side plate 68*a* shown in FIG. 3) of an electrostatic copying apparatus whose operation is desired to be repeated through a plurality of cycles, and forms a counter housing 804 in cooperation with the side plate 802. To the side plate 802 is fixed a support shaft 810 one end of which (the right end of FIG. 33) projects outwardly beyond the frame member 806. A one-figure count wheel 812 is rotatably mounted on the support shaft 810. The one-figure count wheel 812 consists of a ratchet portion 814, a positioning wheel portion 816, a cam disc portion 818 and a shaft portion 820 extending outwardly from the cam disc 818 beyond the frame member 306, and a grasping disc plate portion 822 for manual operation located exteriorly of the counter housing 804 and fixed to the projecting end of the shaft portion 820. The one-figure count wheel 812 is rotated about the support shaft 810 integrally therewith by manually operating the grasping disc portion 822 or by the action of a mechanism for rotating the one-figure count wheel which is to be described in detail hereinbelow. The ratchet portion 814 of the one-figure count wheel 812 has formed along its peripheral surface ten teeth 814*a* (see FIGS. 34-A and 34-B also). The positioning wheel portion 816 of the one-figure count wheel 812 has formed on its peripheral surface ten arcuate depressions 816*a*. On the other hand, a substantially U-shaped elastic member 824 (in FIG. 32, only the two leg portions of the elastic member 824 are shown) is secured to the bottom surface of the frame member 806 through a suitable support member (not shown), and the curved forward end of the elastic member 824 elastically engages one of the ten arcuate depressions 816*a* formed on the periphery of the positioning wheel portion 816. It will be apparent therefore that the one-figure count wheel 812 has ten rotating angular positions at which the elastic member 824 respectively engages the ten arcuate depressions 816*a* of the positioning wheel portion 816, and the count wheel 812 is elastically held at any of these ten angular positions by the action of the elastic member 824. The aforesaid ten angular positions correspond respectively to whole numbers from 0 to 9. On the peripheral surface of the cam disc portion 818 of the one-figure count wheel 812 is formed an arcuate depression 818*a* corresponding to one specific angular position (in the drawing, the angular position corresponding to 0) of the ten angular positions described above. Numbers from 0 to 9 are marked, for example, on the peripheral surface of the grasping disc portion 822 corresponding respectively to the ten angular positions of the one-figure count wheel 812.

On the shaft portion 820 of the one-figure count wheel 812 is rotatably mounted a two-figure count wheel 826. The two-figure count wheel 826 consists of a cam disc portion 828 spaced some distance from the cam disc portion 818 of the one-figure count wheel 812 in the axial direction, a positioning wheel portion 830, a shaft portion 832 extending outwardly of the positioning wheel portion 830 beyond the frame member 806, and a grasping disc portion 834 for manual operation fixed to the projecting end of the shaft portion 832 and positioned outwardly of the counter housing 804 and inwardly of the grasping disc portion 822 of the one-figure count wheel 812. The two-figure count wheel 826 is rotated about the shaft portion 820 of the one-figure count wheel integrally therewith by manually operating the above grasping disc portion 834 or by the action of a mechanism for rotating the two-figure count wheel which is to be described in detail hereinbelow. Like the positioning wheel 816 of the one-figure count wheel 812, the positioning wheel portion 830 of the two-figure count wheel 826 has formed on its peripheral surface ten arcuate depressions 830*a*, and an elastic member 836 similar to the aforesaid elastic member 824 elastically engages any one of the ten arcuate depressions 830*a* of the positioning wheel portion 830. Accordingly, it will be apparent that like the one-figure count wheel 812, the two-figure count wheel 826 also has ten rotating angular positions corresponding to whole numbers from 0 to 9, and is elastically held at any one of these ten angular positions by the action of the elastic member 836. Like the cam disc portion 818 of the one-figure count wheel 812, the cam disc portion 828 of the two-figure count wheel 826 has formed an arcuate depression 828*a* corresponding to one specific angular position (in the drawings, the angular position corresponding to 0) of the ten angular positions. Numbers from 0 to 9 are marked, for example, on the peripheral surface of the grasping disc portion 834 of the two-figure count wheel 826 corresponding respectively to the ten angular positions described above.

The illustrated operation repeating counter is further provided with a detecting means 838, a means 840 for rotating the one-figure count wheel, and a means 842 for rotating the two-figure count wheel 842.

Referring to FIGS. 34-A and 34-B taken in conjunction with FIGS. 32 and 33, the detecting means 838 detects the fact that both of the one-figure count wheel 812 and the two-figure count wheel 826 respectively take one specific angular position out of the ten angular positions (in the drawings, both these count wheels 812 and 826 take an angular position corresponding to 0). The detecting means 838 is constructed of a main body 846 pivotally mounted by a suitable mounted by a suitable means such as a pivot pin 844 between the side plate 802 and the side surface of the frame member 806 positioned opposite thereto, and a follower arm 848 extending downwardly from its upper end fixed to the main body 846 toward the cam disc portions 818 and 828. Preferably, a follower roller 850 is rotatably mounted on the free end of the follower arm 848. The detecting means 838 is urged counterclockwise in FIGS. 34-A and 34-B by its own weight or by the action of a suitable elastic member (not shown) which may be provided as desired, and the follower roller 850 mounted on the free end of the follower arm 848 abuts the peripheral surfaces of both cam disc portions 818 and 828.

Thus, when both of the one-figure count wheel 812 and the two-figure count wheel 826 take specific angular positions (corresponding to 0), the depressions 818*a* and 828*a* of the cam disc portions 818 and 828 take positions which match the follower roller 850. As a result, the follower roller 850 is fitted into the depressions 818*a* and 828*a*, and the detecting means 838 is brought to the detecting position shown in FIG. 34-A. On the other hand, when one or both of the one-figure count wheel 812 and the two-figure count wheel 826 are at angular positions other than the aforesaid specified angular positions, the follower roller 850 abuts that part of either one or both of the cam disc portions 818 and 828 which is other than the depressions 818*a* and 828*a*. Hence, the follower arm 848 cannot be fitted into the depressions 818*a* and 828*a*, and the detecting means 838 is held at the inoperative positions shown in FIG. 34-B. In the illustrated embodiment, a switch 852 is further provided in relation to the detecting means 838. When the detecting means 838 is held in its inoperative position, one end portion of the main body 848 of the detecting means 838 presses an actuator of the switch 852 to maintain the switch 852 in a closed condition (FIG. 34-B). When the detecting means 838 is brought to the detecting position, the one end portion of the main body 846 of the detecting means 838 moves away from the actuator of the switch 852 to maintain the switch 852 in an open condition.

Referring to FIGS. 32, 34-A and 34-B, the one-figure count wheel rotating means 840 is described which rotates the one-figure count wheel 812 by a predetermined amount in a predetermined direction every time the copying apparatus operates through one cycle.

The electrostatic copying apparatus includes a reciprocating member 854 (which may, for example, be the support frame 6 of the original-support means shown in FIG. 1) which is reciprocated once through a predetermined path during one cycle of operation of the apparatus. The rotating means 840 is reciprocated according to the reciprocating movement of the reciprocating member 854 to rotate the one-figure count wheel 812 by a predetermined amount in a predetermined direction every time the reciprocating member 854 reciprocates once. In the specific embodiment shown in the drawings, every time the apparatus operates through one cycle (one copying cycle), the reciprocating member 854 first moves from the initial position shown by the solid line in FIGS. 34-A and 34-B to the position shown by the two-dot chain line in FIG. 34-B in the direction shown by arrow 856, then moves from this position in the opposite direction, i.e. the direction shown by arrow 858, to a predetermined position (not shown) beyond the initial position, and thereafter again moves in the direction shown by arrow 856 and returns to the initial position. The rotating means 840 is constructed such that it rotates the one-figure count wheel 812 through 1/10 turn clockwise (in the direction of counting backward from 9 to 0) in FIGS. 32, 34-A and 34-B while the reciprocating member 854 moves from the initial position shown by the solid line in FIGS. 34-A and 34-B to the position shown by the two-dot chain line in FIG. 34-B.

The construction of the rotating means 840 for the one-figure counter wheel 812 in the illustrated embodiment is described below. A pair of support posts 860 are provided at a predetermined interval therebetween in the moving direction of the reciprocating member 854. The upper ends of these support posts 860 are secured to the top surface portion of the frame member 806, and an enlarged portion 860*a* is formed at the lower free end of each of the posts 860. A sliding member 862 with an elongated slit 862*a* having a width larger than the width of the main portion of the support post 860 but smaller than the width of the enlarged portion 860*a* and extending in the moving direction of the reciprocating member 854 is secured to said pair of support posts 860 by positioning the slit 862*a* at the main portions of the support posts 860, so that the sliding member 862 is freely slidable in the moving direction of the reciprocating member 854, i.e. in the directions shown by arrows 856 and 858. An elastic member 864 is interposed between the left end of the sliding member 862 and the left end surface of the frame member 806, and the sliding member 862 is elastically held at the position shown by the solid line in FIGS. 34-A and 34-B by the elastic urging action of the elastic member 864. At the right end portion of the sliding member 862 is provided a follower piece 866 which projects upwardly through an opening 865 formed on the top surface of the frame member 806. On the other hand, to the under surface of the reciprocating member 854 is fixed an actuating piece 868 which is so positioned that when the reciprocating member 854 is at the initial position shown by the solid line in FIGS. 34-A and 34-B, it abuts the left-hand surface of the follower piece 866. A pawl member 870 is pivotably mounted on the left end portion of the sliding member 862. The pawl member 870 is urged to the operative position shown in FIG. 34-B (i.e., the position at which it abuts a stop piece 872 provided in the undersurface of the left end portion of the sliding member 862) by its own weight or by the action of a suitable elastic member (not shown) which may be provided as required. The pawl member 870 has an actuating pawl 870*a* which projects downwardly by a predetermined length beyond the sliding member 862 when it is at the position shown in FIG. 34-B and which engages the teeth 814*a* of the ratchet portion 814 when the sliding member 862 slides as described hereinbelow, and a follower portion 870*b* which extends upward beyond the sliding member 862 and to the forward end of which a follower roller 874 is rotatably secured. As is apparent from FIG. 34-A, when the detecting means 838 moves away from the non-operative position shown in FIG. 34-B and reaches the detecting position shown in FIG. 34-A, one end of the main body 846 of the detecting means 838 abuts the follower roller 874 mounted on the follower portion 870*b* of the pawl member 870 to turn the pawl member 870 counterclockwise in FIGS. 34-A and 34-B from the operative position shown in FIG. 34-B to the non-operative position shown in FIG. 34-A in resistance to the aforesaid urging action. On the other hand, when the detecting means 838 moves from the detecting position shown in FIG. 34-A to the non-detecting position shown in FIG. 34-B, one end of the main body 846 of the detecting means 838 moves away from the pawl member 870, whereby the pawl member 870 returns to the operative position shown in FIG. 34-B by the aforesaid urging action.

In the one-figure count wheel rotating means 840 described hereinabove, the reciprocating member 854 abuts the follower piece 866 of the sliding member 862. Accordingly, when the reciprocating member 854 moves in the direction of arrow 856 from the initial position shown by the solid line in FIGS. 34-A and 34-B to the position shown by the two-dot chain line shown in FIG. 34-B, the sliding member 862 also moves from the position shown by the solid line in FIGS. 34-A and 34-B to the position shown by the two-dot chain line in FIG. 34-B in resistance to the urging action of the elastic member 864. When the pawl member 870 is at the operative position shown in FIG. 34-B during such a movement of the sliding member 862, the actuating pawl 870*a* of the pawl member 870 engages one of the ten teeth 814*a* of the ratchet portion 814. As a result, the ratchet portion 814 is rotated through 1/10 turn clockwise in FIGS. 34-A and 34-B, and the one-figure count wheel 812 is turned from the aforesaid one specified angular position to the adjacent angular position in the backward counting direction. As will be readily appreciated from FIG. 34-A, when the pawl member 870 is at the non-operative position shown in FIG. 34-A, the movement of the sliding member 862 does not cause the abutment of the actuating pawl 870*a* of the pawl member 870 with the teeth 814*a* of the ratchet portion 814, and therefore, the one-figure count wheel 812 is not rotated. When the reciprocating member 854 moves in the direction of arrow 858 from the position shown by the two-dot chain line in FIG. 34-B, the elastic urging action of the elastic member 864 causes the sliding member 862 to return to the position shown by the solid line in FIGS. 34-A and 34-B. When the pawl member 870 is located at the operative position shown in FIG. 34-B during this movement of the sliding member 862, the actuating pawl 870*a* of the pawl member 870 engages the teeth 814*a* of the ratchet portion 814. As a result, the pawl member 870 is turned counterclockwise in FIG. 34-B from its operative position in resistance to the aforesaid urging action, and the ratchet portion 814 and the one-figure count wheel 812 will not be rotated.

In the illustrated embodiment, the pawl member 870 is held in the inoperative position when the detecting means 838 is at the detecting position, but it is not always necessary to have this construction. If, however, the pawl member 870 is at the operative position while the detecting means 838 is still at the detecting position, the one-figure count wheel 812 will be rotated in the backward counting direction even when the apparatus is operated through one cycle independently of the action of the operation repeating counter. While in the illustrated embodiment, the one-figure count wheel 812 is rotated when the rotating means 840 (i.e., the sliding member 862, the pawl member 870, etc.) reciprocating in response to the reciprocating member 854 moves forth, it is possible, if desired, to rotate the one-figure count wheel 812 when the rotating means 840 moves back in its reciprocating movement.

Referring to FIGS. 32 and 33, the two-figure count wheel rotating means 842 interposed between the one-figure count wheel 812 and the two-figure count wheel 826 is described.

The rotating means 842 in the illustrated embodiment is constructed of one pin 876 provided at a predetermined position on the right side surface of the cam disc portion 818 of the one-figure count wheel 812, ten pins 878 provided at equal angular intervals on the left side surface of the cam disc portion 828 of the two-figure count wheel 826, and a gear 880 cooperating with these pins 876 and 878. The gear 880 is rotatably disposed at a predetermined position by mounting its shaft 882 rotatably on the side plate 802 of the apparatus and the side surface portion of the frame member 806 located opposite thereto.

In the rotating means 842, when the one-figure count wheel 812 is rotated from a specified angular position (the position corresponding to 0 in the illustrated embodiment) to the next angular position (the position corresponding to 9 in the illustrated embodiment) in a predetermined direction (in the illustrated embodiment, clockwise, i.e. in the backward counting direction), the pin 876 on the cam disc portion 818 meshes with the gear 880 to rotate the gear 880 by a predetermined amount in a predetermined direction (counterclockwise in the illustrated embodiment). As a result, the gear engages any one of the ten pins 878 provided in the cam disc portion 828 to rotate the cam disc portion 828 by a predetermined amount (i.e., through 1/10 turn) in a predetermined direction (clockwise, i.e. the backward counting direction, in the illustrated embodiment), whereby the two-figure count wheel 826 is rotated from one of the aforesaid ten angular positions to the next adjacent angular position in a predetermined direction (clockwise, i.e. in the backward counting direction). When the one-figure count wheel 812 rotates from any of the 9 angular positions excepting the specified angular position (the angular position corresponding to 0 in the illustrated embodiment) in a predetermined direction (clockwise, i.e. in the backward counting direction, in the illustrated embodiment), the pin 876 provided on the cam disc portion 818 does not engage the gear 880, and therefore, the gear 880 and the two-figure count wheel 826 are not rotated.

The rotating means 842 for the two-figure count wheel 826 is not limited to the above-described construction, and can take any construction so long as it can perform the function of transmitting to the two-figure count wheel 826 the rotation of the one-figure count wheel 812 from a specified angular position to the next adjacent angular position in a predetermined position, and rotating the two-figure count wheel 826 from one of its ten angular positions to the next adjacent angular position in a predetermined direction. For example, there can be used a known mechanism which is utilized in a manually operative counter in which counting increases every time its push button or lever is pushed by a finger.

Now, the operation and advantage of the operation repeating counter described hereinabove is described in regard to the copying cycle in the electrostatic copying apparatus shown in FIGS. 1 and 2 which comprises primarily charging the photosensitive member 82 on rotary drum 14, projecting an image of an original onto the photosensitive member 82 to form a latent electrostatic image on the photosensitive member, developing the latent electrostatic image, and transferring the developed image to a copying paper.

During one cycle of copying in the electrostatic copying apparatus shown in FIGS. 1 and 2, the reciprocating member 854 which may be the support frame 6 of the original-support means 4 first makes a preparatory movement from its initial position shown by the solid line in FIGS. 34-A and 34-B to the exposure initiating position shown by the two-dot chain line in FIG. 34-B in the direction of arrow 856, then makes an exposing movement from the aforesaid exposure initiating position in the direction of arrow 858 to a predetermined exposure terminating position (not shown) beyond the aforesaid initial position, and thereafter makes a returning movement to the initial position in the direction shown by arrow 856.

Figure 35:
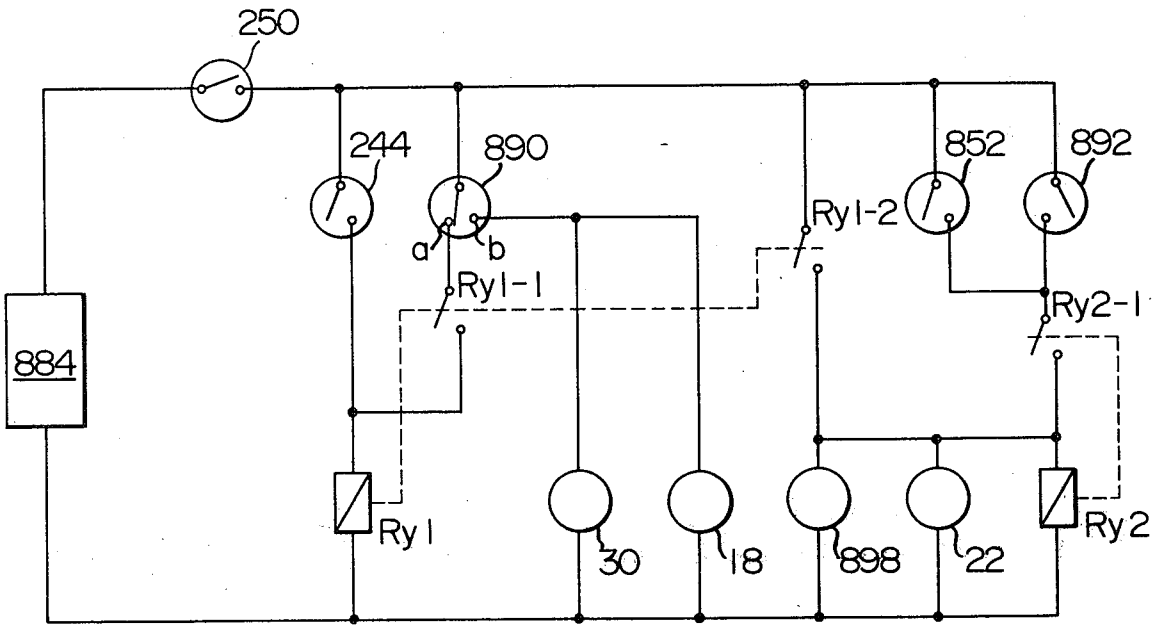
FIG. 35 is a circuit diagram showing a control circuit of an electrostatic copying apparatus to which an operation repeating counter is to be applied.

The electrostatic copying apparatus includes a control circuit shown in FIG. 35. In the control circuit shown in FIG. 35, a switch shown at 852 is controlled by the operation repeating counter described hereinabove, and corresponds to the switch 852 shown in FIGS. 32, 33, 34-A and 34-B. Other known constituent elements of the control circuit in FIG. 35 are briefly listed below.

884: a power source
250: a main switch (see FIG. 13 also)
244: a copying start switch (see FIG. 13 also)
890: a lamp switch
892: a switch for stopping the original-support means
30: a lamp for illuminating an original placed on the original-support means (see FIG. 2 also)
18: a corona discharge device for charging (see FIG. 2 also)
898: a drive motor for driving the rotary drum, the original-support means, the paper conveying device, etc.
22: a corona discharge device for transfer (see FIG. 2 also)
$R_Y$1: a relay having normally open contacts $R_Y$1-1 and $R_Y$1-2
$R_Y$2: a relay having a normally open contact $R_Y$2-1

The main switch 250 is opened or closed by manual operation. The copying start switch 244 is temporarily closed by pressing, but returns to an open position upon releasing of the pressing. The lamp switch 890 is constructed such that when the reciprocating member 854 is brought to the aforesaid exposure initiating position, the switch shifts from contact a side to contact b side, and during the exposing movement of the reciprocating member 854 (i.e. until it reaches the exposure terminating position), it is mechanically held at the contact b side, and that when the reciprocating member 854 reaches the exposure terminating position, it is returned to the contact a side. The switch 892 for the original-support means is constructed such that it is open only when the reciprocating member 854 makes a returning movement and reaches its initial position (it does not become open even when the reciprocating member 854 goes past the initial position at the time of exposing movement).

When it is desired to obtain only one copy in the electrostatic copying apparatus having the control circuit described above, it is not necessary to use the operation repeating counter. Thus, at this time, the operation repeating counter is such that both the one-figure count wheel 812 and the two-figure count wheel 826 are at angular positions corresponding to 0. Thus, the depression 818*a* of the cam disc portion 818 of the one-figure count wheel 812 and the depression 828*a* of the cam disc portion 828 of the two-figure count wheel 826 are positioned in coordination with the follower roller 850 of the detecting means 838, and the detecting means 838 is at the detecting position shown in FIG. 34-A. Accordingly, the switch 852 is open, and the pawl member 870 of the rotating means 840 for the one-figure count wheel 812 is in the inoperative position shown in FIG. 34-A.

To obtain one copy in such a state, namely to operate the electrostatic copying apparatus through one cycle, the main switch 250 is closed and the start switch 244 is pushed. As a result, the relay $R_Y$1 is energized to close the contacts $R_Y$1-1 and $R_Y$1-2. When the contact $R_Y$1-1 is closed, the relay $R_Y$1 is energized through the contact a of the lamp switch 890. Hence, even when the pressing of the copying start switch 244 is released and the switch 244 is open, the contacts $R_Y$1-1 and $R_Y$1-2 of the relay $R_Y$1 are selfmaintained. As a result, power is supplied to the drive motor 898 and transfer corona discharge device 22 through the contact $R_Y$1-2, and the operation of the drive motor 898 starts the operation of the rotary drum 14 (FIG. 2), etc. Simultaneously, the reciprocating member 854 is caused to make a preparatory movement from its initial position (the position shown by the solid line in FIGS. 34-A and 34-B) to the exposure initiating position (the position shown by the two-dot chain line in FIG. 34-B). At the same time, the relay $R_Y$2 is energized through the contact $R_Y$1-2 to close its contact $R_Y$2-1. Furthermore, as soon as the reciprocating member 854 begins to move toward the exposure starting position, the switch 892 for stopping the original-support means is closed. When the reciprocating member 854 reaches the exposure starting position, the lamp switch 890 turns from the contact a side to the contact b side to supply power to the lamp 30 and charging corona discharge device 18 and put them in operation. Since the lamp switch 890 is turned from the contact a side to the contact b side at this time, the self-maintenance of the relay $R_Y$1 is released, and its contacts $R_Y$1-1 and $R_Y$1-2 are open. But as the relay $R_Y$2 is kept energized through the closed switch 892, power is continuously supplied to the drive motor 898 and the transfer coro-a discharge device 22 through the stop switch 892 and the contact $R_Y$2-1 of the relay $R_Y$2 to keep them in operation. When the reciprocating member 854 makes an exposing movement from the exposure initiating position and reaches the exposure terminating position, the lamp switch 890 returns to the contact a side from the contact b side to stop the operation of the lamp 30 and the charging corona discharge device 18. When the reciprocating member 854 returns to the initial position from the exposure terminating position, the stop switch 892 for the original-support means is opened to stop the operation of the drive motor 898 and the transfer corona discharge device 22. Thus, the operation of the electrostatic copying apparatus stops and the reciprocating member 854 stops at its initial position.

When the reciprocating member 854 makes a preparatory movement from its initial position to its exposure starting position and further makes an exposing movement to the exposure terminating position in the aforesaid operation of the electrostatic copying apparatus, the sliding member 862 and the pawl member 870 which constitute the on-figure count wheel rotating means 840 are reciprocated. But as long as the one-figure count wheel 812 and the two-figure count wheel 826 of the operation repeating counter are at angular positions corresponding to 0, the pawl member 870 is at its inoperative position shown in FIG. 34-A. Accordingly, even when the sliding member 862 and the pawl member 870 are reciprocated, the one-figure count wheel 812 will not be rotated.

When it is desired to obtain a predetermined number of copies automatically by the action of the operation repeating counter in the electrostatic copying apparatus having the control circuit shown in FIG. 35, the apparatus is operated through a predetermined number of cycles as described below.

In this repeated operation, the first step is to set the one-figure count wheel 812 and the two-figure count wheel 826 at the desired angular positions by manually operating the grasping disc portion 822 of the wheel 812 and the grasping disc portion 834 of the wheel 826. Thus, the desired number of operating cycles, or the desired number of copies, is pre-set. As a result, at least either one of the cam disc portion 818 of the count wheel 812 or the cam disc portion 828 of the count wheel 826 assumes such a state that the depression 818*a* or 828*a* does not match the position of the follower roller 850 of the detecting means 838, and therefore, the detecting means 838 is in the inoperative position shown in FIG. 34-B thereby closing the switch 852. Furthermore, since the detecting means 838 is brought to the non-detecting position, the pawl member 870 of the rotating means 840 for the one-figure count wheel 812 is at the operative position shown in FIG. 34-B.

Thereafter, in the same way as in the case of obtaining one copy, the main switch 250 is closed and the start switch 244 is pushed. As a result, the operation of the electrostatic copying apparatus is performed in the same way as described above. When the reciprocating member 854 returns from the exposure terminating position to the initial position (the position shown by the solid line in FIGS. 34-A and 34-B) to complete one cycle of operation, the stop switch 892 for the original-support means is opened. Since, however, the switch 852 relating to the operation repeating counter is closed, the relay $R_Y$2 is kept energized through the switch 852 even after one cycle of operation is over. Accordingly, power is continuously supplied to the transfer corona discharge device 22 and the drive motor 898 through the switch 852 and the contact $R_Y$201 of the relay $R_Y$2. Thus, the reciprocating member 854 does not stop at the initial position but keeps moving toward the exposure starting position (the position shown by the two-dot chain line in FIG. 34-B). Thus, the electrostatic copying apparatus successively performs the next operation without being stopped on completion of one cycle of operation.

During one cycle of operation of the electrostatic copying apparatus, the reciprocating member 854 makes a preparatory movement in the direction of arrow 856 from its initial position (the position shown by the solid line in FIGS. 34-A and 34-B) to the exposure starting position (the position shown by the two-dot chain line in FIG. 34-B) and then makes an exposing movement in the direction of arrow 858 from the exposure initiating position to the exposure terminating position (not shown) beyond the initial position. When the reciprocating member 854 makes such a movement, the rotating means 840 for the one-figure count wheel 812 (i.e. the sliding member 862 and the pawl member 870 mounted thereon) moves forth from the position shown by the solid line in FIGS. 34-A and 34-B to the position shown by the two-dot chain line in FIG. 34-B, and further moves back from the position shown by the two-dot chain line shown in FIG. 34-B to the position shown by the solid line in FIGS. 34-A and 34-B. When the rotating means moves back as mentioned above, the actuating pawl 870*a* of the pawl member 870 at the operative position shown in FIG. 34-B engages one tooth 814*a* of the ratchet portion 814 to rotate the ratchet portion 814 through 1/10 turn clockwise in FIGS. 34-A and 34-B, and therefore, the one-figure count wheel 812 is rotated clockwise, i.e. in the backward counting direction, from one angular position to the next adjacent angular position. Thus, every time the electrostatic copying apparatus is operated through one cycle, the one-figure count wheel 812 is rotated through 1/10 turn to the next adjacent angular position in the backward counting direction by the action of the rotating means 840.

When the one-figure count wheel 812 is rotated from an angular position corresponding to 0 to an angular position corresponding to 9 (this occurs when the preset number of repeating cycles is 10 or more), the two-figure count wheel 826 is rotated through 1/10 turn from one angular position to the next adjacent angular position clockwise, i.e. in the backward counting direction, by the action of the rotating means 842. When the one-figure count wheel 812 is rotated from the angular position corresponding to 0 to the angular position corresponding to 9, the rotation of the one-figure count wheel 812 is transmitted to the two-figure count wheel 826 through the pin 876 provided on the side surface of the cam disc portion 818 of the count wheel 812 and the pin 878 provided at the side surface of the cam disc portion of the count wheel 826. As a result, the two-figure count wheel 826 is rotated in the backward counting direction from one angular position to the next adjacent angular position.

When the electrostatic copying apparatus is operated repeatedly and the final cycle of operation is performed, the reciprocating member 854 makes a preparatory movement from its initial position to the exposure starting position to move forth the rotary rotating means 840 and rotate the one-figure count wheel 812. As a result, both the two-figure count wheel 826 and the one-figure count wheel 812 take angular positions corresponding to 0. Thus, both the depression 818*a* of the cam disc portion 818 of the one-figure count wheel 812 and the depression 828*a* of the cam disc portion 828 of the two-figure count wheel 826 are brought to a position which matches the position of the follower roller 850 of the detecting means 838, and therefore, the detecting means 838 is brought to the detecting position shown in FIG. 34-A from the non-detecting position shown in FIG. 34-B. As a result, as shown in FIG. 34-A, the pawl member 870 of the rotating means 840 for the one-figure count wheel 812 is brought to the inoperative position, and the switch 852 which has been kept closed becomes open. When after the opening of the switch 852, the reciprocating member 854 returns to the initial position from the exposure terminating position by the final operation of the apparatus in the pre-set number of cycles, the stop switch 892 for the original-support means is opened. Since the switch 852 is already open, the relay $R_{Y}2$ is de-energized and power supply to the drive motor 898 and the corona discharge device 22 is stopped. Thus, the operation of the electrostatic copying apparatus is automatically stopped.

While in the illustrated embodiment, two count wheels, i.e. the one-figure count wheel 812 and the two-figure count wheel 826, are used, it is possible to provide further a three-figure count wheel (if required, four-figure or higher figure count wheels when it is desired to repeat the operation of the copying machine through more than 99 cycles. In this modification, a means for rotating the three-figure count wheel, similar to the two-figure count wheel rotating means 842, is provided so as to rotate the three-figure count wheel from one angular position to the next adjacent angular position when the two-figure count wheel 826 rotates from a specified angular position to the next adjacent angular position in a predetermined direction, and the detecting means 838 is so constructed that it is brought to the detecting position when all the count wheels take a specified angular position (for example, an angular position corresponding to 0).

What we claim is:

1. An electrostatic copying apparatus of the type in which a rotary drum having a photosensitive member on its surface is rotatably and detachably disposed at a predetermined location within a housing, said apparatus comprising a pair of inner side plates spaced apart from each other in the direction of the central axial line of rotation of said rotary drum, a guide and support member mounted at a predetermined location on the inside surface of each of said side plates, and formed in each said guide and support member, a bearing hole having a recess opened in a direction substantially perpendicular to said central axial line of rotation and at least one guide surface extending from said recess of said bearing hole in a direction substantially perpendicular to said central axial line of rotation, whereby when a selected site of each of both side portions of said rotary drum is moved along each said guide surface, each of said side portions of said rotary drum is positioned within each said bearing hole through each said recess to mount, said rotary drum rotatably and detachably in the direction substantially perpendicular to said central axial line of rotation.

2. The electrostatic copying apparatus of claim 1 wherein said rotary drum includes a shaft, a bearing member having a relatively small diameter disposed at each of the two side ends of said shaft, and a drum member secured to said shaft between said bearing members, the main surface of said drum member having said photosensitive member disposed thereon but the two side end portions of said drum member having a non-photosensitive area with substantially the same outside diameter to the surface of the photosensitive member; said guide surface formed in each of the guide and support members is composed of a first guide surface extending from the lower end of the recess of said bearing hole and a second guide surface extending inwardly of the first guide surface; and when each non-photosensitive area of said rotary drum is moved along each second guide surface, each of said bearing member of said drum is positioned on each first guide surface, and when each of said bearing members is moved along each first guide suface, each non-photosensitive area moves away from each second guide surface and each bearing member is positioned within each bearing hole through each said recess.

3. The electrostatic copying apparatus of claim 2 wherein a developing station is disposed around, and adjacent to, said rotary drum, said developing station comprising a hollow cylindrical developing sleeve extending substantially parallel to the central axial line of said rotary drum, a roll-like magnet member disposed within said sleeve, a pair of spacer rings having an outside diameter larger by a predetermined dimension than the outside diameter of said sleeve and provided rotatably and coaxially with said sleeve, a developer dispenser for supplying a developer to the peripheral surface of said sleeve, and a support frame for supporting said sleeve, magnet member, spacer rings and dispenser; and said support frame is pivotally mounted at a predetermined position between said pair of side plates, and the entire developing station is urged toward said rotary drum by its own weight or by the action of a suitable elastic means to cause each of said pair of spacer rings to abut each of said non-photoconductive area.

4. The electrostatic copying apparatus of claim 3 wherein said developing station is disposed rearwardly of said rotary drum when it is viewed in the moving direction of said rotary drum at the time of mounting said rotary drum.

* * * * *